US006231045B1

(12) United States Patent
Yamada et al.

(10) Patent No.: US 6,231,045 B1
(45) Date of Patent: May 15, 2001

(54) FINISHER FOR AN IMAGE FORMING APPARATUS

(75) Inventors: Kenji Yamada, Tokyo; Shinji Asami, Saitama; Hiroki Okada, Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/332,442

(22) Filed: Jun. 14, 1999

(30) Foreign Application Priority Data

| | | |
|---|---|---|
| Jun. 12, 1998 | (JP) | 10-165219 |
| Jun. 17, 1998 | (JP) | 10-170154 |
| Aug. 5, 1998 | (JP) | 10-221688 |
| Aug. 7, 1998 | (JP) | 10-224356 |
| Aug. 31, 1998 | (JP) | 10-245792 |
| Sep. 2, 1998 | (JP) | 10-248492 |
| Sep. 7, 1998 | (JP) | 10-252274 |
| Sep. 7, 1998 | (JP) | 10-252805 |
| Nov. 16, 1998 | (JP) | 10-325033 |
| Mar. 23, 1999 | (JP) | 11-077995 |

(51) Int. Cl.[7] ..... B65H 39/10

(52) U.S. Cl. ..... 271/292; 271/294; 271/298; 270/58.14; 270/58.19

(58) Field of Search ..... 271/292, 294, 271/298, 287, 288; 270/58.08, 58.14, 58.19

(56) References Cited

U.S. PATENT DOCUMENTS 5,236,189 * 8/1993 Ikoma ..... 271/292
5,374,043 * 12/1994 Mandel et al. ..... 270/58.14

FOREIGN PATENT DOCUMENTS

| | | | |
|---|---|---|---|
| 5-155507 | | 6/1993 (JP) . | |
| 5147817 | * | 6/1993 (JP) ..... | 271/292 |
| 8-26569 | | 1/1996 (JP) . | |
| 8-151161 | | 6/1996 (JP) . | |
| 8-169627 | | 7/1996 (JP) . | |
| 9-240909 | | 9/1997 (JP) . | |

* cited by examiner

*Primary Examiner*—David H. Bollinger
(74) *Attorney, Agent, or Firm*—Oblon, Spivak, McClelland, Maier & Neustadt, P.C.

(57) ABSTRACT

A finisher for finishing papers sequentially driven out of an image forming apparatus includes a plurality of trays selectively movable to a single paper outlet. The finisher reduces a period of time necessary for designated one of the trays to reach the paper outlet, increases the number of papers which can be stacked on the trays, and determines the number of papers stacked with a simple configuration. Papers are prevented from returning from the tray to the paper outlet without complicating the configuration of the outlet. An outlet roller protrudes from the paper outlet, but does not interfere with the tray moving past the paper outlet. The trays protect the operator from injury and protect the structural elements of the finisher from damage despite their movement.

12 Claims, 65 Drawing Sheets

51
60
62
64
41a
58
2
8
34
70
42a
43
35
SN9
32
SN7
41b
34

32
2
SN9
60
62
64

(TO TRAY 2)

START
RAISE UPPER TRAY 1
S1
S2
PRESELECTED PERIOD OF TIME ELAPSED ?
NO
ABOUT (0.1~0.5S)
YES
RAISE TRAY 2
S3
S4
SENSOR SN5 ON ?
NO
S13
SENSOR SN6 ON ?
NO
YES
STOP RAISING UPPER TRAY 1
S5
YES
STOP RAISING TRAY 2
S14
S6
SENSOR SN6 ON ?
NO
YES
J6
J5

START

RECEIPT OF PAPER OUTPUT REQUEST FROM APPARATUS
S1
REPORT STAND-BY CONDITION TO APPARATUS
S2
S3
TO PAPER 1 ?
TO TRAY 2
NO
YES
LOWER TRAY 2 AT SPEED 1
S4
(SPEED 1 > SPEED 2)
S21

LOWER TRAY 1 AT SPEED 2
S5
S6
SENSOR SN7 ON ?
NO
S15
YES
SENSOR SN6 ON ?
NO
STOP LOWERING TRAY 2
S7
YES
STOP LOWERING TRAY 1
S16
S8
SENSOR SN6 ON ?
NO
YES
J8
J7

FINISHER FOR AN IMAGE FORMING APPARATUS

BACKGROUND OF THE INVENTION

The present invention relates to an electrophotographic copier, printer, facsimile apparatus or similar image forming apparatus and more particularly to a finisher for finishing papers driven out of an image forming apparatus.

A finisher for the above application is taught in, e.g., Japanese Patent Laid-Open Publication No. 8-26579. The finisher includes a single tray counted on one side thereof. A staple mode and a shift mode are available with the finisher. In the staple mode, papers sequentially driven out of an image forming apparatus are stacked on a staple tray disposed in the finisher, stapled together, and then discharged to the tray. In the shift mode, papers are directly discharged to the above tray without being stapled. The tray may be constructed to be movable up and down in order to stack a great number of papers, as also proposed in the past.

The above finisher has a paper outlet where a drive roller and a driven roller are arranged in a pair. The driven roller is rotatably mounted on one end of a roller support member that is angularly movable about the other end. The driven roller is pressed against the drive roller due to its own weight. In the shift mode, the drive roller and driven roller are held in contact with each other for discharging the papers. In the staple mode, the roller support member is angularly moved to release the driven roller from the drive roller.

However, the problem with this type of finisher is that all the groups of papers or all the stacks of papers are loaded on the single tray and cannot be distinguished from each other. This is particularly true when a plurality of persons share the finisher. Moreover, an image forming apparatus with such a finisher is often used as a printer for a computer or an output device for a facsimile apparatus. As a result, copies and printings are apt to exist together on the tray. This makes the distinction between copies produced by different persons and between copies and printings extremely difficult.

In light of the above, the finisher may be provided with another paper outlet and another tray or proof tray in addition to the above tray. Even this kind of scheme has a problem that because the outlets and trays are provided in one-to-one correspondence, various functions including a sort mode and a staple mode available with the finisher are limited. Specifically, when the proof tray is selected, stapling or similar advanced function is not available.

Japanese Patent Laid-Open Publication Nos. 9-48557 and 9-48559, for example, each disclose a finisher including a plurality of trays arranged one above the other and capable of locating one of them at a paper outlet. This kind of finisher, however, has the following problems left unsolved. The trays selected and the trays not selected each are moved across the outlet while only the tray selected is located at the outlet. Therefore, to prevent papers stacked on any one of trays from returning into the outlet, a shutter or similar sophisticated device must be arranged in the outlet.

Moreover, the trays each have an end fence for positioning the trailing edges of papers stacked thereon. Because the end fence is implemented by the wall of the finisher where the outlet is formed, an outlet roller cannot overlap the wall. As a result, although the trailing edge of a paper may successfully move away from the outlet roller, the paper is apt to partly remain between the outlet roller and the wall of the finisher. The finisher therefore fails to surely discharge papers.

Japanese Patent Laid-Open Publication No. 9-110259, for example, proposes a finisher addressing the above problems. The finisher taught in this document includes an outlet roller disposed in a paper outlet formed in the wall of the finisher. The outlet roller is movable toward and away from the paper outlet. After the trailing edge of a paper has reached the above wall, the outlet roller is moved away from the wall so as to prevent the trailing edge of the paper from remaining between it and the wall. This, however, complicates the arrangement of the paper outlet.

The finisher of Laid-Open Publication No. 9-48569 mentioned earlier has another problem left unsolved. After a tray unit has been moved to locate a designated tray at the single paper outlet, papers are discharged to the tray. As a result, the operation for discharging the papers must be delayed by a period of time necessary for the particular tray to reach the paper outlet.

Japanese Patent Laid-Open Publication No. 7-228401. for example, proposes a finisher constructed to reduce the above period of time and adaptive to a high-speed image forming apparatus. This finisher includes two paper outlets and two trays associated one-to-one with the paper outlets. The trays are arranged one above the other and movable up and down independently of each other. When the upper tray is used as a mass paper tray, the lower tray is retracted downward as soon as the upper tray is lowered to a preselected position. However, the paper outlets each being associated with a particular tray are sophisticated, Japanese Patent Laid-Open Publication No. 8-73107 teaches a sorter capable of moving a plurality of trays up and down at the same time and varying the distance between nearby trays. The sorter allows the number of papers to be stacked on each tray to be varied, as desired. Each tray is movable via a paper outlet and is returned to its home position when papers are removed therefrom. However, the problem with this sorter is that all the trays are connected together and limit the stroke available for was paper discharge, i.e., a sufficient capacity is not available for mass paper discharge.

In the finisher of the type locating one of a plurality of trays at a paper outlet by driving it independently of the other trays, when an upper tray should be brought to the paper outlet, a lower tray must be retracted downward away from the paper outlet. Also, when the lower tray should be brought to the paper outlet, the upper tray must be retracted upward away from the paper outlet. When the lower tray is used as a mass paper tray, it should preferably be retracted away from the paper outlet as far as possible from the capacity standpoint. This, however, increases a distance that the lower tray should be brought to the paper outlet when selected later, slowing down the finishing operation.

Further, Japanese Patent Laid-Open Publication No. 8-119518 discloses a finisher including a plurality of trays arranged one above the other and at least one of which is movable up and down for mass paper discharge. When the movable tray is selected, it is moved from a stand-by position where papers have been removed to a paper outlet. That is, the finisher taught in the above document recognizes a position where papers have been removed as a stand-by position. In practice, however, the movable tray sometimes reaches its lower limit position in the event of mass paper discharge. It follows that a substantial period of time is necessary for the tray to move from the stand-by position (lower limit position) to the paper outlet. The lower limit position of the mass paper discharge tray is naturally close to the bottom of the finisher, so that the function of the tray can be made most of. This increases the period of time necessary for the tray to move from the lower limit position to the paper outlet and is therefore apt to lower the processing speed of the image forming apparatus. To solve this problem, the moving speed of the tray must be varied by sophisticated control, as needed.

When a paper jams the paper outlet in any one of the conventional finishers, the operator must put the operator's hand in the paper outlet and move outlet rollers provided in a pair away from each other, i.e., rotate a roller support member for removing the paper. At this instant, the tray moving upward via the paper outlet is apt to injure the operator and damage structural elements around the paper outlet. Although the shutter taught in Laid-Open Publication No. 9-48557 or 9-48559 may obviate such an accident, it sophisticates the configuration of the outlet and control.

SUMMARY OF THE INVENTION

It is therefore a first object of the present invention to provide a finisher capable of moving a lower tray to a paper outlet in a short period of time without resorting to any sophisticated control.

It is a second object of the present invention to provide a finisher highly productive and easy to use.

It is a third object of the present invention to provide a finisher capable of stacking a great number of papers without scaling up a drive source and moving a tray to a paper outlet in a short constant period of time without resorting to any sophisticated control.

It is a fourth object of the present invention to provide a finisher capable of preventing papers from returning from a tray to a paper outlet without complicating the configuration of the outlet, or promoting sure positioning of papers without complicating the configuration of the outlet, or reducing the period of time necessary for a tray to reach the outlet.

It is a fifth object of the present invention to provide a finisher capable of reducing a paper discharging timer with a plurality of trays sharing a single paper outlet, and implementing mass paper discharge.

It is a sixth object of the present invention to provide a finisher capable of receiving, with a relatively simple construction, papers with a plurality of trays without causing the papers from returning from the trays to a paper outlet.

It is a seventh object of the present invention to provide a finisher capable of obviating accidents ascribable to the movement of a tray with a relatively simple construction.

It is an eighth object of the present invention to provide a finisher capable of preventing trays from colliding with each other, and reducing the distance of movement of a tray to a paper outlet to thereby adopt to a high-speed image forming operation.

In accordance with the present invention, a finisher for an image forming apparatus includes a paper outlet for discharging papers. A plurality of trays are capable of being selectively located at the paper outlet and include at least an upper tray and a lower tray movable up and down independently of each other. A controller selectively locates either one of the upper tray and lower tray at the paper outlet. The controller moves the lower tray to a retracted position when locating the upper tray at the paper outlet. A standby position sensor senses the stand-by position of the lower tray which is a home position defined between the paper outlet and the retracted position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the finisher in accordance with the present invention will be described hereinafter.

First Embodiment

Figure 1:
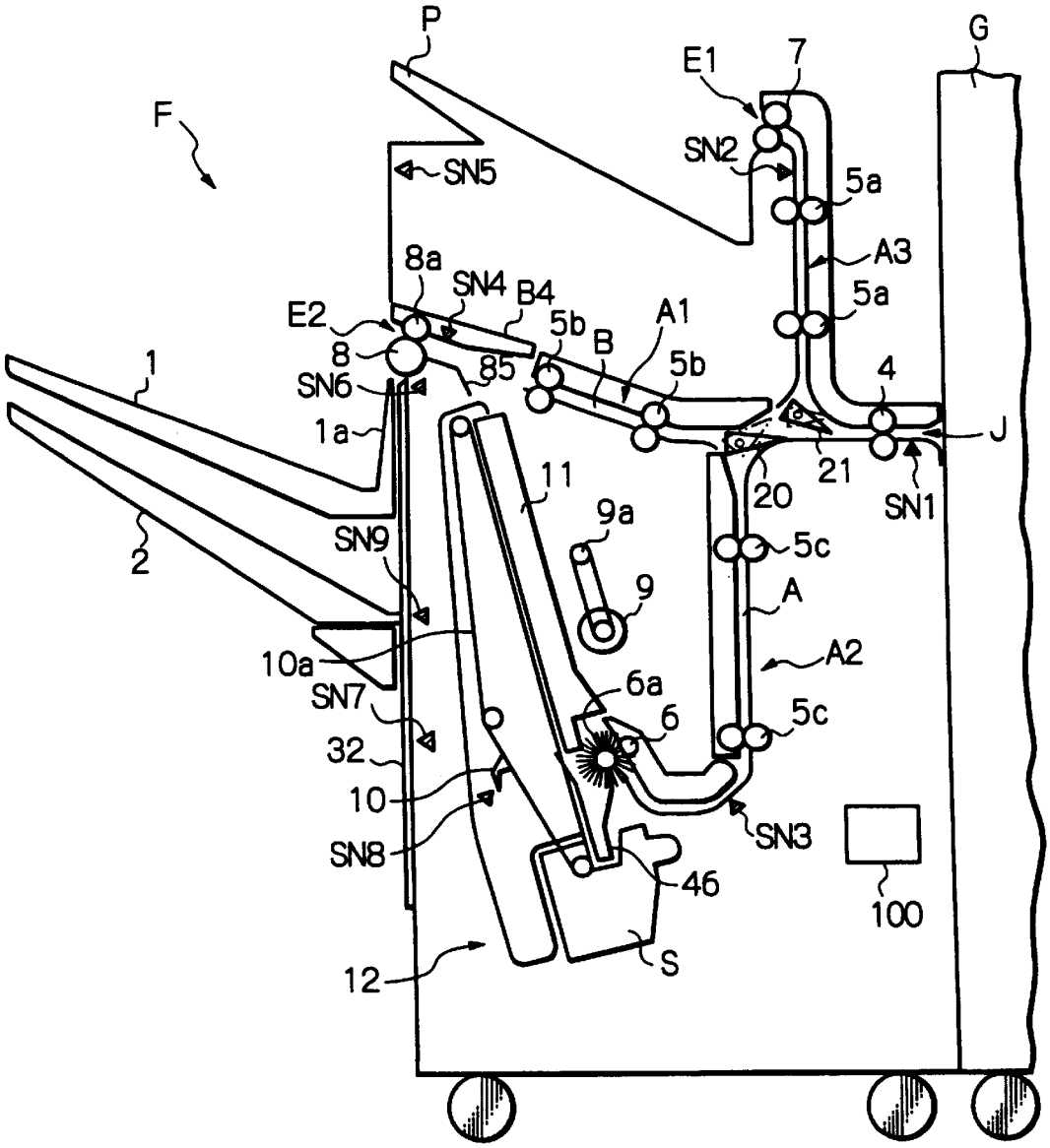
FIG. 1 is a side elevation showing a first embodiment of the finisher in accordance with the present invention.

Referring to FIG. 1 of the drawings, a finisher embodying the present invention and directed toward the first object stated earlier will be described. As shown, the finisher or paper stacking device, generally labeled F, receives a paper from a copier G at a transfer position J. The copier G belongs to a family of image forming apparatuses. An inlet sensor SN1 and inlet rollers 4 are arranged around the transfer position J. A proof tray P is provided on the top of the finisher F. A paper received via the inlet rollers 4 is discharged to the proof tray P via an outlet E1, or discharged to an upper tray 1 or a lower tray 2 via an outlet E2 without being stapled or after being stapled, depending on the operation mode. Mainly, the upper tray 1 is used to stock papers. The lower tray 1 is capable of stacking a great number of papers.

Figure 2:
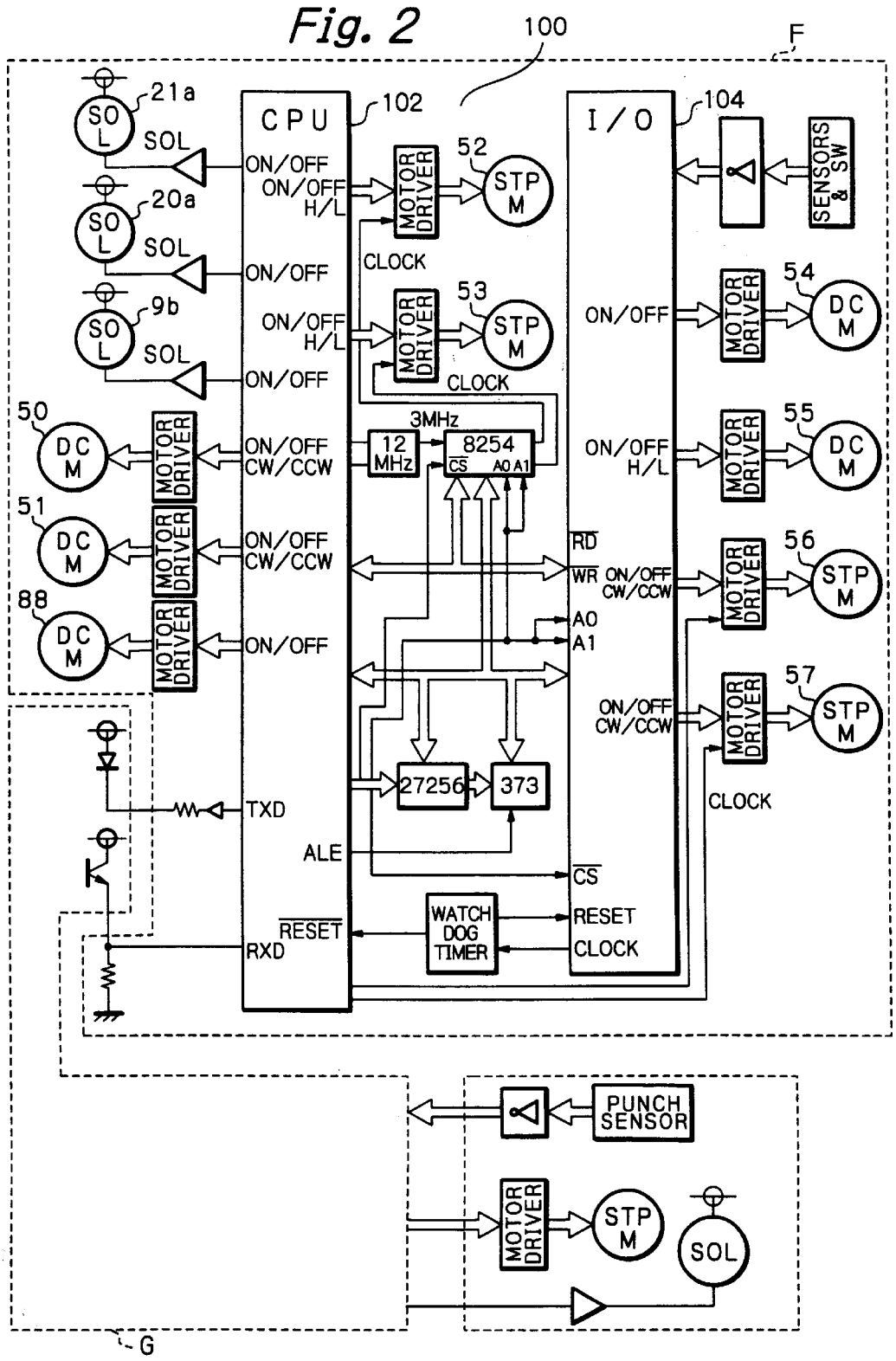
FIG. 2 is a block diagram schematically showing a control system included in the first embodiment.

A path selector 21 is positioned downstream of the inlet rollers 4 in the direction of conveyance of papers and operated by a solenoid 21*a* (see FIG. 2). When the solenoid 21*a* is turned off, the path selector 21 is brought to a position indicated by a solid line in FIG. 1. In this position, the path selector 21 steers a paper being conveyed by the inlet rollers 4 toward the outlet E1. At this instant, rollers 5*a* convey the paper toward the outlet E1 while outlet rollers 7 discharge the paper to the proof tray P. An outlet sensor SN2 is located between the rollers 5*a* and outlet rollers 7, as illustrated. It is to be noted that the rollers 5*a* and outlet rollers 7, as well as other rollers, each are implemented as a drive roller and a driven roller cooperating with each other.

When the solenoid 21*a* is turned on, it brings the path selector 21 to a position indicated by a dash-and-dots line in FIG. 1. In this position, the path selector 21 steers the paper into a horizontal path. Another path selector 20 is positioned on the horizontal path downstream of the path selector 21 and operated by a solenoid 20*a* (see FIG. 2). When the solenoid 20*a* is turned on, it switches the path selector 21 to a position indicated by a dash-and-dots line in FIG. 1. As a result, the path selector 21 steers the paper to a vertical staple route A. When the solenoid 20*a* is turned off, it switches the path selector 21 to a position indicated by a solid line in FIG. 1 and causes it to steer the paper to a non-staple route B.

Rollers 5*b* are arranged on the non-staple route B for conveying the paper introduced into the route B. An outlet roller or drive roller 8 cooperates with a driven roller 8*a* for discharging the paper to the upper tray 1 or the lower tray 2. An outlet sensor SN4 is positioned between the rollers 5*b* and the outlet roller 8. The trays 1 and 2 each are driven by a respective drive source. A controller 100 selectively locates either one of the trays 1 and 2 at the outlet E2.

On the staple route A, rollers 6C convey the paper to a staple unit 12. Papers stapled by the staple unit 12 are discharged to the tray 1 or 2 by the outlet roller 8. An outlet sensor SN3 is located on the staple route A.

Assume that the operator of the copier G selects a staple mode. In the staple mode, papers sequentially guided into the staple route A are stacked on a staple tray disposed in the finisher F by a discharge roller 6. A tap roller 9 positions every paper in the vertical direction (direction of conveyance) while a jogger fence 11 positions every paper in the horizontal direction (widthwise direction). The controller 100 sends a staple signal to a stapler S between to consecutive jobs, i.e., during an interval between the list paper of one stack and the first paper of the next stack. A paper stack stapled by the stapler S is immediately conveyed to the outlet roller 8 by a belt 10*a* having a catch 10 and driven out to the tray 1 or 2 located at the outlet E2 by the roller 8.

The tap roller 9 pivots about a fulcrum 9*a* by being driven by return solenoid 9*b* (see FIG. 2). Every time a paper is driven onto the staple tray, the tap roller 9 acts on the paper and causes it to abut against a rear fence 46. At this instant, a brush roller 6*a* cooperative with the discharge roller 6 prevents the trailing edge of the paper from returning toward the staple path A. The tap roller 9 is rotatable in the counterclockwise direction. A home position sensor SN8 is responsive to the home position of the catch 10.

As shown in FIG. 2, the controller 100 is implemented by a microcomputer including a CPU (Central Processing Unit) 102 and an I/O (Input/Output) interface 104. A control panel, not shown, is mounted on the top of the finisher body and includes various switches (SW). Signals output from the switches and various sensors are input to the CPU 102 via the I/O interface 104. In response, the CPU 102 controls a motor 50 assigned to the upper tray 1, a motor 51 assigned to the lower tray 2, the solenoids 20*a* and 21*a*. the return solenoid 9*b*, a motor 52 assigned to the rollers 5*a*, 5*b* and 5*c*, a motor 53 assigned to the outlet rollers 7 and 8, motors 54 and 56 assigned to the stapler S, a motor 5*c* assigned to the belt 10*a*, a motor 57 assigned to the jogger fence 11, etc. Pulse signals for driving the motor 52 assigned to the rollers 5*c* are input to the CPU 102 and counted thereby. The CPU 102 controls the return solenoid 9*b* in accordance with the number of the pulse signals. Also shown in FIG. 2 are a DM motor DCM and a stepping motor STMP.

Sensors SN5, SN6, SN9 and SN7 are sequentially arranged on the outlet E2 side of the finisher body from the upper portion to the lower portion. The sensor SN5 is a retracted position sensing means for sensing a position to which the upper tray 1 is retracted when the lower tray 2 should be brought to the outlet E2. The sensor SN6 is a discharge position sensing means responsive to the tray 1 or 2 brought to the outlet E2. The sensor SN9 is a stand-by position or home position sensing means responsive to the stand-by position or home position of the tray 2. The sensor SN7 is a retracted position sensing means responsive to the tray 2 brought to its retracted position. The outputs of the sensors SN5, SN6, SN9 and SN7 are input to the CPU 102 via the I/O interface 104.

A desired operation mode and a desired tray are input on an operation panel, not shown, mounted on the copier G or a computer, not shown, connected to the copier G. When the staple mode is input despite that the proof tray P is selected, the staple mode is automatically canceled with priority given to the proof tray P.

Figure 3:
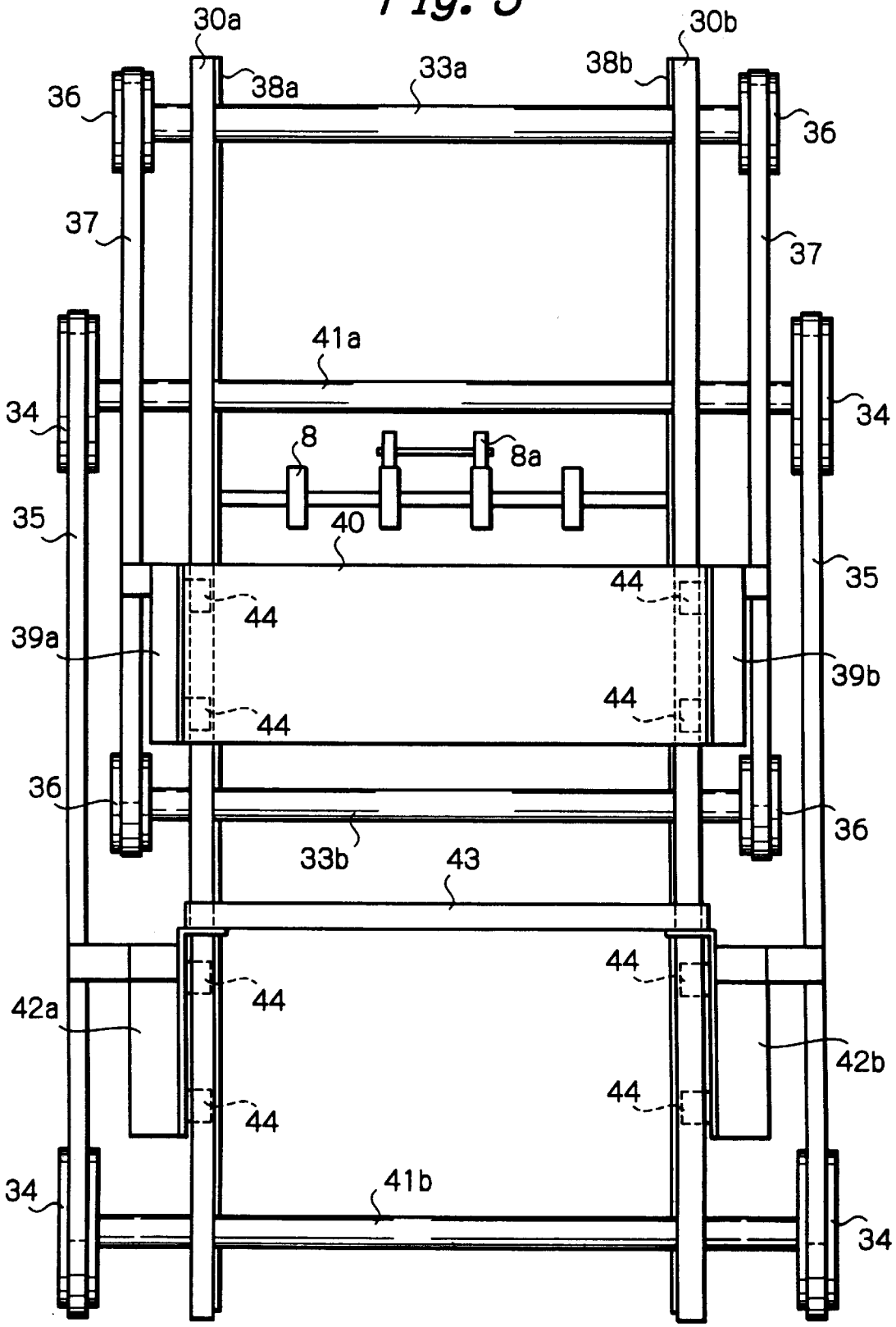
FIG. 3 is a front view showing a mechanism included in the first embodiment for moving trays up and down.

A mechanism for moving the trays 1 and 2 up and down will be described with reference to FIG. 3. As shown, the upper tray 1 is mounted on a base 40 affixed to opposite side walls 39*a* and 39*b*. Guide rollers 44 are mounted on the side walls 39*a* and 39*b* via stubs not shown. The guide rollers 44 are rollable on and along the inner peripheries of guide rails 30*a* and 30*b* each having a generally U-shaped section. The guide rollers 44 are positioned by the assembly of the side walls 39*a* and 39*b* and base 40 and prevented from slipping out of the guide rails 30*a* and 30*b* thereby. Two timing belts 37 each are passed over a pair of timing pulleys 36. The motor 50 drives the timing belts 37 via a drive shaft 33*a* and a driven shaft 33*b* on which the timing pulleys 36 are mounted. The side walls 39*a* and 39*b* each are partly affixed to the adjoining timing belt 37. In this configuration, the unit including the upper tray 1 is movable up and down.

The lower tray 2, like the upper tray 1, is mounted on a base 43 affixed to opposite side walls 42*a* and 42*b*. Guide rollers 44 are mounted on the sidewalls 42*a* and 42*b* via stubs not shown. The guide rollers 44 are rollable on end along the inner peripheries of the guide rails 30*a* and 30*b*. The guide rollers 44 are positioned by the assembly of the side walls 42*a* and 42*b* and base 43 and prevented from slipping out of the guide rails 30*a* and 30*b* thereby. Two timing belts 35 each are passed over a pair of timing pulleys 34. The motor 51 drives the timing belts 35 via a drive shaft 41*a* and a driven shaft 41*b* on which the timing pulleys 34 are mounted. The side walls 42*a* and 42*b* each are partly affixed to the adjoining timing belt 35. In this configuration, the unit including the lower tray 2 is movable up and down.

Figure 4:
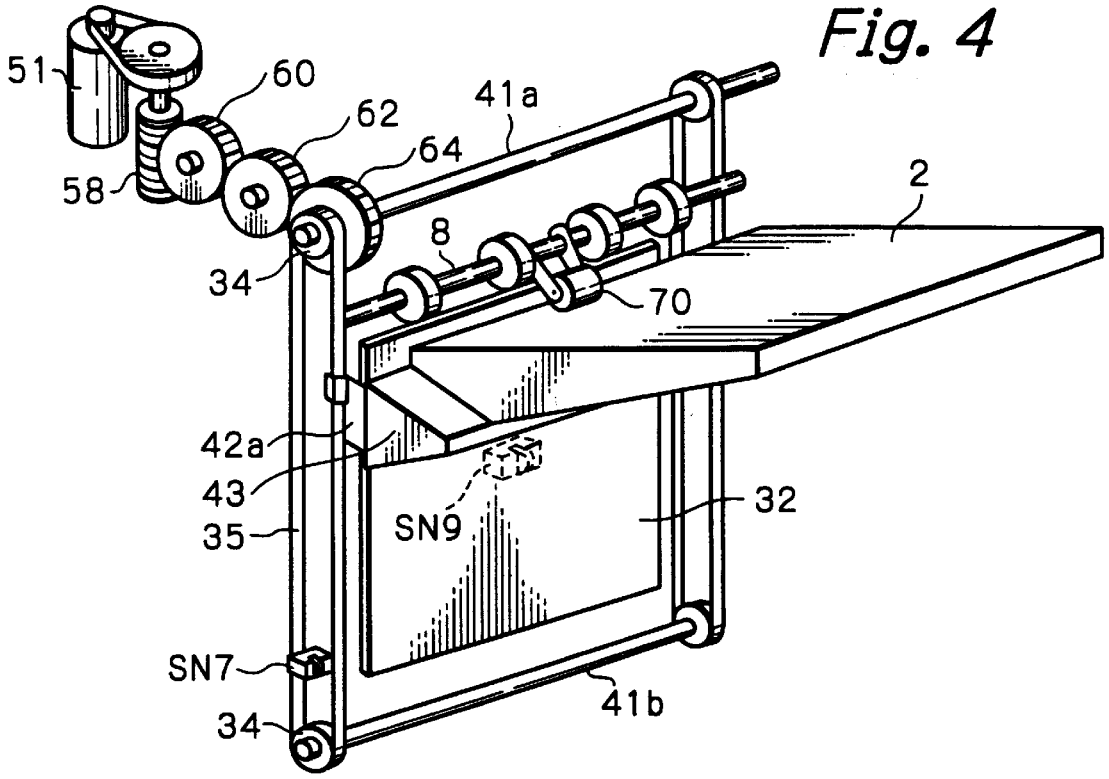
FIG. 4 is a perspective view showing a mechanism included in the first embodiment for moving lower one of the trays.

FIG. 4 shows a mechanism for driving the lower tray 2. As shown, the rotation of the motor 51 is transferred via a worm gear 58 to the last gear of a gear train mounted an the drive shaft 41*a*. The worm gear 58 allows the tray 2 to be held at a preselected position. The upper tray 1 is driven by a similar mechanism. The sensor SN7 mentioned earlier is located between the opposite runs of the timing belt 35 and turned on and off by a part of the side wall 42*a* or 42*b* affixed to one run of the timing belt 35 located at the discharge side. This is also true with the sensor SN5. The driven roller 8*a* is not shown in FIG. 4.

Figure 5:
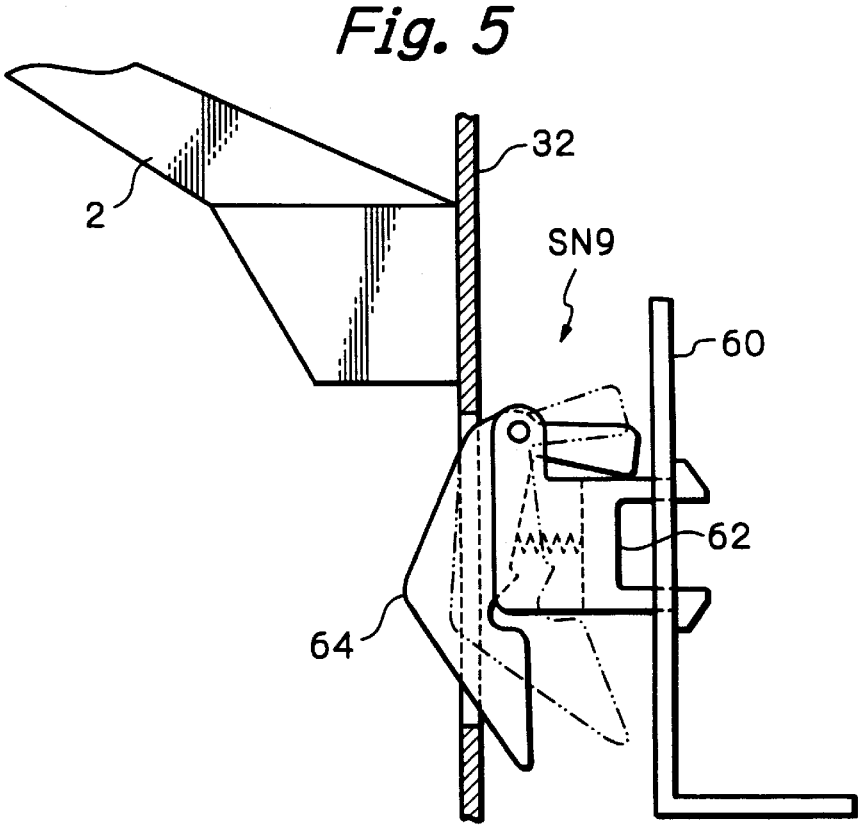
FIG. 5 is a side elevation showing the construction and operation of a sensor responsive to the stand-by position of the lower tray.

The sensor SN9 is positioned around the center of a paper discharged and operable on a surface which the rear edge of the paper contacts, i.e., on a side wall or rear fence 32. More specifically, as shown in FIG. 5, the sensor SN9 implemented by a microswitch includes a portion 62 affixed to a stationary member 60 forming a part of the finisher body, and a movable piece 64 rotatably supported by the portion 62 at its one end. The movable piece 64 partly protrudes from the side well 32 in the paper discharge direction and is actuated by the rear end of the tray 2 or the top of a paper stack. The other sensors SN5, SN6 and SN7 each have the same configuration as the sensor SN9. All the sensors may be implemented by either one of refection type sensors or transmission type sensors.

Figure 6:
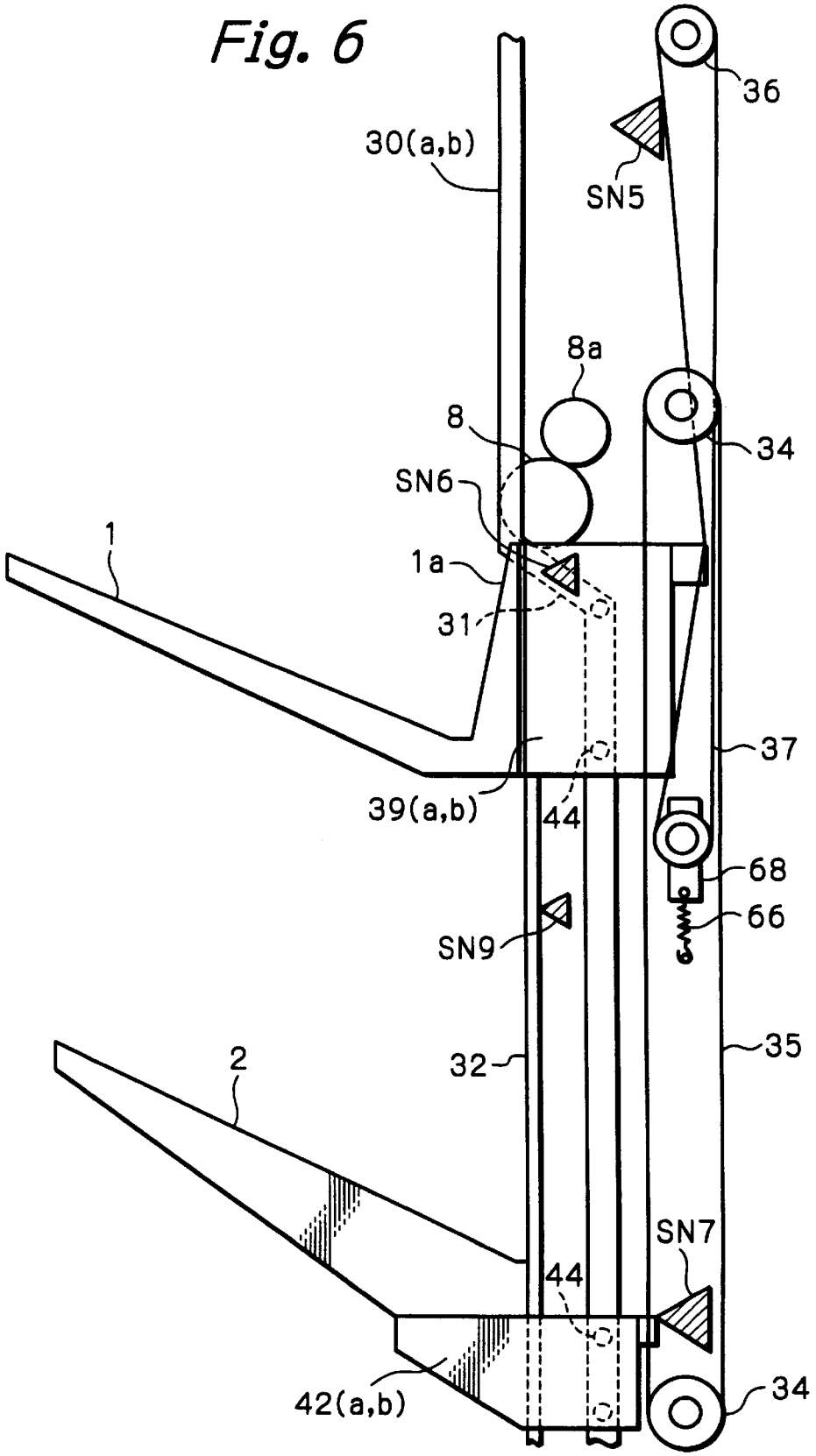
FIG. 6 is a side elevation showing the mechanism for moving an upper tray located at a paper outlet.
Figure 7:
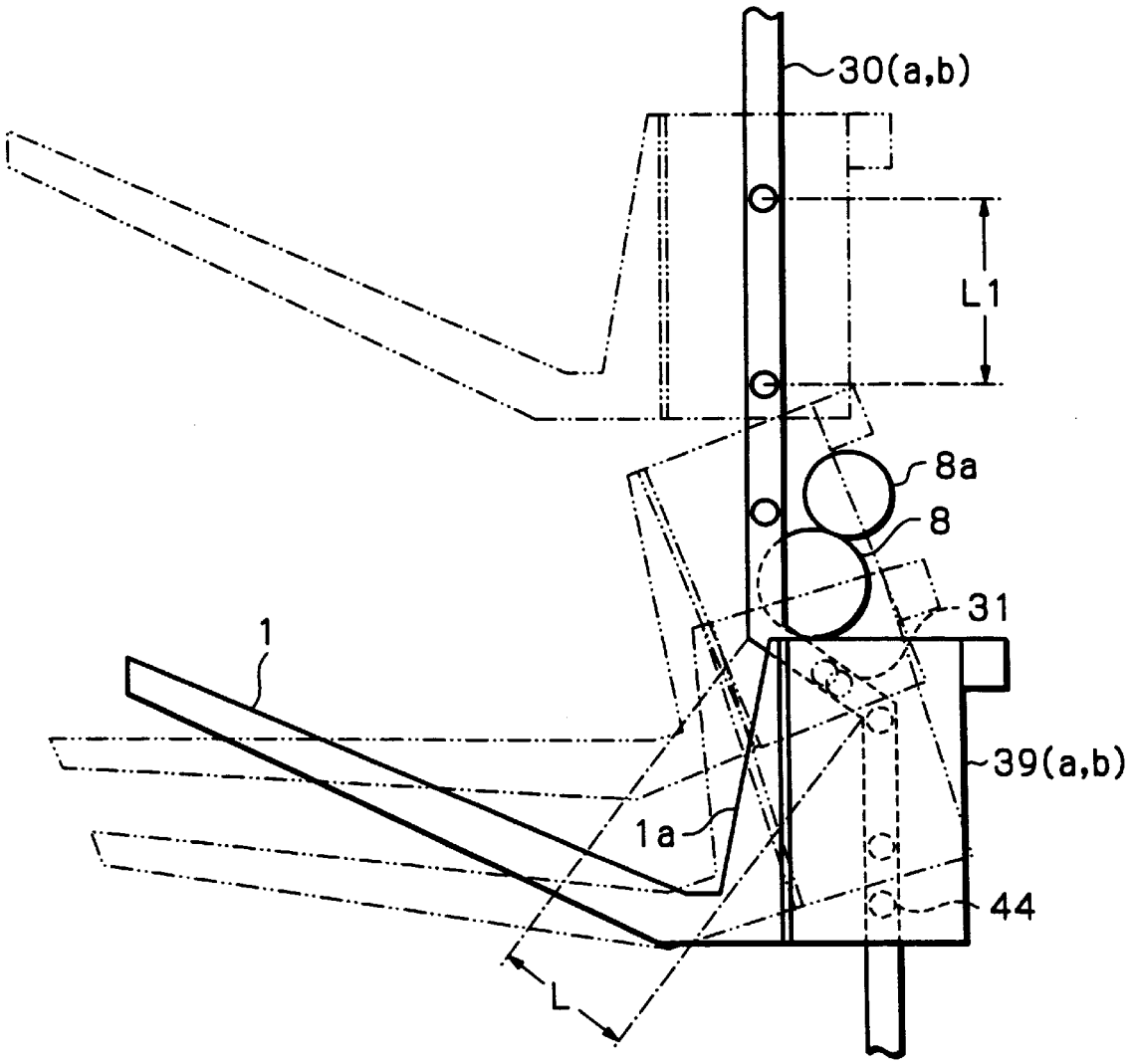
FIG. 7 is a side elevation demonstrating the retraction of the upper tray.

As shown in FIG. 1, in the illustrative embodiment, the outlet roller 8 protrudes from the side wall 32 in order to prevent the side wall 32 from catching a paper being discharged via the outlet E2. The outlet roller 8, however, interferes with the upper tray 1 when the tray 1 is retracted upward. As shown in FIG. 6, to obviate such interference, the guide rails 30*a* and 30*b* each include a bent portion 31. FIG. 6 shows a condition wherein the upper tray 1 is located at the outlet E2 while the lower tray 2 is retracted. As shown in FIG. 7, as the guide rollers 44 are displaced, the tray 1 is angularly moved and prevented from interfering with the outlet roller 8. The distance L1 between the guide rollers 44 of the tray 1 are greater than the length L of the bent portion 31.

Figure 8:
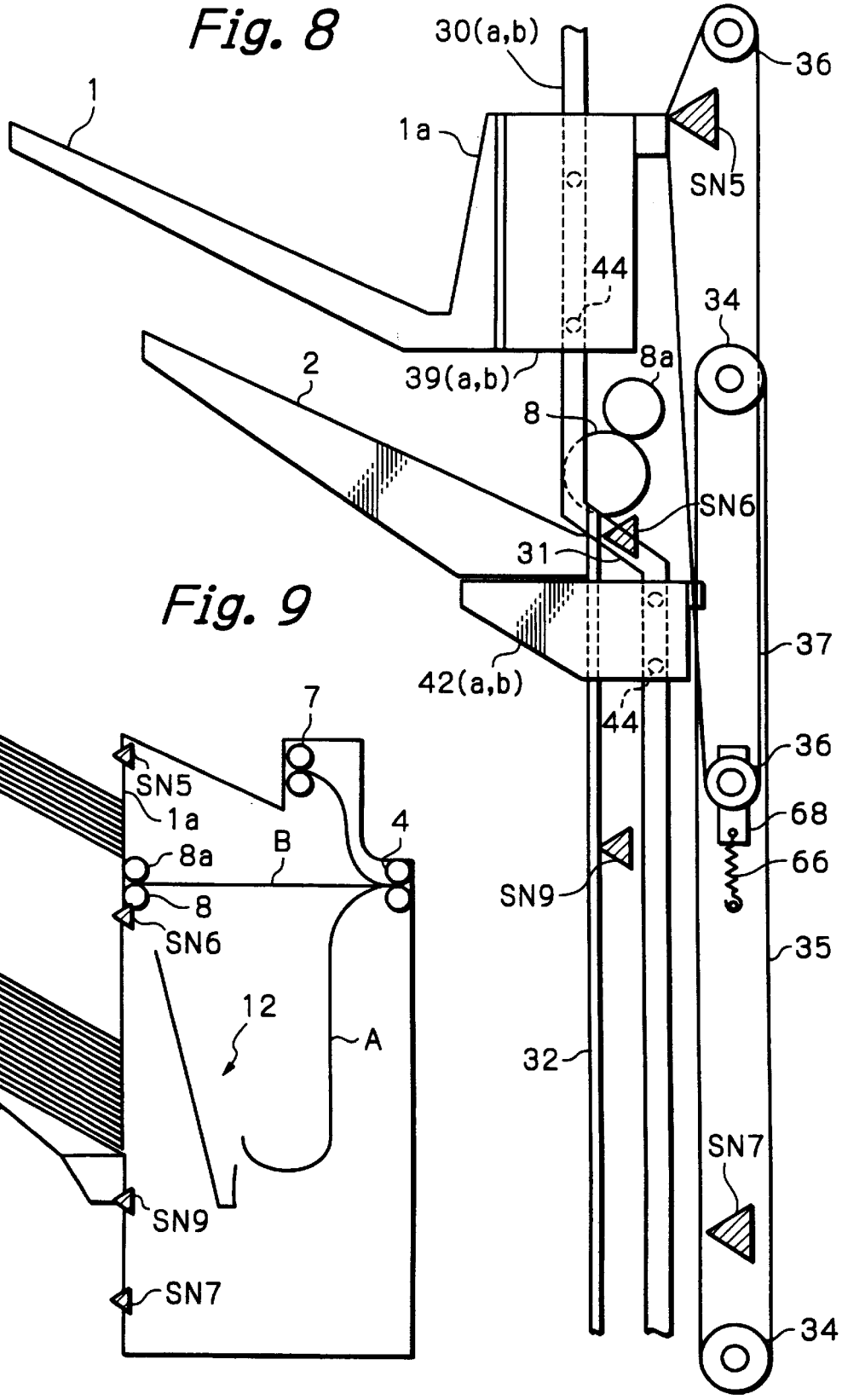
FIG. 8 is a side elevation showing the mechanism for moving the lower tray located at the paper outlet.

The angular movement of the tray 1 causes the tension acting an the timing belt 37 to vary. In light of this, as shown in FIG. 6, the lower timing pulley 36 is affixed to a movable bracket 68 to which a spring 66 is anchored. FIG. 8 shows a condition wherein the lower tray 2 is located at the outlet E2 while the upper tray 1 is retracted upward.

Figure 9:
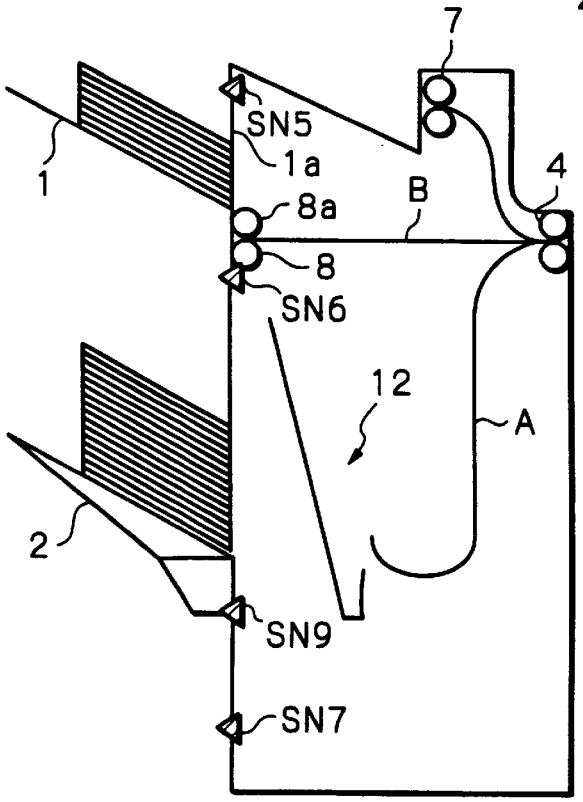
FIG. 9 shows the upper tray and lower tray each being located at the respective home position.

How the controller 100 controls the upper tray 1 and lower tray 2 will be described hereinafter. FIG. 9 shows home positions at which the trays 1 and 2 are located on the power-up of the copier G. As shown, the sensor SN6 senses the upper end of an end fence 1*a* included in the tray 1 when the tray 1 is located at its home position. The sensor SN9 senses the lower end of the tray 2 when the tray 2 is located at its home position.

Figure 10:
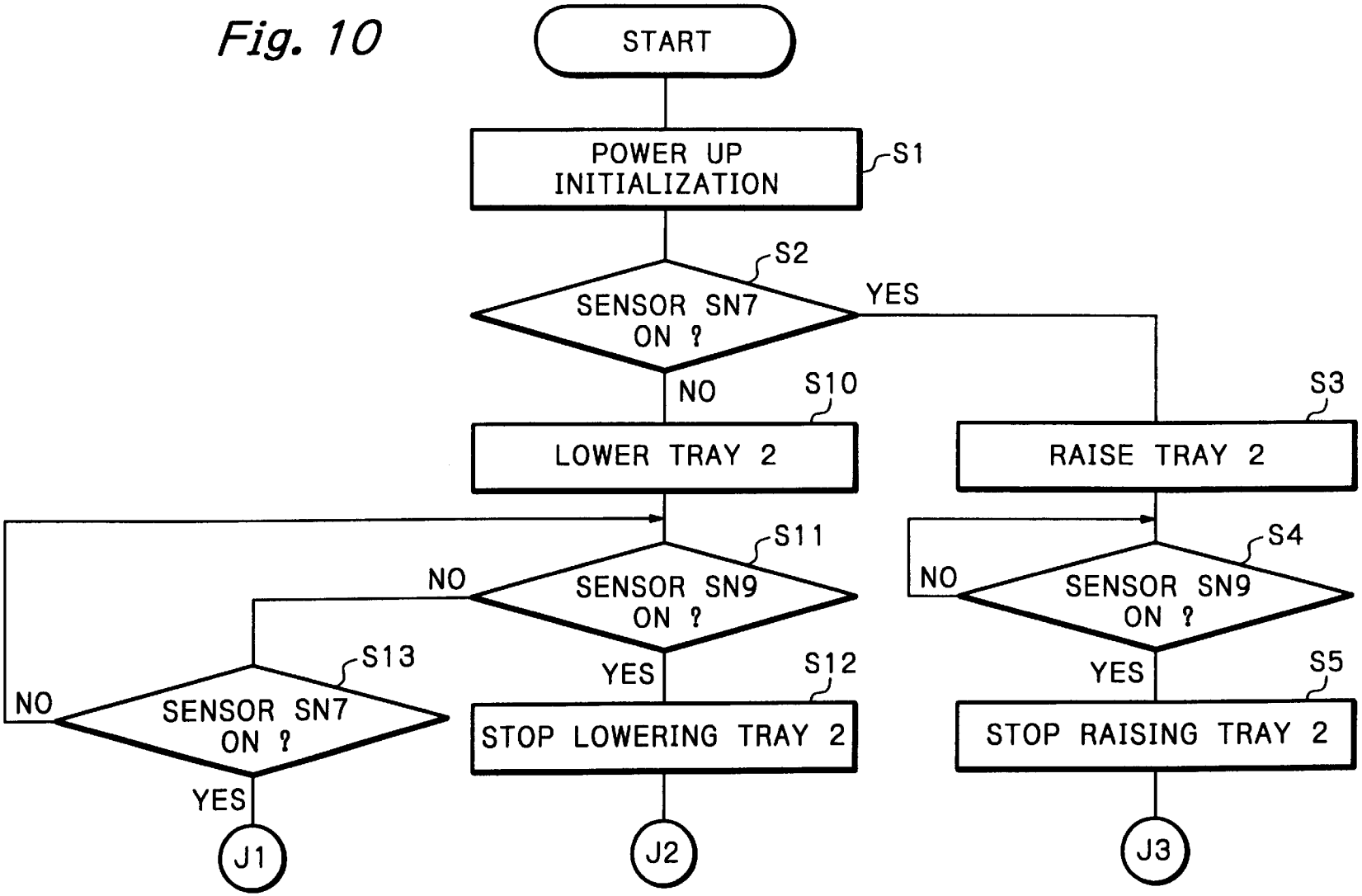
FIGS. 10 and 11 are flowcharts representative of initialization which the first embodiment executes with a sensor responsive to the lower retracted position of the lower tray.
Figure 11:
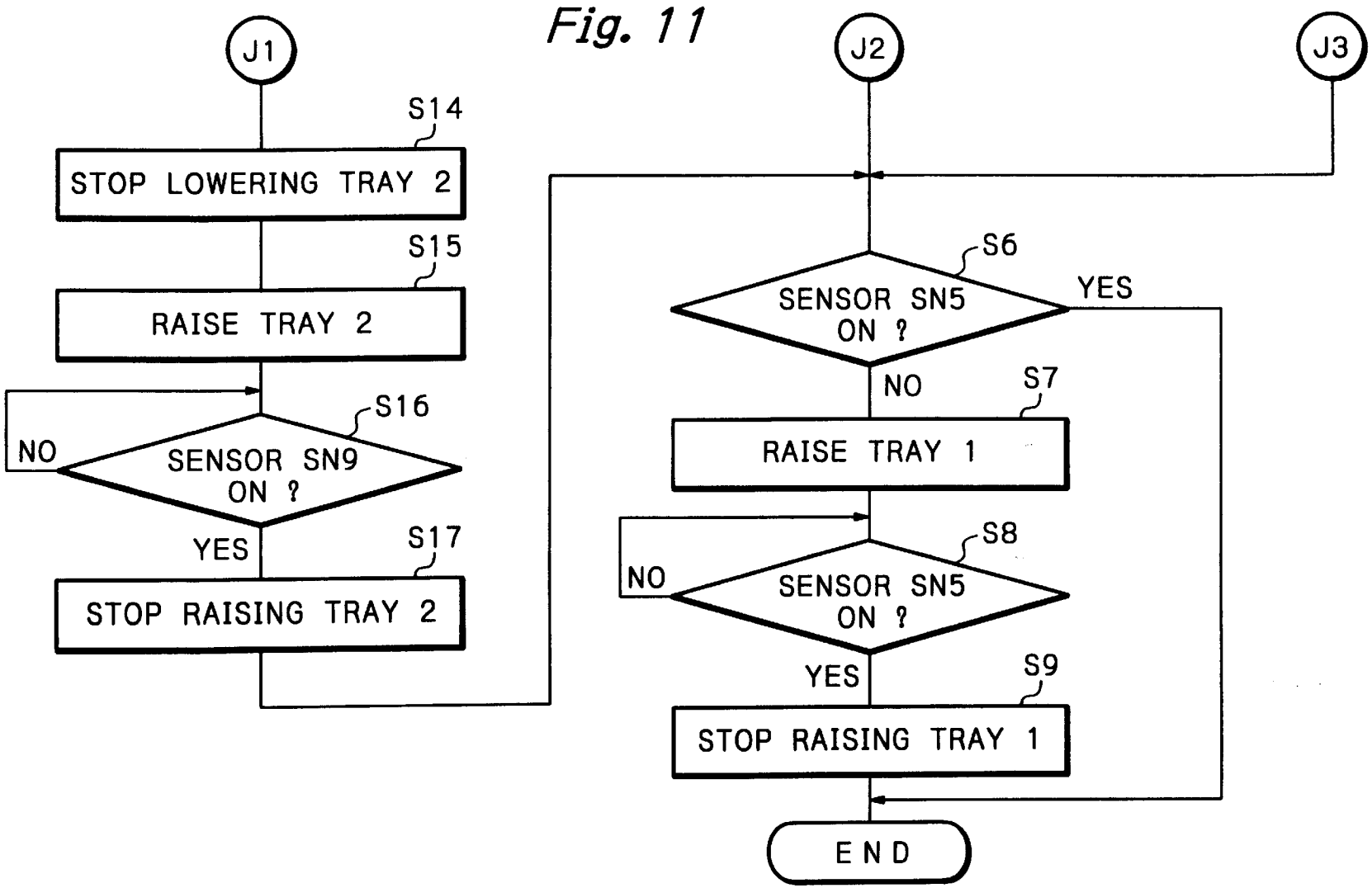

Reference will be made to FIGS. 10 and 11 for describing the initialization of the trays 1 and 2, i.e. a procedure for locating them at the home positions. As shown, on the power-up of the copier G, initialization begins (step S1). Specifically, the controller 100 determines whether or not the sensor SN7 is in an ON state (step S2). If the answer of the step S2 is positive (YES), the controller 100 raises the tray 2 (step S3) and then determines whether or not the sensor SN9 is in an ON state (step S4). If the answer of the step S4 is YES, the controller 100 stops the elevation of the tray 2 (step S5). As a result, the tray 2 is caused to stop at its home position. To move the trays 1 and 2 up and down, the controller 100 drives the motors 50 and 51.

Subsequently, the controller 100 determines whether or not the sensor SN5 is in an ON state (step S6). If the answer of the step S6 is YES, meaning that the tray 1 is located at its home position, the controller 100 ends the initialization. If the answer of the step S6 is negative (NO), the controller raises the tray 1 (step S7) and determines whether or not the sensor SN5 is in an ON state (step S8). The controller 100 stops the movement of the tray 1 as soon as the sensor SN5 senses the upper end of the end fence 1*a* (step S9).

If the answer of the step S2 is NO, meaning that the sensor SN7 is in an OFF state, the controller 100 lowers the tray 2 (step S10) and then determines whether or not the sensor SN9 is an ON state (step S11). If the answer of the step S11 is YES, the controller 100 stops the movement of the tray 2 (step S12). In this case, the tray 2 is moved downward toward the sensor SN9.

If the answer of the step S11 is NO, i.e., if the sensor SN9 is in an OFF state, the controller 100 determines whether or not the sensor SN7 is in an ON state (stop S13). If the answer of the step S13 is YES, the controller 100 stops the movement of the tray 2 (step S14). Subsequently, the controller 100 raises the tray 2 (step 315) and then determines whether or not the sensor SN9 is in an ON state (step S16). As soon as the sensor SN9 senses the lower end of the tray 2 (YES, step S16), the controller 100 stops the movement of the tray 2 (step S17). In this case, the tray 2 is raised from a position between the sensors SN9 and SN7. This is followed by the step S6.

The controller 100 may move the two trays 1 and 2 at the same time, if desired.

To locate the tray 1 at the outlet E2, the controller 100 once stops the movement of the tray 1 when the sensor SN6 senses the upper end of the end fence 1*a,* then raises the tray 1 by a preselected distance, and then stops it. To locate the other tray 2 at the outlet E2, the controller 100 once stops the movement of the tray 2 when the sensor SN6 senses the upper end of the tray 2, then lowers the tray 2 by a preselected distance, and then stops it.

Because the home position of the tray 2 corresponds to the position of the sensor SN7, the tray 2 is moved from the home position to the outlet E2 when selected. This successfully reduces the distance and time of movement of the tray 2, compared to a case wherein the above home position corresponds to the position of the sensor SN7.

The end fence 1*a* of the tray 1 has its intermediate portion notched so as not to interfere with a push roller 70 (see FIG. 4) although not shown specifically. The sensor SN6 is therefore so positioned as to sense the end fence 1*a*, the rear end of the tray 2 or the top of a paper stack. In this sense, the sensor SN6 serves as a paper sensor at the same time.

Figure 13:
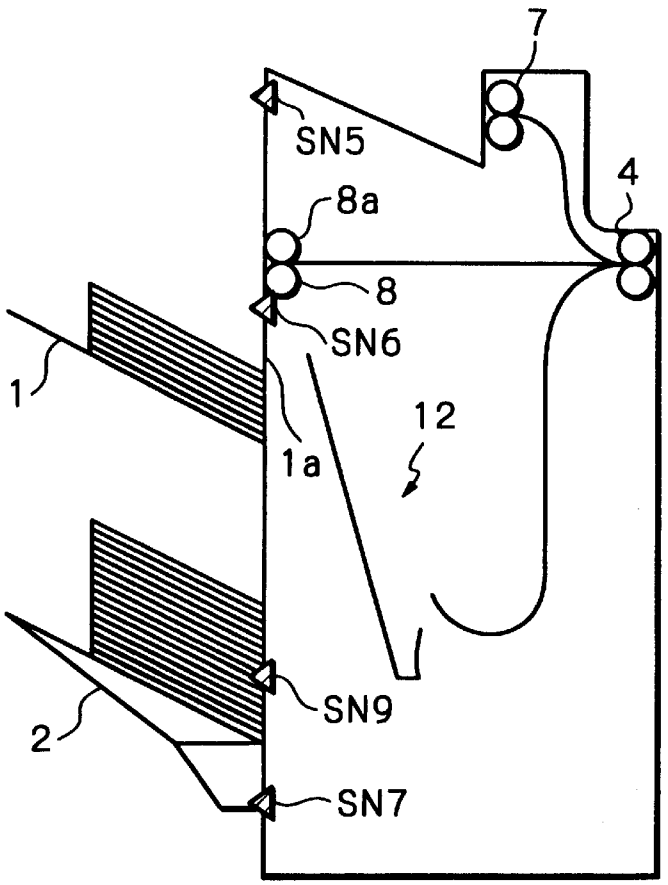
FIG. 13 is a side elevation showing another specific condition wherein the lower tray is retracted while the upper tray is located at the paper outlet.
Figure 12:
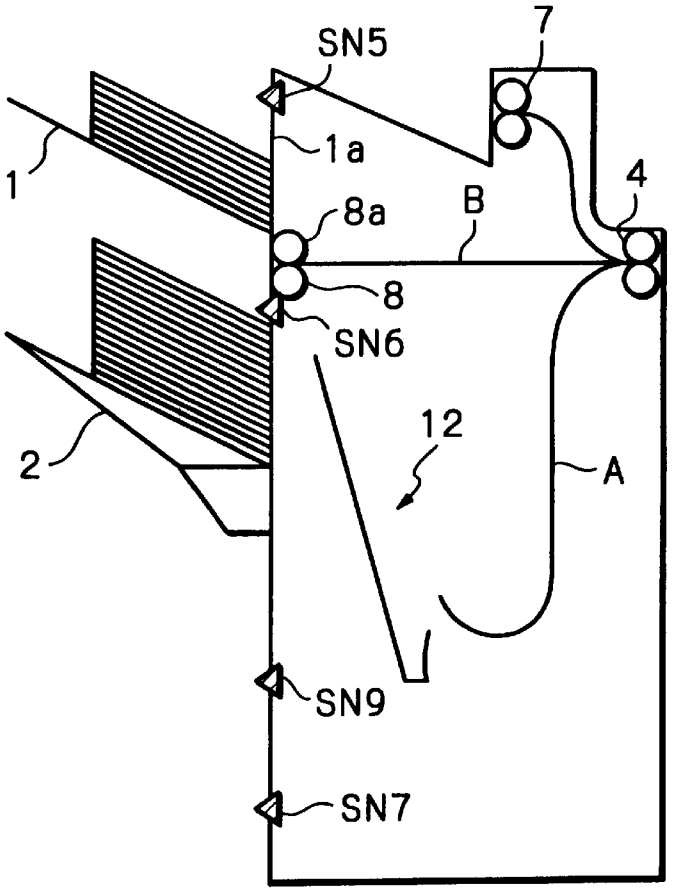
FIG. 12 is a side elevation showing a specific condition wherein papers are sequentially stacked on the lower tray.

FIG. 12 shows a condition wherein the tray 2 is selected and has received a certain number of papers. Assume that the other tray 1 is selected in the condition shown in FIG. 12. Then, as shown in FIG. 13, the tray 2 is retracted until the sensor SN7 senses it, while the tray 1 is brought to the outlet E2.

Figure 14:
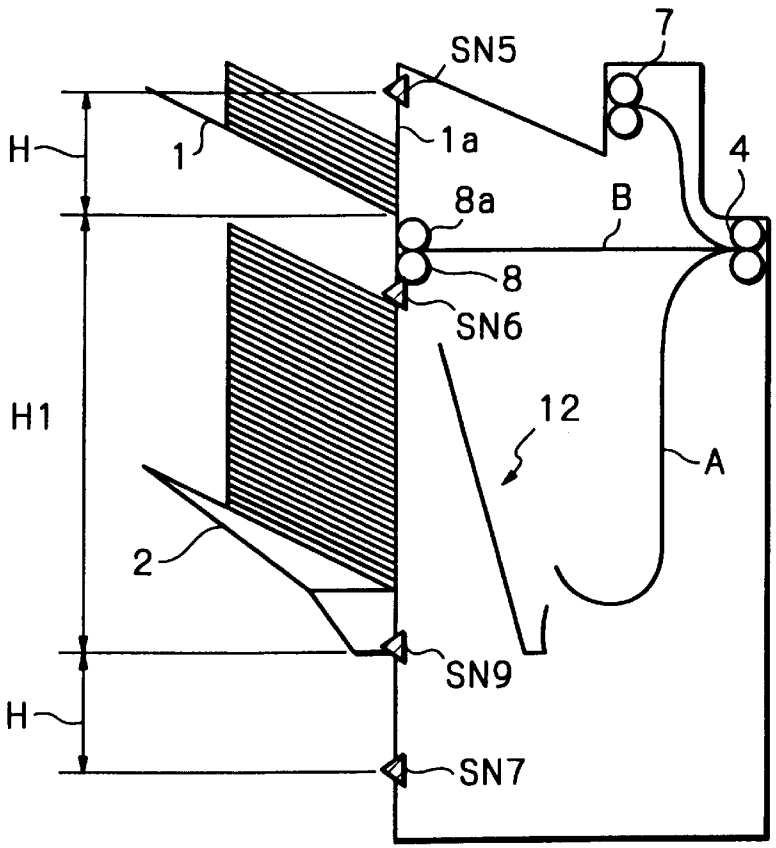
FIG. 14 is a side elevation showing still another specific condition wherein the lower tray has reached its full state.

FIG. 14 shows a condition wherein the tray 2 is selected and has received a number of papers great enough to turn on both of the sensors SN6 and SN9. In the illustrative embodiment, the tray 2 reached the condition of FIG. 14 is determined to be full. More specifically, the sensor SN9 is capable of detecting the full state of the tray 2 alone. When the tray 1 is selected with the tray 2 being in its full state, the tray 2 must be retracted. However, the tray 2 should only be retracted by a distance equal to the height of a stack that the tray 1 can accommodate, i.e., a dimension H shown in FIG. 14.

Figure 15:
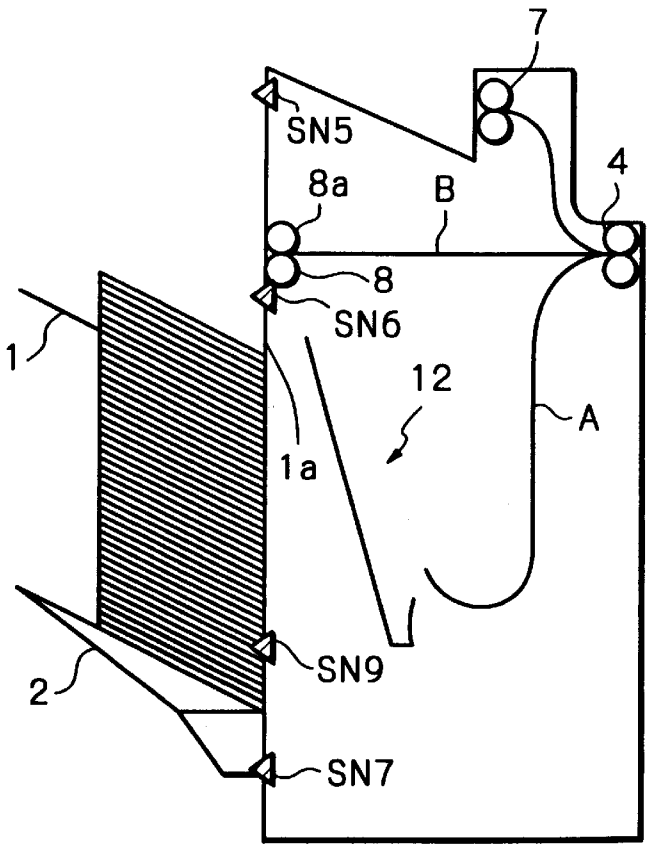
FIG. 15 is a side elevation showing a further specific condition wherein the full lower tray is retracted while the upper tray is located at the paper outlet.

In light of the above, the sensors SN9 and SN7 are spaced by the distance H from each other. It follows that when the full tray 2 is retracted and the tray 1 is brought to the outlet E2, no wasteful space exists between the trays 1 and 2, as shown in FIG. 15.

As stated above, the optimal distance between the sensors SN9 and SN7 can be regarded as the height of a stock that the tray 1 can accommodate (dimension H). Therefore, considering the sensor SN9 to be a reference, it is possible to determine the position of the sensor SN7 in terms of the distance of movement of the tray 2. This obviates the need for the sensor SN7.

Figure 16:
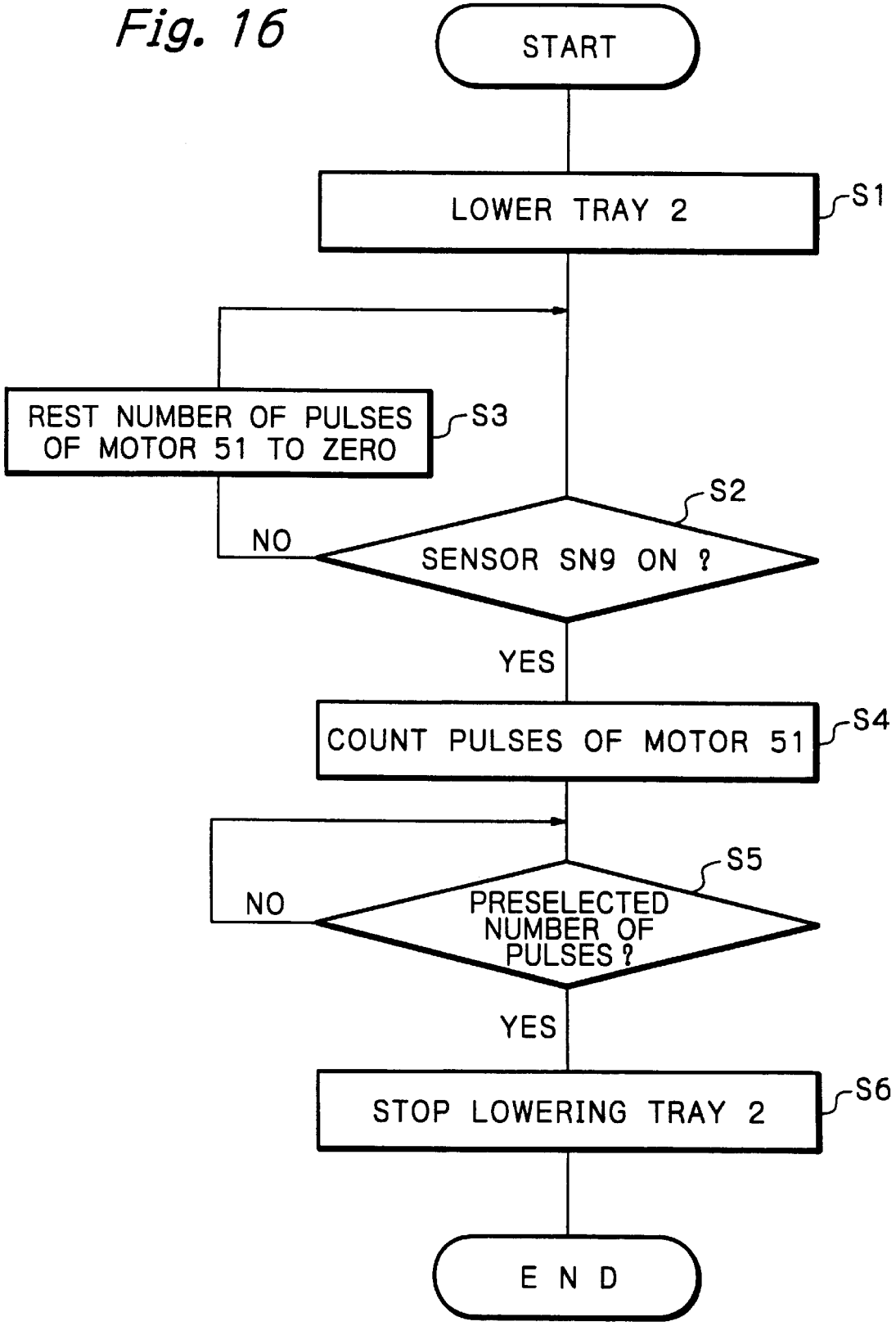
FIG. 16 is a flowchart showing a procedure which the first embodiment executes for determining a retracted position without using the sensor responsive to the lower retracted position.

A specific procedure for retracting the tray 2 without using the sensor SN7 will be described with reference to FIG. 16. As shown, the controller 100 lowers the tray 2 (step S1) and then determines whether or not the sensor SN1 is in an ON state (step S2). If the answer of the step S2 is NO, the controller 100 resets a counter, not shown, for counting the pulses of the motor 51 to zero (step S3). When the sensor SN9 turns on (YES, step S2), the controller 100 starts counting the pulses of the motor 51 with the above counter (step S4). On counting a preselected number of pulses (YES, step S5), the controller 100 stops the movement of the tray 2. As a result, the tray 2 is located at its retracted position.

Figure 17:
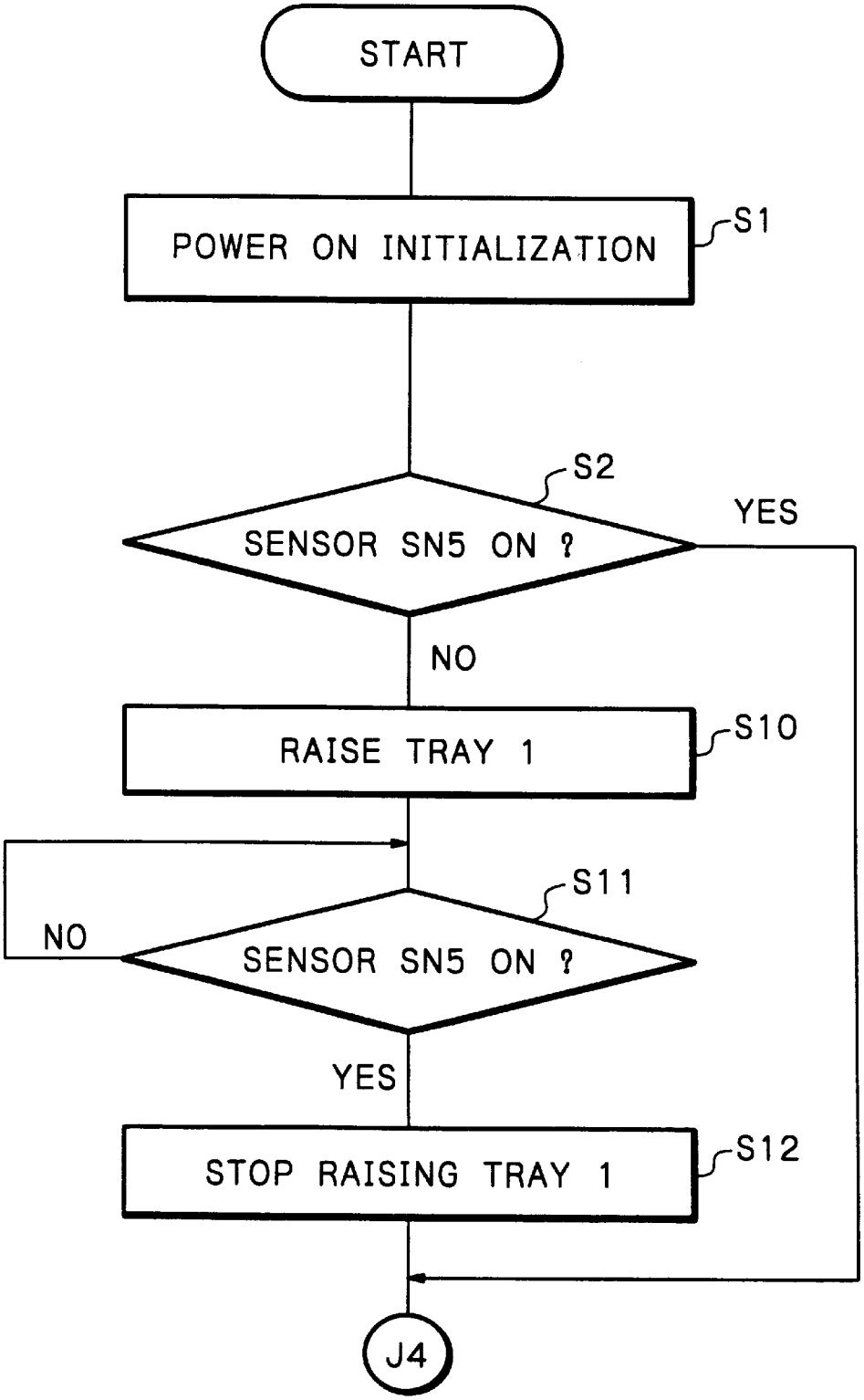
FIGS. 17 and 18 are flowcharts showing initialization which the first embodiment executes without using the sensor responsive to the lower retracted position.
Figure 18:
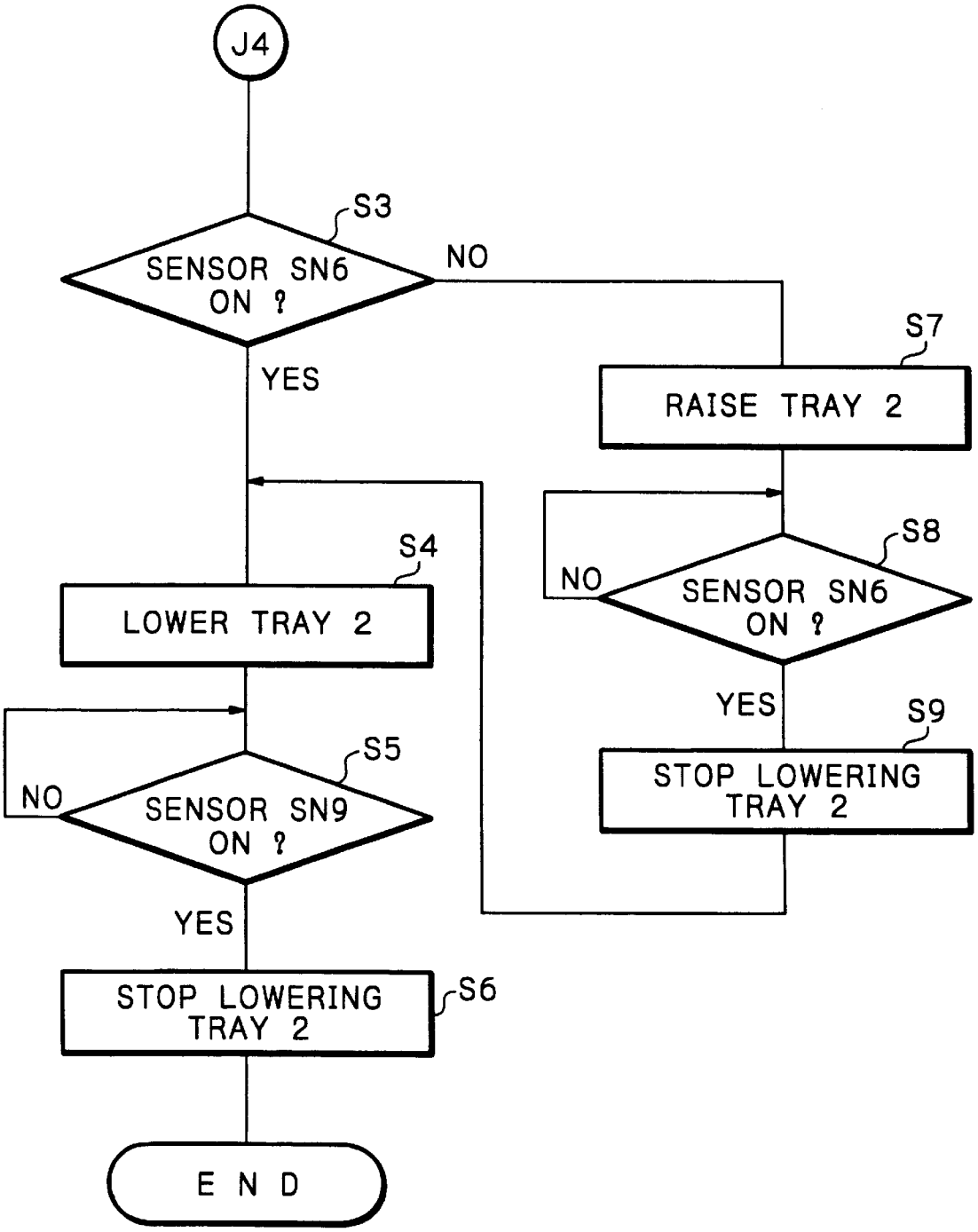

A specific initialization procedure not using the sensor SN7 will be described with reference to FIGS. 17 and 18. As shown, on the power-up of the copier G, the controller 100 starts initialization (step S1). The controller 100 determines whether or not the sensor SN5 is in an ON state (step S2). If the answer of the step S2 is YES, the controller 100 determines that the tray 1 is located at its home position, and then determines whether or not the sensor SN6 is in an ON state (step S3). If the answer of the step S3 is YES, the controller determines that the tray 2 is located at the outlet E2, and then lowers the tray 2 (step S4). As soon as the sensor SN9 turns on (YES, step S5), the controller 100 stops the movement of the tray 2. As a result, the tray 2 is located at its home position.

If the sensor SN6 is in an OFF state, as determined in the step S3, the controller 100 once raises the tray 2 (step S7) and determines whether or not the sensor SN6 is an ON state (step S8). If the answer of the step S8 is YES, the controller stops the movement of the tray 2 (step S9). This is followed by the step S4.

If the answer of the step S2 is NO, meaning that the sensor SN5 is in an OFF state, the controller 100 raises the tray 1 (step S10) and then determines whether or not the sensor SN5 is in an ON state (step S11). If the answer of the step S11 is YES, the controller 100 stops the movement of the tray 1 (step S12). Consequently, the tray 1 is located at its home position. This is followed by the sequence of steps to be executed when the answer of the step S2 is YES.

The above embodiment achieves various unprecedented advantages, as enumerated below.

(1) The stand-by position or home position assigned to the lower tray is higher in level than the retracted position. Therefore, when the lower tray is selected, it can move to the outlet in a short period of time.

(2) The home position sensing means bifunctions as means for sensing the full state of the lower tray. This obviates the need for extra means for sensing the full state and thereby reduces the cost of the finisher.

(3) The stand-by position or home position sensing means is positioned above the retracted position by the height of a stack that the upper tray can accommodate. This minimizes the distance of retraction of the full lower tray and thereby obviates a wasteful space.

(4) Because the retracted position is determined in terms of the distance of movement of the lower tray without using extra means, the cost is further reduced.

(5) The discharge position sensing means is so located as to operate on a surface which the trailing edge of a paper on the tray contacts. The sensing means can therefore sense both of the upper tray and lower tray as well as the top of a paper stack. This simplifies the sensing arrangement and reduces the cost of the finisher.

Second Embodiment

This embodiment is directed mainly toward the second object stated earlier. Because the second embodiment is similar to the first embodiment of FIGS. 1–8 in construction and operation, the following description will concentrate on differences. This is also true with the other embodiments to be described later.

A tray control procedure to be executed by the controller 100 and unique to this embodiment will be described with reference to FIGS. 19–25 in addition to FIGS. 1–8. The sensor SN5 senses the upper end of the end fence 1*a* of the tray 1 when the tray 1 is located at its home position while the sensor SN9 senses the upper rear end of the tray 2 when the tray 2 is located at its home position.

Figure 19:
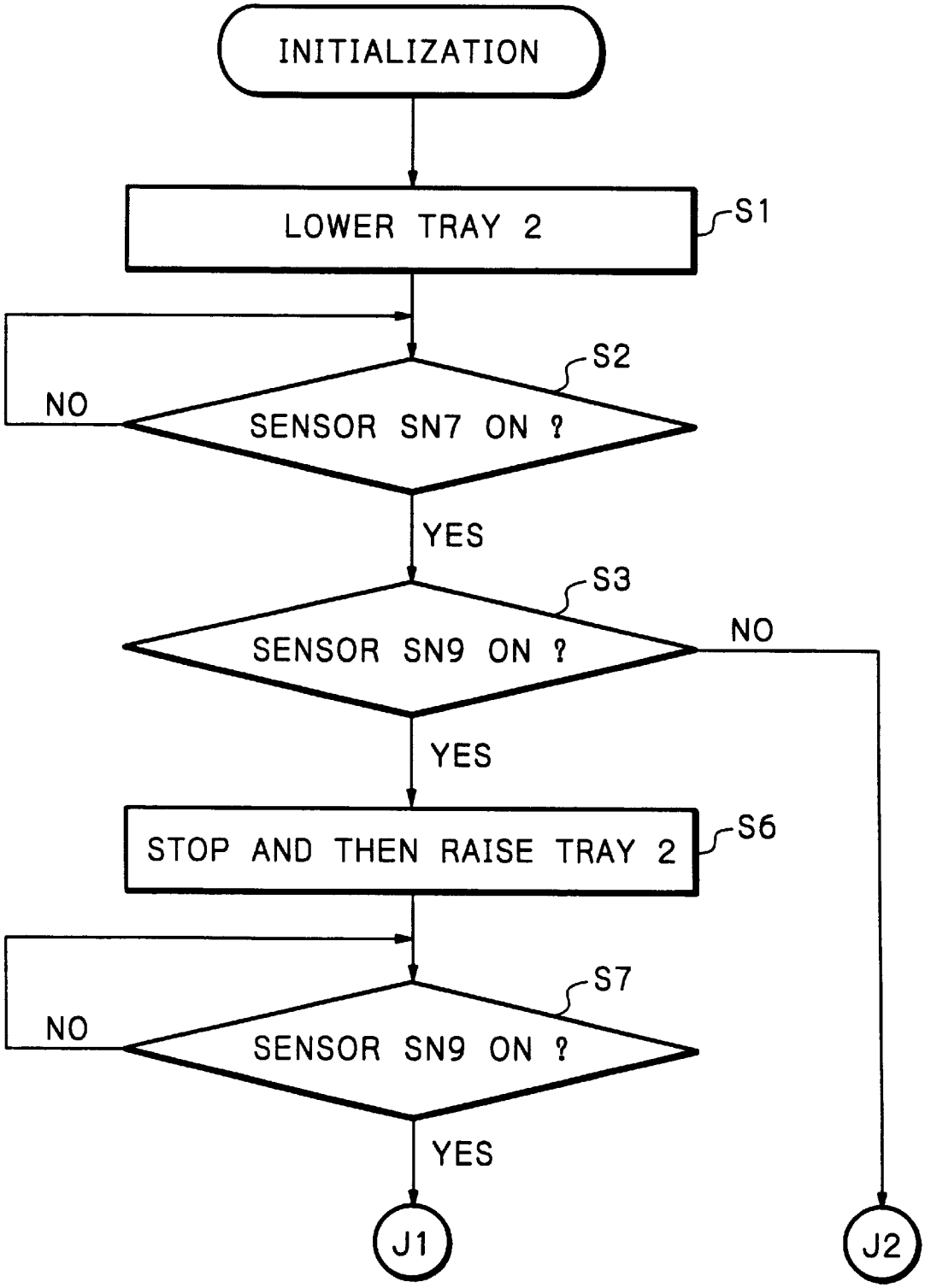
FIGS. 19 and 20 are flowcharts demonstrating initialization representative of a second embodiment of the present invention.
Figure 20:
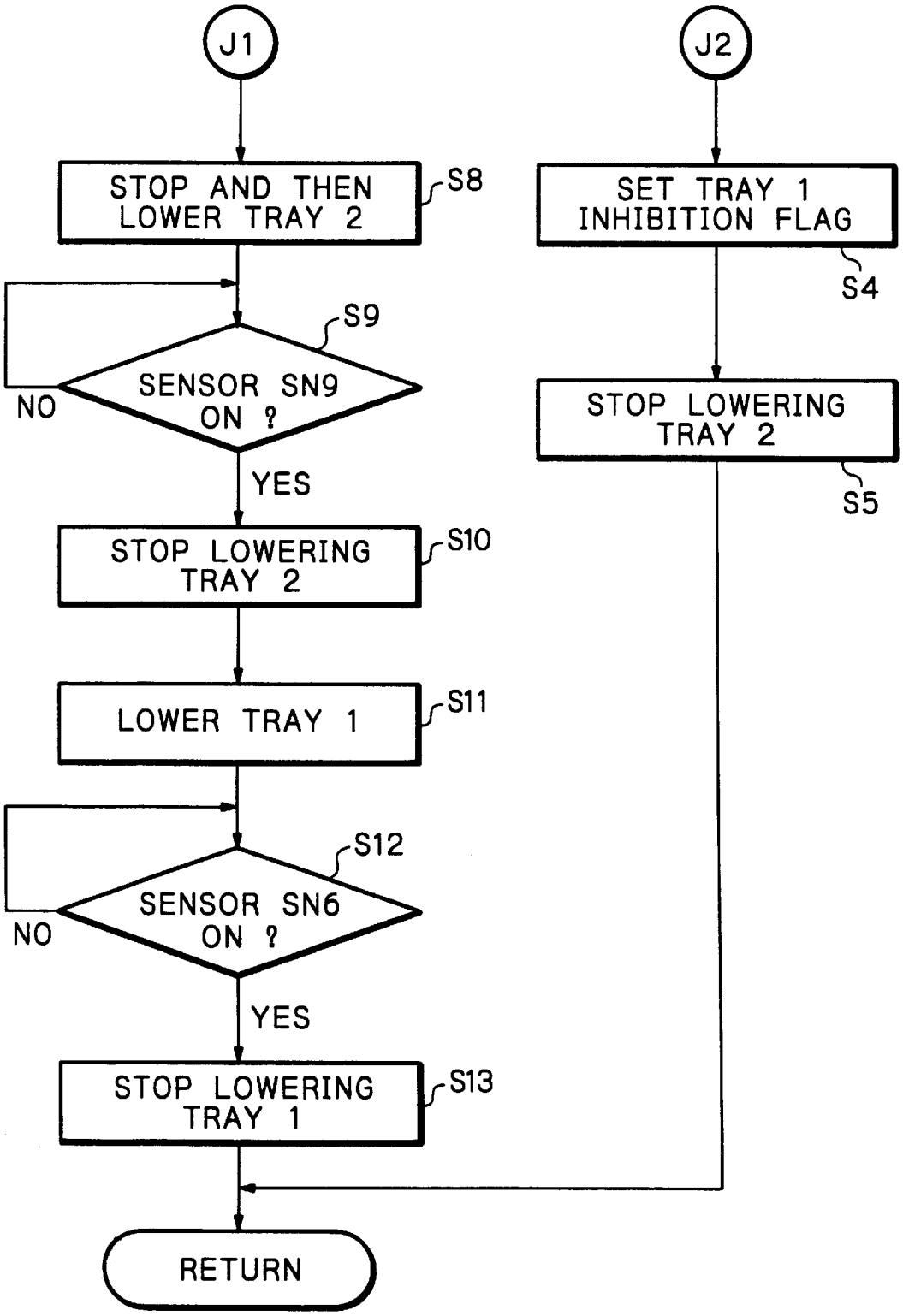

Reference will be made to FIGS. 19 and 20 for describing the initialization of the trays 1 and 2, i.e., a procedure for locating them at the home positions. As shown, on the power-up of the copier G, the controller 100 starts initialization and lowers the tray 2 (step S1). The controller 100 determines whether or not the sensor SN7 is in an ON state (step S2). If the answer of the step S2 is YES, the controller 100 determines whether or not the sensor SN9 is in an ON state (step S3). If the answer of the step S3 is YES, the controller 100 determines that the number of papers stacked on the tray 2 is so great, the tray 1 cannot be lowered. In this case, the controller 100 sets a tray 1 inhibition flag in the flag area of a RAM (Random Access Memory), not shown, to thereby inhibit the tray 1 from being used (step S4). Then, the controller 100 stops the movement of the tray 2 (step S5).

If the sensor SN9 is in an OFF state, as determined in the step S3, the controller stops of the tray 2, then raises it (step S6), and again determines whether or not the sensor SN9 is in an ON state (step S7), if the answer of the step S7 is YES, the controller 100 stops the tray 2 and again lowers it (step S8). As soon as the sensor SN9 turns off (YES, step S9), the controller 100 stops the tray 2. As a result, the upper surface of the tray 2 or that of a paper stack on the tray 2 is located at or below the home position of the tray 2. Subsequently, the controller 100 determines whether or not the sensor SN6 is in an ON state. If the sensor SN6 is in an OFF state, the controller 100 lowers the tray 1 (step S11). As soon as the sensor SN6 senses the upper end of the end fence 1*a* of the tray 1 (YES, step S12), the controller 100 stops the tray 1 (step S13).

Figure 21:
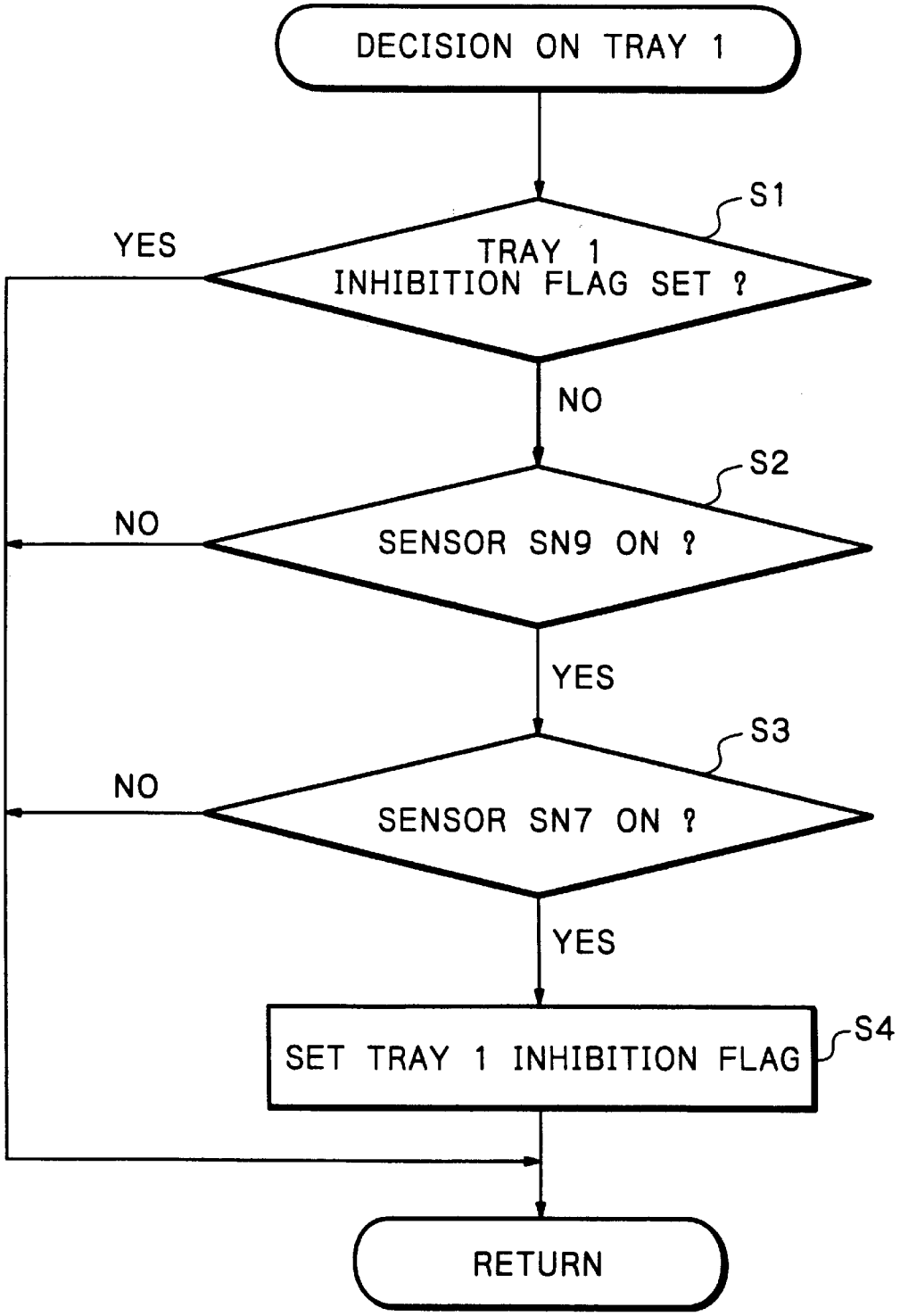
FIG. 21 is a flowchart showing a specific procedure that the second embodiment executes for determining whether or not the upper tray is usable.
Figure 22:
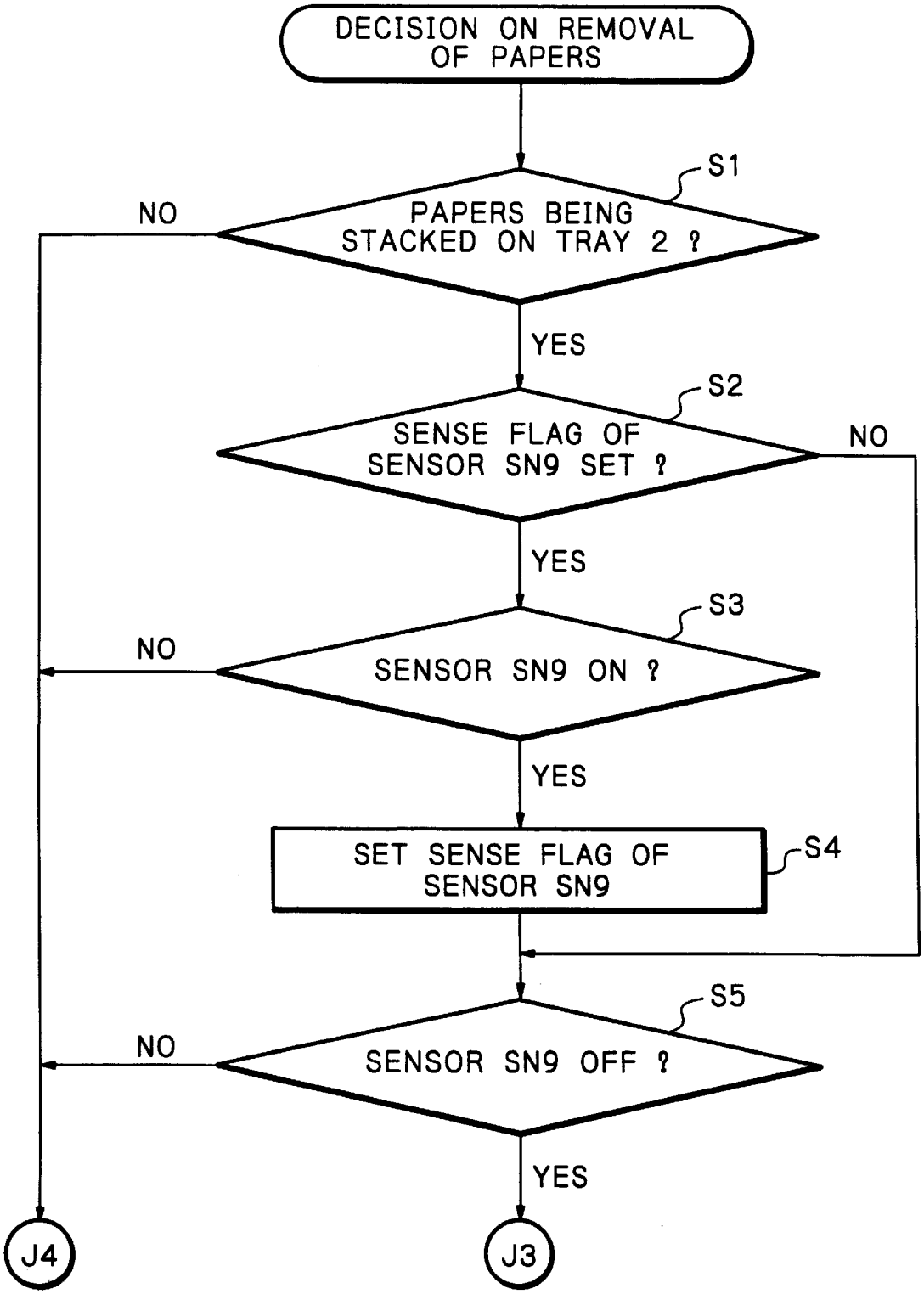
FIGS. 22 and 23 are flowcharts showing another specific procedure which the second embodiment executes for determining whether or not papers have been removed.
Figure 23:
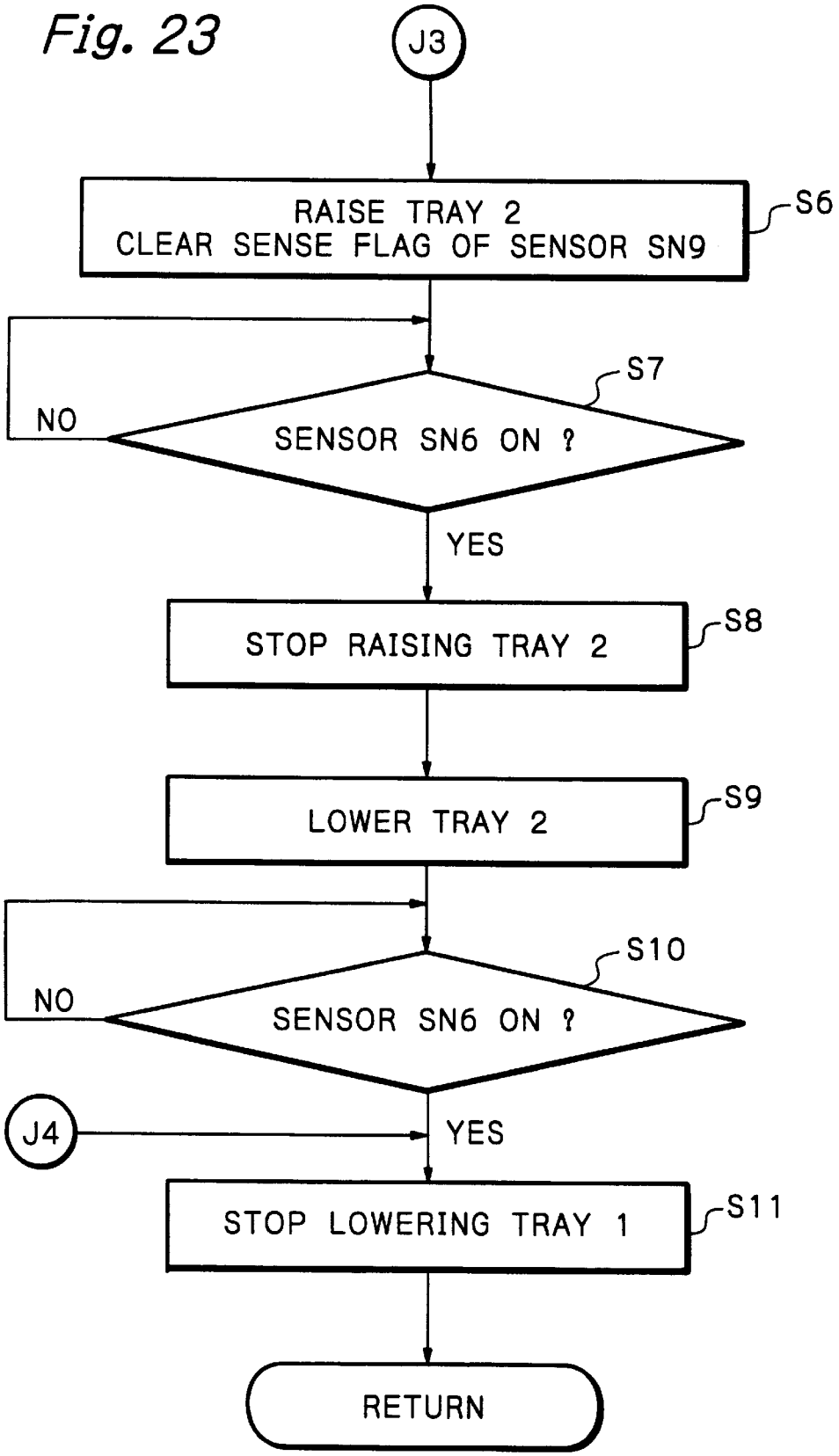

During the downward movement of the tray 2 or during the stacking of papers on the tray 2, the controller 100 determines whether or not the tray 1 can be lowered in accordance with a subroutine program shown in FIG. 21. For example, while papers are sequentially stacked on the tray 2, the tray 2 is sequentially lowered for accommodating a great number of papers. However, it sometimes occurs that after the current job, the tray 1 is selected in place of the tray 2 without the stack of papers being removed from the tray 2.

In the above situation, the tray 2 is lowered. Specifically, as shown in FIG. 21, the controller 100 determines whether or not the tray 1 inhibition flag is set (step S1) If the answer of the step S1 is NO, the controller 100 determines whether or not the sensor SN9 is in an ON state (step S2). If the answer of the step S2 is YES, the controller 100 determines whether or not the sensor SN7 is in an ON state (step S3).

Assume that the sensors SN9 and SN7 both turn on while the tray 2 is in downward movement. Then, the controller 100 determines that the top of the stack on the tray 2 may lie in the range to which the tray 1 should be lowered. In this case, the controller 100 sets the tray 1 inhibition flag (step S4) and sends a signal indicative of the inhibition to a controller, not shown, included in the copier G. In response, the controller of the copier G urges the operator to remove the stack from the tray 2 via, e.g., the operation panel.

Assume that the sensor SN9 senses a paper during stacking of papers on the tray 2 and then turns off. Then, the controller 100 raises the tray 2, determining that the operator has removed the stack from the tray 2. This will be described specifically with reference to FIGS. 22 and 23. As shown, the controller 100 determines whether or not papers are being stacked on the tray 2 (step S1). If the answer of the step S1 is YES, the controller 100 determines whether or not a sense flag relating to the sensor SN9 is set (step S2). If the answer of the step S2 is YES, the control for 100 determines whether or not the sensor SN9 is in an ON state (step S3). If the answer of the step S3 is YES, the controller 100 sets the sense flag relating to the sensor SN9 (step S4).

Subsequently, the controller 100 determines whether or not the sensor SN9 is in an OFF state (step S5). If the answer of the step S5 is YES, the controller 100 raises the tray 2 and clears the sense flag relating to the sensor SN9 (step S8). As soon as the sensor SN6 senses the tray 2 being raised (YES, step S7), the controller 100 stops the tray 2 (step S8). Thereafter, the controller 100 lowers the tray 2 (step S9) and then stops it as soon as the sensor SN6 turns off (step S11). This successfully locates the tray 2 at the adequate position for receiving papers via the outlet 2. Even when some papers are left on the tray 2, the top of the papers is located at the adequate position.

Figure 24:
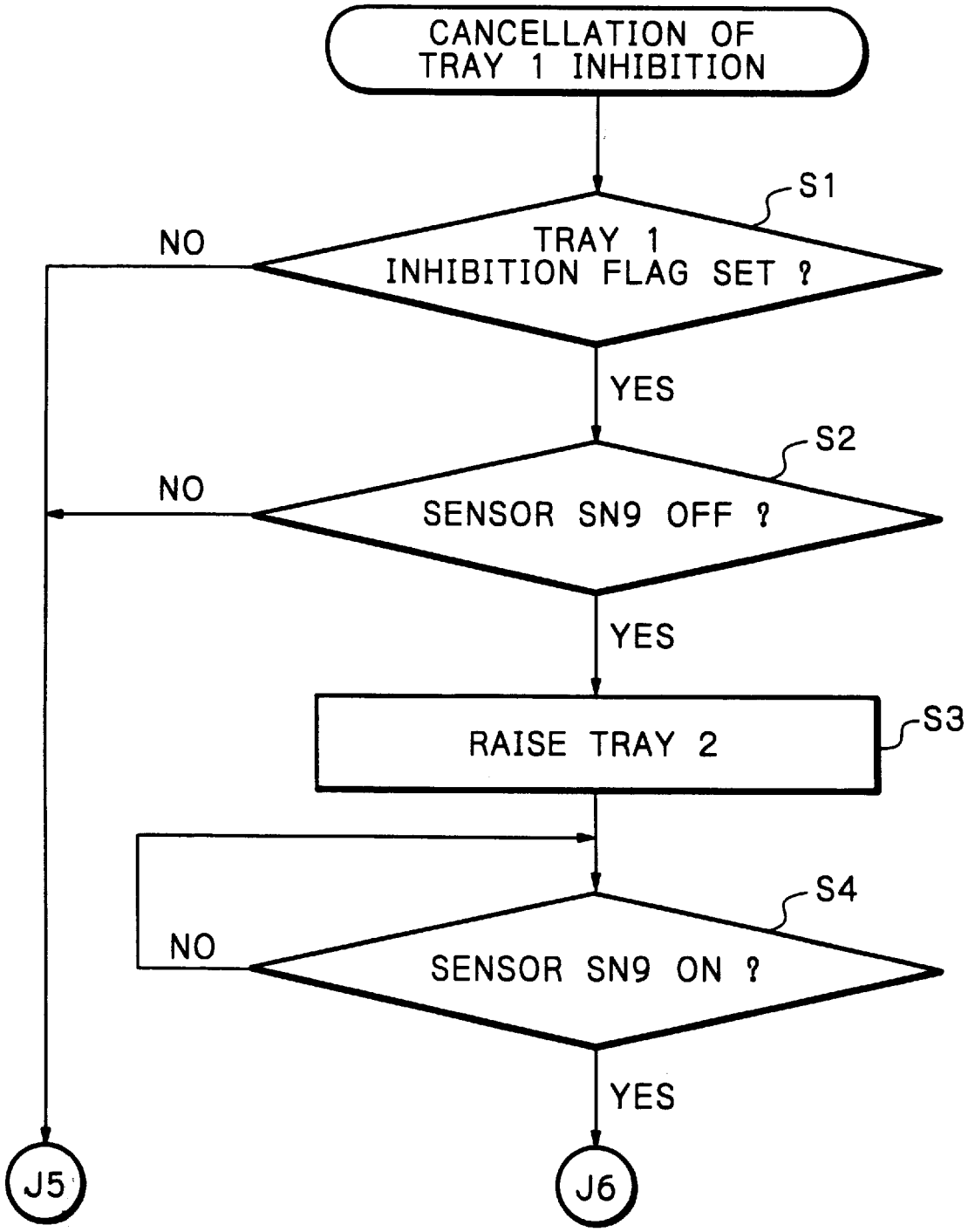
FIGS. 24 and 25 are flowcharts showing still another specific procedure which the second embodiment executes for canceling inhibition relating to the upper tray.
Figure 25:
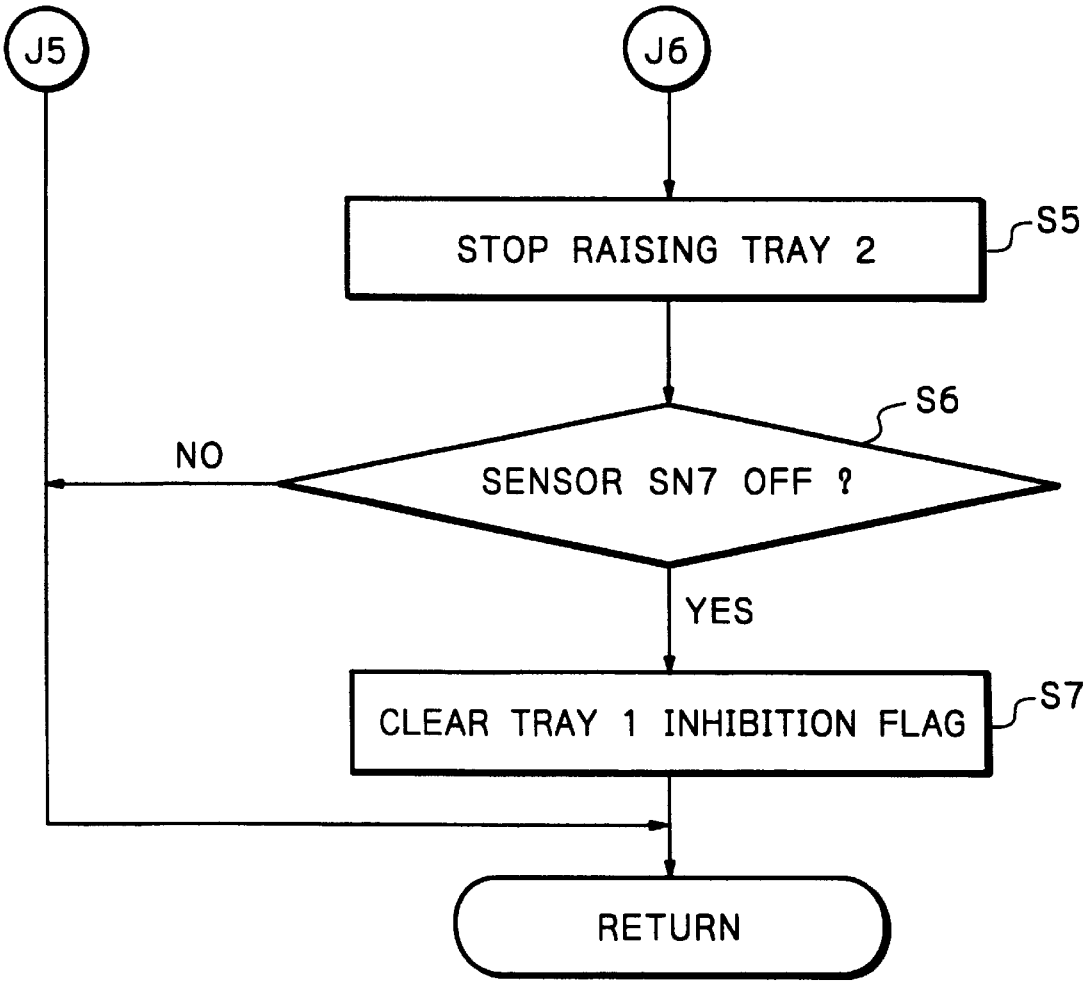

FIGS. 24 and 25 demonstrate a procedure for canceling the inhibition of the tray 1. As shown, the controller 100 determines whether or not the tray 1 inhibition flag is set (step S1). If the answer of the step S1 is YES and if the sensor SN9 turns off later (YES, step S2), the controller raises the tray (step S3) end then stops it (step S5) as soon as the sensor SN9 turns on (YES, step S4). As a result, the tray 2 is located at the home position or stand-by position. The controller 100 again determines whether or not the sensor SN7 is in an OFF state (step S6). If the answer of the step S6 is YES, the controller 100 clears the tray 1 inhibition flag (step S7) while sending a signal indicative of the cancellation to the controller of the copier G. In response, the controller of the copier G cancels the inhibition relating to the tray 1.

As stated above, the second embodiment achieves the following advantages.

(1) The stand-by position or home position assigned to the lower tray is higher in level than the retracted position. Therefore, when the lower tray is selected, it can move to the outlet in a short period of time.

(2) The retracted position sensing means senses the upper surface of the lower tray or the top of papers stacked on the lower tray. The lower tray can therefore wait at a preselected position without regard to the number of papers stacked thereon. This is successful to render the removal of the paper stack stable and the period of time necessary for the lower tray to reach the outlet constant.

(3) Because the stand-by position sensing means is located in the range of movement of a paper of minimum size available with the lower tray, the above advantages (1) and (2) are achievable with papers of all sizes.

(4) By simply adding the stand-by position sensing means, it is possible to prevent the upper tray from interfering with the lower tray when moved downward. This reduces the down time of the entire system including the finisher while promoting safety operation.

(5) Even when the paper stack is abruptly removed, the stand-by position sensing means allows the lower tray to be located at the adequate discharge position without fail. It follows that a wasteful space above the lower tray is obviated.

Third Embodiment

This embodiment is directed mainly toward the third embodiment stated earlier. This embodiment is also similar to the first embodiment except for the tray control procedure to be executed by the control means. A first tray control procedure available with the third embodiment will be described with reference to FIGS. 26–30 in addition to FIGS. 1–8. Again, the sensor SN6 senses the end fence 1*a* of the tray 1 when the tray 1 is in its home position while the sensor SN9 senses the upper rear end of the tray 2 when the tray 2 is in its home position.

Figure 26:
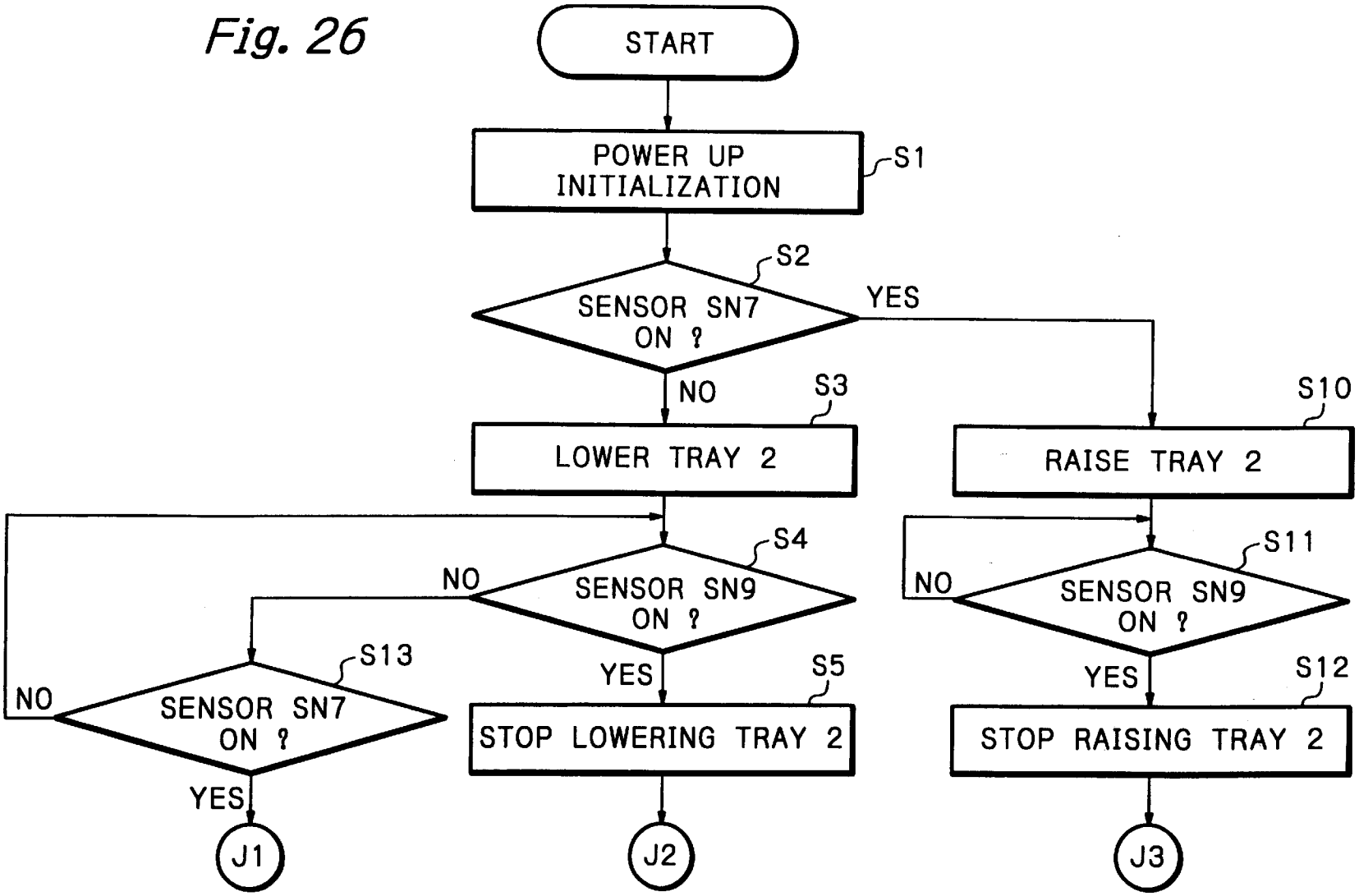
FIGS. 26 and 27 are flowcharts showing initialization representative of a third embodiment of the present invention.
Figure 27:
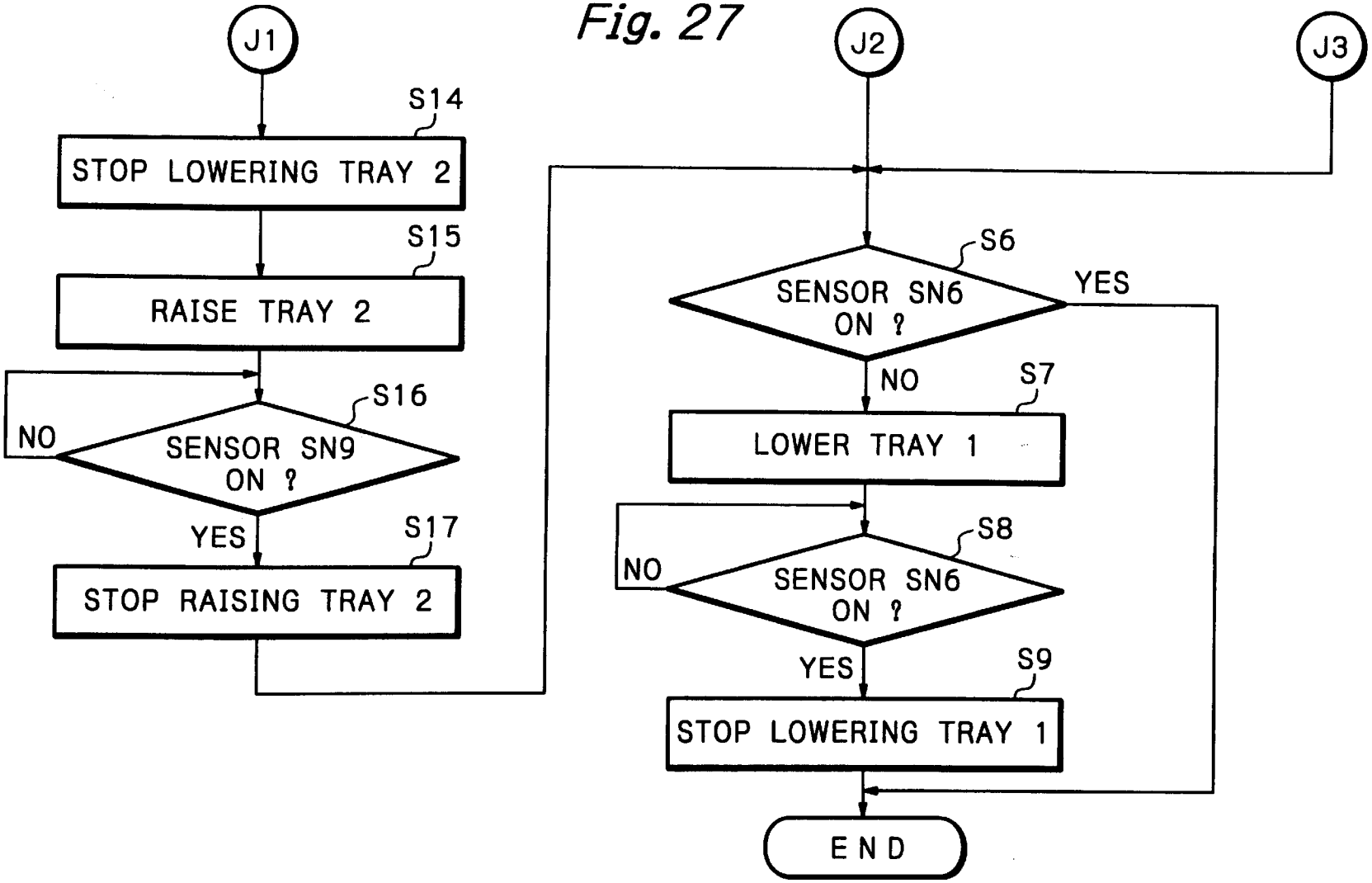

As shown in FIGS. 26 and 27, on the power-up of the copier G, the control means 100 starts initialization (step S1). Specifically, the control means 100 determines whether or not the sensor SN7 is in an ON state (step S2). If the sensor SN7 is in an OFF state (NO, step S2), the controller lowers the tray 2, determining that the tray 2 is positioned above the sensor SN7 (step S3). Then, the controller 100 determines whether or not the sensor SN9 is in an ON state (step S4). If the answer of the step S4 is YES, the controller 100 stops the movement of the tray 2 (step S5). As a result, the tray 2 is located at its home position.

Subsequently, the controller 100 determines whether or not the sensor SN6 is in an ON state (step S6). If the answer of the step S6 is NO, the controller 100 lowers the tray 1, determining that the tray 1 is positioned above the sensor SN6 (step S7). The controller 100 again determines whether or not the sensor SN6 is in an ON state (step S8). As soon as the sensor SN6 senses the upper end of the end fence 1*a* (YES, step S8), the controller 100 stops the movement of the tray 1 (step S9).

If the answer of the step S2 is YES, the controller 100 raises the tray 2 (step S10) until the sensor SN9 turns on (YES, step S11), Then, the controller 100 stops the movement of the tray 2 (step S12).

When the tray 2 is located between the sensors SN7 and SN9, the sensor SN9 remains in an OFF state, as determined in the step S4. In this case, the controller 100 determines whether or not the sensor SN7 is in an ON state (step S13). If the answer of the step S13 is YES, the controller 100 stops the movement of the tray 2 (step S14) and then raises the tray 2 (step S15). As soon as the sensor SN9 turns on (YES, step S16), the controller 100 stops the movement of the tray 2 (step S17).

As stated above, in the first tray control procedure, the tray 1 is located at the paper discharge position. Therefore, when the tray 1 is selected, neither the tray 1 nor the tray 2 is moved. This promotes the efficient use of the tray 1 when the tray 1 is frequently used.

When the tray 2 is selected, the tray 1 is elevated until the sensor SN5 senses it. The tray 2 is raised from its stand-by position until the sensor SN6 senses it. The elevation of the tray 1 and that of the tray 2 may be affected at the same time, if desired.

Because the tray 2 is moved from its stand-by position to the outlet E2, a period of time necessary for the tray 2 to reach the outlet 2 is shorter than when the tray 2 is moved from its retracted position (lower limit position) defined by the sensor SN7.

Figure 28:
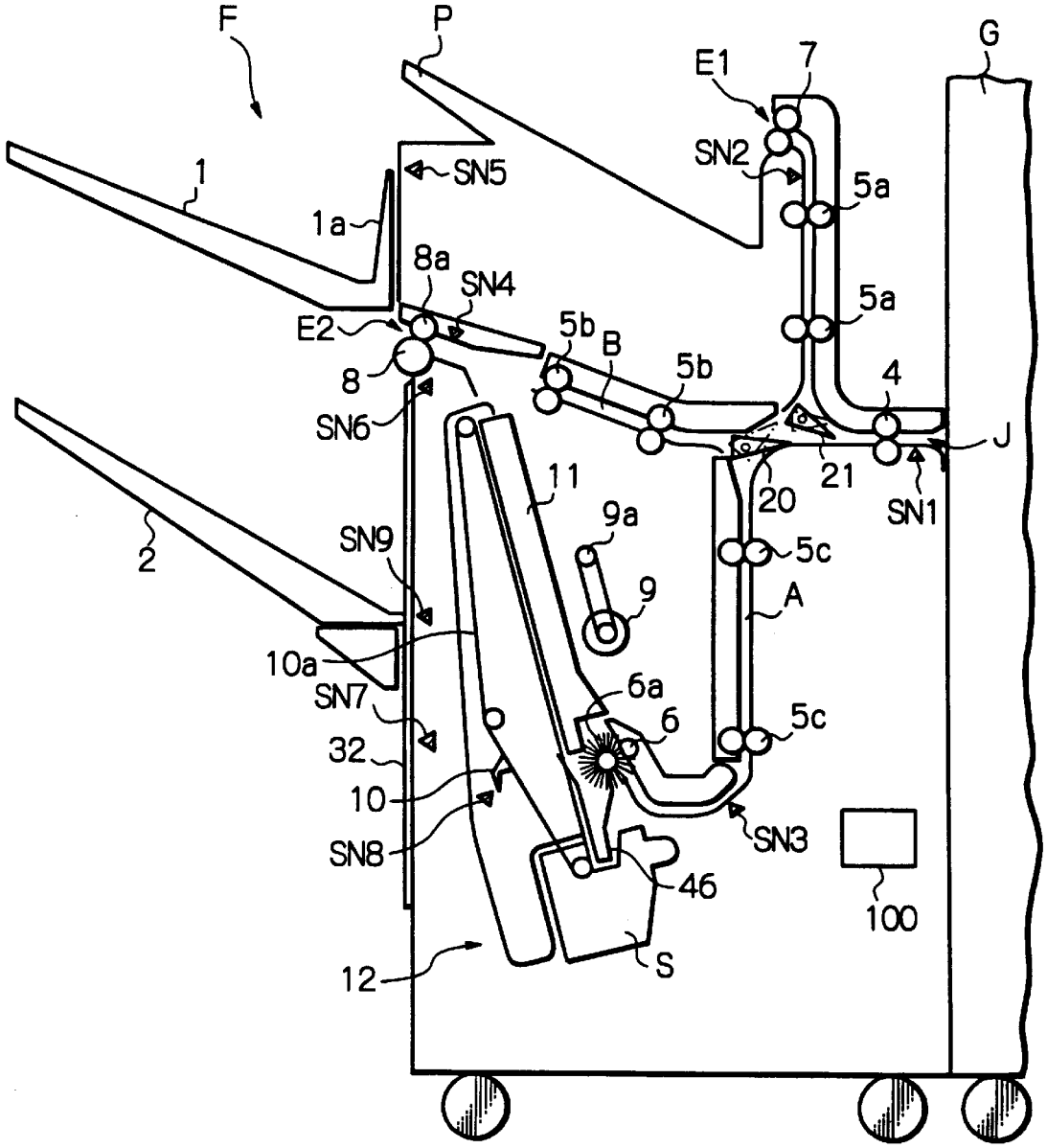
FIG. 28 is a side elevation showing the home positions of the trays for executing an alternative control procedure.
Figure 29:
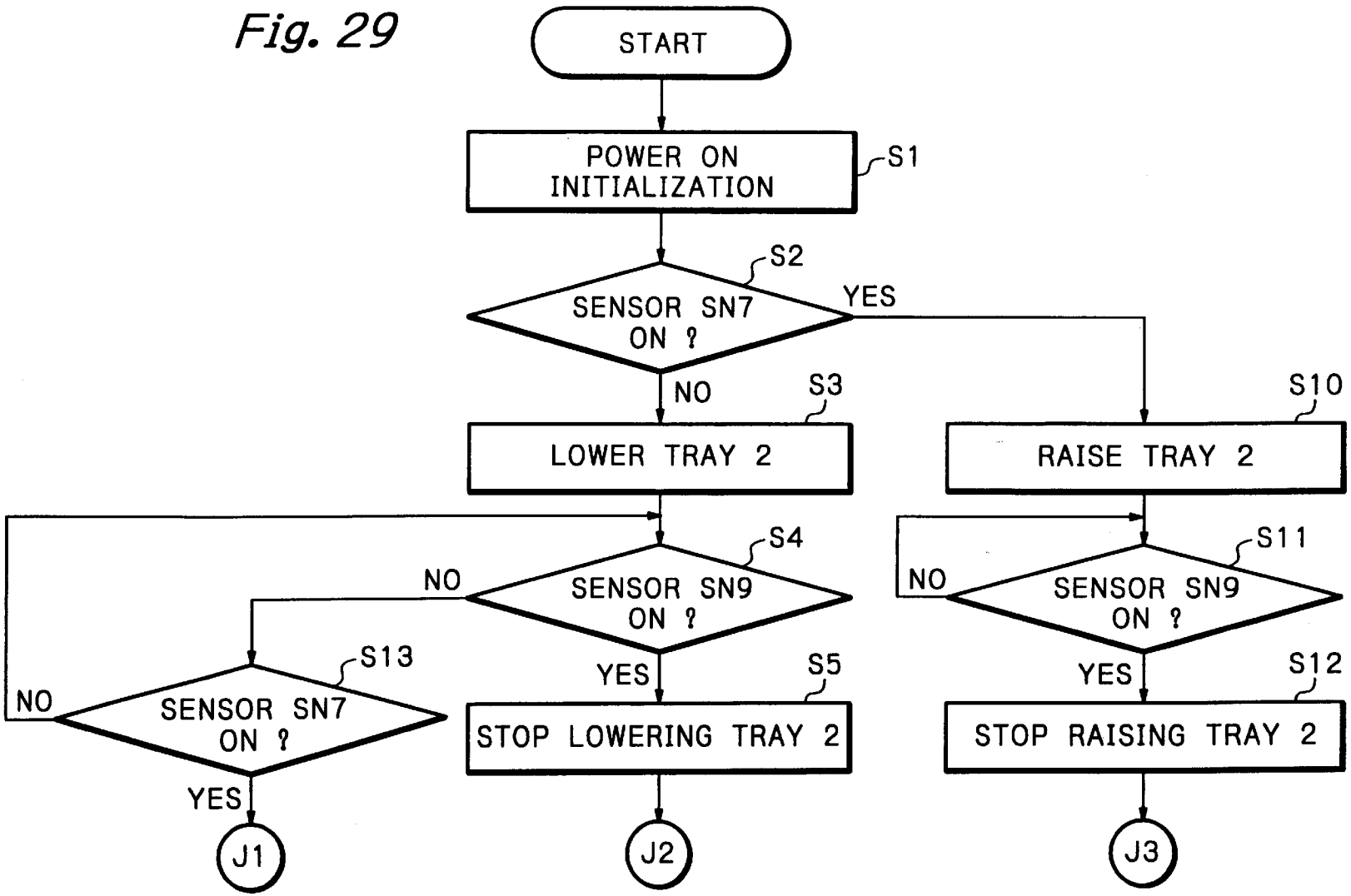
FIGS. 29 and 30 are flowcharts showing initialization associated with the arrangement of FIG. 28.
Figure 30:
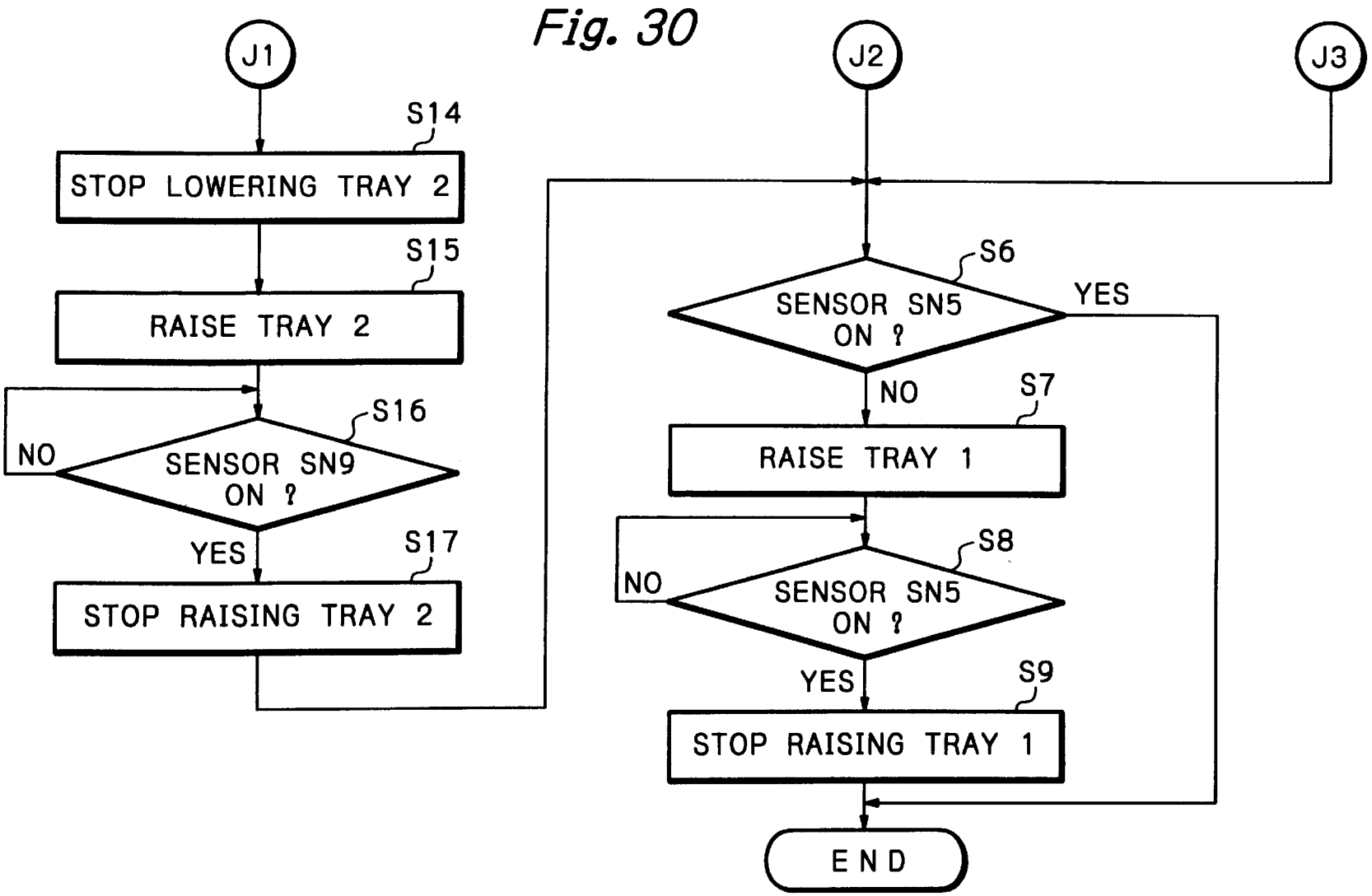

A second tray control procedure available with the illustrative embodiment is as follow. As shown in FIG. 28, the sensor SN5 senses the upper end of the end fence 1*a* of the tray 1 when the tray 1 is in its home position while the sensor SN9 senses the upper rear end of the tray 2 when the tray 2 is in its home position. Initialization of the trays 1 and 2 will be described with reference to FIGS. 29 and 30.

As shown, on the power-up of the copier G, the controller 100 starts initialization (step S1). Specifically, the control means 100 determines whether or not the sensor SN7 is in an ON state (step S2). If the sensor SN7 is in an OFF state (NO, step S2), the controller lowers the tray 2, determining that the tray 2 is positioned above the sensor SN7 (step S3). Then, the controller 100 determines whether or not the sensor SN9 is in an ON state (step S4). If the answer of the step S4 is YES, the controller 100 stops the movement of the tray 2 (step S5). As a result, the tray 2 is located at its home position.

Subsequently, the controller 100 determines whether or not the sensor SN5 is in an ON state (step S6). If the answer of the step S6 is NO, the controller 100 raises the tray 1 (step S7) and then determines whether or not the sensor SN5 is in an ON state (step S8). If the answer of the step S8 is YES, meaning that the sensor SN5 has sensed the upper end of the end fence 1*a*, the controller 100 stops the movement of the tray 1 (step S9). If the answer of the step S6 is YES, the controller 100 ends the initialization, determining that the tray 1 is held its home position.

If the sensor SN7 is in an ON state, as determined in the step S2, the controller 100 raises the tray 2 (step S10) and then determines whether or not the sensor SN9 is in an ON state (step S11). If the answer of the step S11 is YES, the controller 100 stops the movement of the tray 2 (step S12). If the sensor SN9 is in an ON state, as determined in the step S4, the controller 100 determines whether or not the sensor SN7 is in an ON state (step S13). If the answer of the step S13 is YES, the controller 100 stops the movement of the tray 2 (step S14). Subsequently, the controller 100 raises the tray 2 (step S16). As soon as the sensor SN9 senses the upper rear end of the tray 2 (YES, step S16), the controller 100 stops the movement of the tray 2 (step S17). In this case, the tray 2 has been positioned between the sensors SN9 and SN7 before.

While the above specific procedure moves the tray 1 after the tray 2, the trays 1 and 2 may be moved at the same time, if desired, To bring the tray 1 to the outlet E2, the tray 1 is stopped when the sensor SN6 senses the upper end of its end fence 1*a*. To bring the tray 2 to the outlet E2, the tray 2 is once stopped when the sensor SN6 senses its upper rear end, then lowered by a preselected distance, and then brought to a stop.

Because the home position of the tray 2 corresponds to the position of the sensor SN9, the tray 2 is moved from the home position to the outlet E2 when selected. This successfully reduces the distance and time of movement of the tray 2, compared to the case wherein the home position is located below the position of the sensor SN7.

The end fence 1*a* of the tray 1 has its intermediate portion notched so as not to interfere with the push roller 70, FIG. 4, although not shown specifically. The sensor SN6 is therefore so positioned as to sense the end fence 1*a*, the rear end of the tray 2 or the top of a paper stack. In this sense, the sensor SN6 serves as a paper sensor at the same time.

As stated above, in the finisher shown in FIG. 28, the distance between the trays 1 and 2 held in their stand-by positions is greater than in the finisher of FIG. 1, facilitating the removal of a paper stack from the tray 2. It follows that the stand-by position of the tray 2 defined by the sensor SN9 can be selected in consideration of easy removal of a paper stack also.

The third embodiment shown and described has the following advantages.

(1) The stand-by position of the lower tray is located above the lower limit position of the same. This reduces a period of time necessary for the lower tray to reach the paper discharge position when selected.

(2) Because the home position of the upper tray correspond, to the paper discharge position, the finisher can be efficiently used when the upper tray is frequently used.

(3) Because the stand-by position of the upper tray is coincident with the retracted position above the outlet, the distance between the upper tray and the lower tray can be increased to facilitate the removal of a paper stack from the lower tray.

Fourth Embodiment

This embodiment is directed mainly toward the fourth object stated earlier. This embodiment differs from the previous embodiments in that the sensor SN9 responsive to the retracted position or home position of the tray 2 is absent and in that the controller 100 controls the trays 1 and 2 in a unique way. The fourth embodiment will be described with reference to FIGS. 31–40 in addition to FIGS. 1–8.

The sensor SN5 senses the upper end of the end fence is of the tray 1 when the tray 1 is in its home position. The home position of the tray 2 is lower than the position where the sensor SN6 senses it by a preselected distance.

Figure 31:
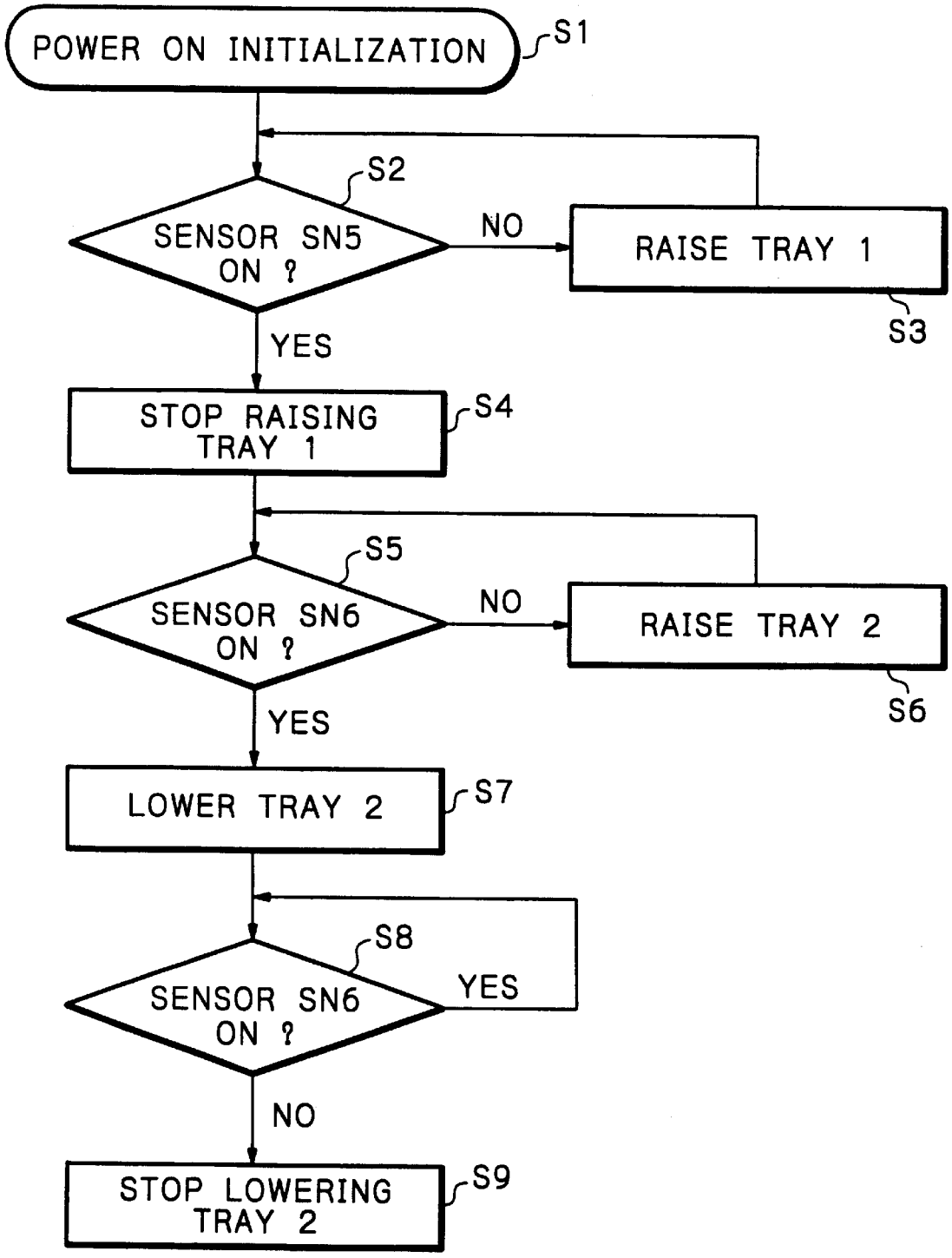
FIG. 31 is a flowchart showing initialization representative of a fourth embodiment of the present invention.

FIG. 31 demonstrates initialization for locating the trays 1 and 2 at their home positions. As shown, on the power-up of the copier G, initialization begins (step S1). The controller 100 determines whether or not the sensor SN5 is in an ON state (step S2). If the answer of the step S2 is NO, the controller 100 raises the tray 1 (S3), determining that the tray 1 is positioned below the sensor SN5. As soon as the sensor SN5 senses the tray 1 (YES, step S2), the controller 100 stops the movement of the tray 1 (step S4).

Subsequently, the controller 100 determines whether or not the sensor SN6 is in an ON state (step S8). If the answer of the step S5 is NO, the controller 100 raises the tray 2 (step S6). When the sensor SN6 senses the tray 2, the controller 100 stops the tray 2 at a position where the sensor SN6 has not sense it. If the answer of the step S5 is YES, the controller 100 lowers the tray 2 (step S7), determining that the tray 2 has overrun. Then, the controller determines whether or not the sensor SN6 is in an ON state (step S8), and stops the tray 2 when the sensor SN6 stops sensing the tray 2 (step S9).

Assume that the operator selects the tray 1 on the operation panel of the copier G or the computer connected thereto. Then, the controller 100 first determines whether or not the sensors SN5 and SN6 each are in an ON state in order to see the positions of the trays 1 and 2. Patterns A–O shown below are representative of the possible combinations of the ON/OFF states of the sensors SN5 and SN6 and the positions of the trays 1 and 2.

| | SN5 | SN6 | Positions of Trays |
|---|---|---|---|
| A: | ON | ON | tray 1 at retracted position<br>tray 2 overrun |
| B: | ON | OFF | tray 1 at retracted position<br>tray 2 below SN6 |
| C: | OFF | ON | tray 1 at discharge position<br>tray 2 below SN6 |
| D: | OFF | OFF | tray 1 between retracted position<br>and 2 discharge position<br>tray 2 below SN6 |

Figure 32:
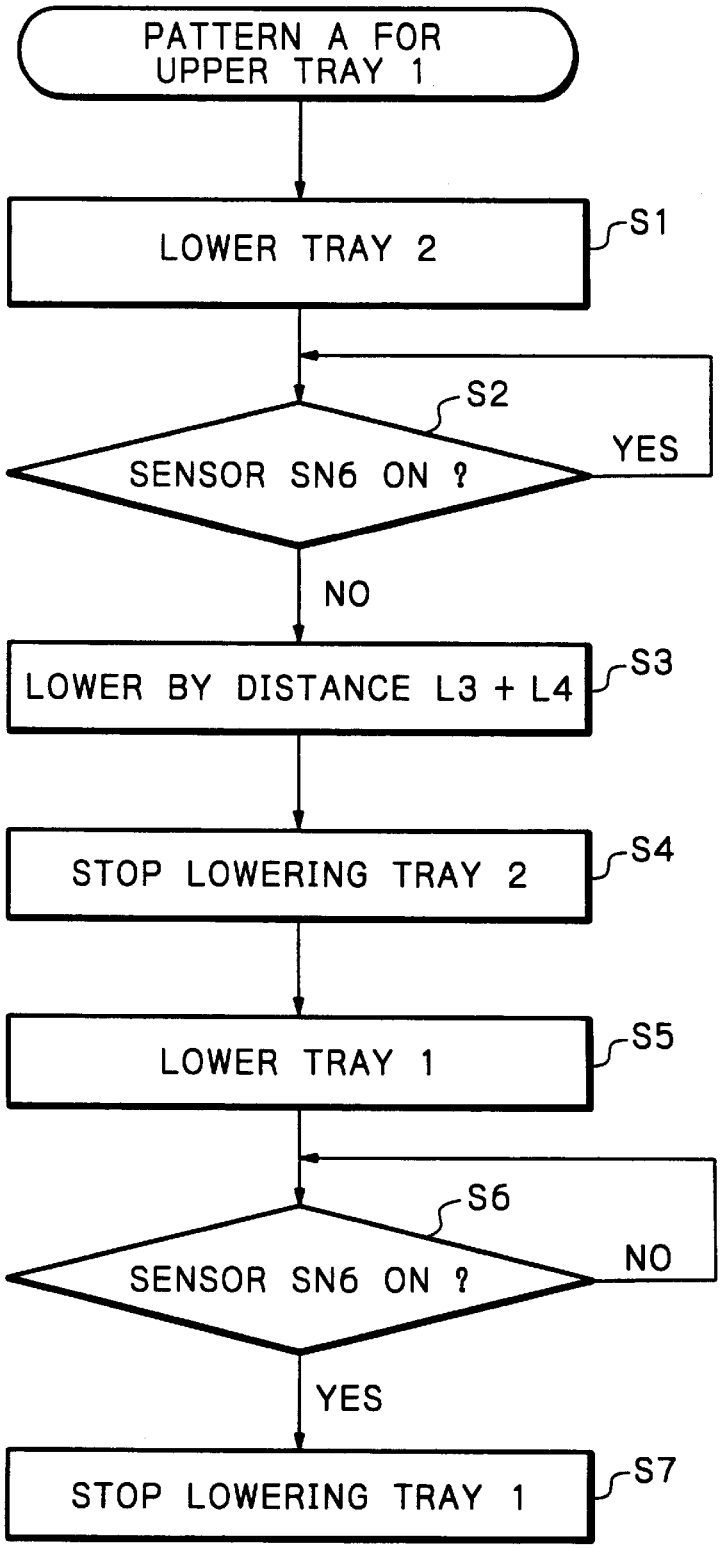
FIG. 32 is a flowchart showing a specific control procedure that the fourth embodiment executes when the upper tray is selected.
Figure 33:
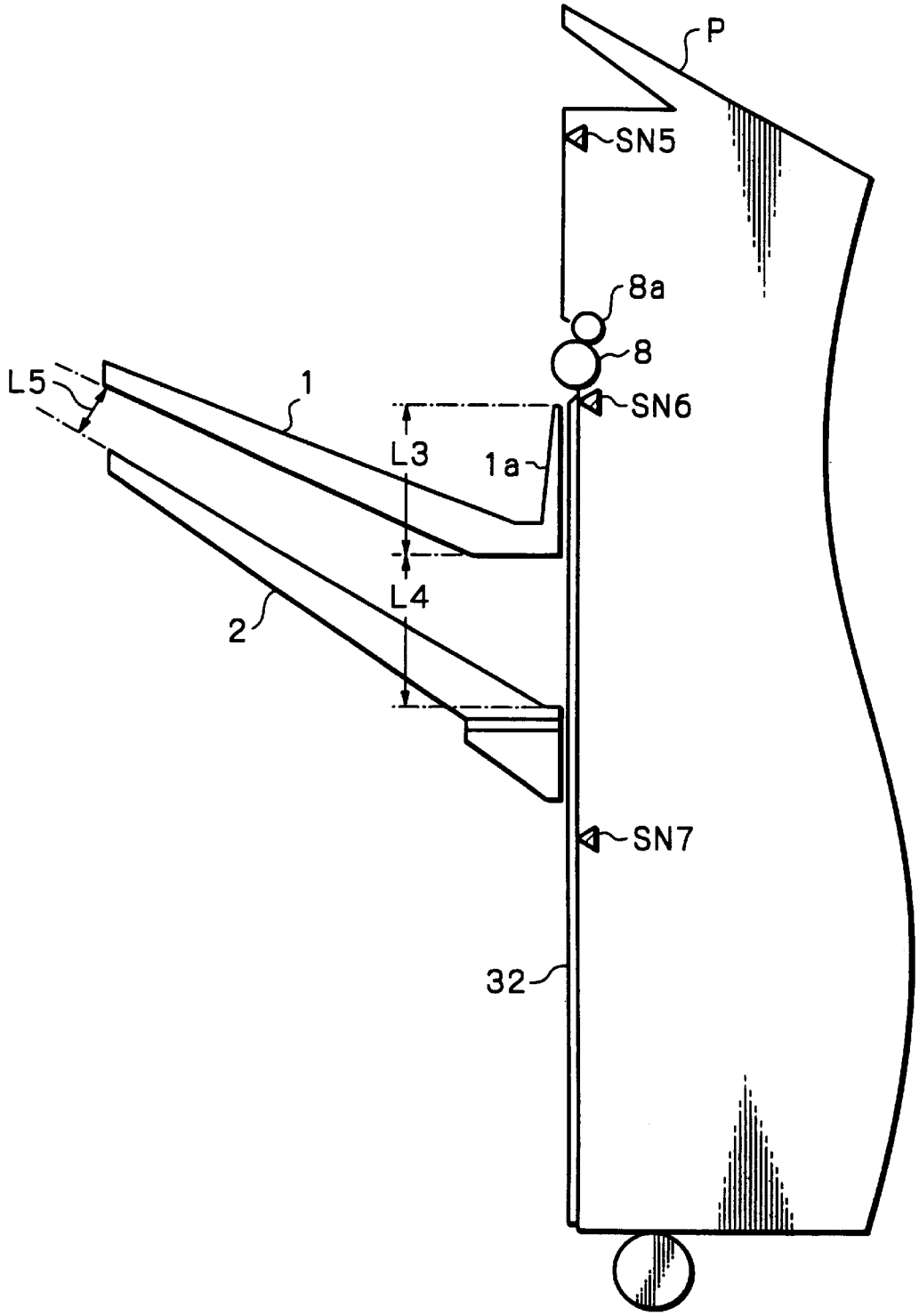
FIG. 33 is a side elevation showing the retracted position of the lower tray particular to the fourth embodiment.

As shown in FIG. 32, as for the above pattern A, the controller 100 first lowers the tray 2 (step S1) while determining whether or not the sensor SN6 is in an ON state (step S2). When the sensor SN6 stops sensing the tray 2 (NO, step S2), the controller 100 further lowers the tray 2 by a preselected distance of (L3+L4) (step S3) and then stops its movement. As shown in FIG. 33, the distance (L3+L4) is great enough for the tray 1 to move to the paper discharge position and for the operator to pick up a paper stack from the tray 2. Specifically, the distance L3 is a height that the tray 1 occupies when brought to the paper discharge position. The distance L4 is a height for implementing a tray gap L5 necessary for the operator to pick up a paper stack from the tray 2. To set the distance (L3+L4), a pulse counter, not shown, counts pulses far driving the motor 51 assigned to the tray 2 after the sensor SN6 has stopped sensing the tray 2.

Subsequently, the controller 100 lowers the tray 1 (step S5) and determines whether or not the sensor SN6 has sensed the upper end of the end fence 1*a* (step S6). If the answer of the step S6 is YES, the controller 100 stops the movement of the tray 1 (step S7).

Figure 34:
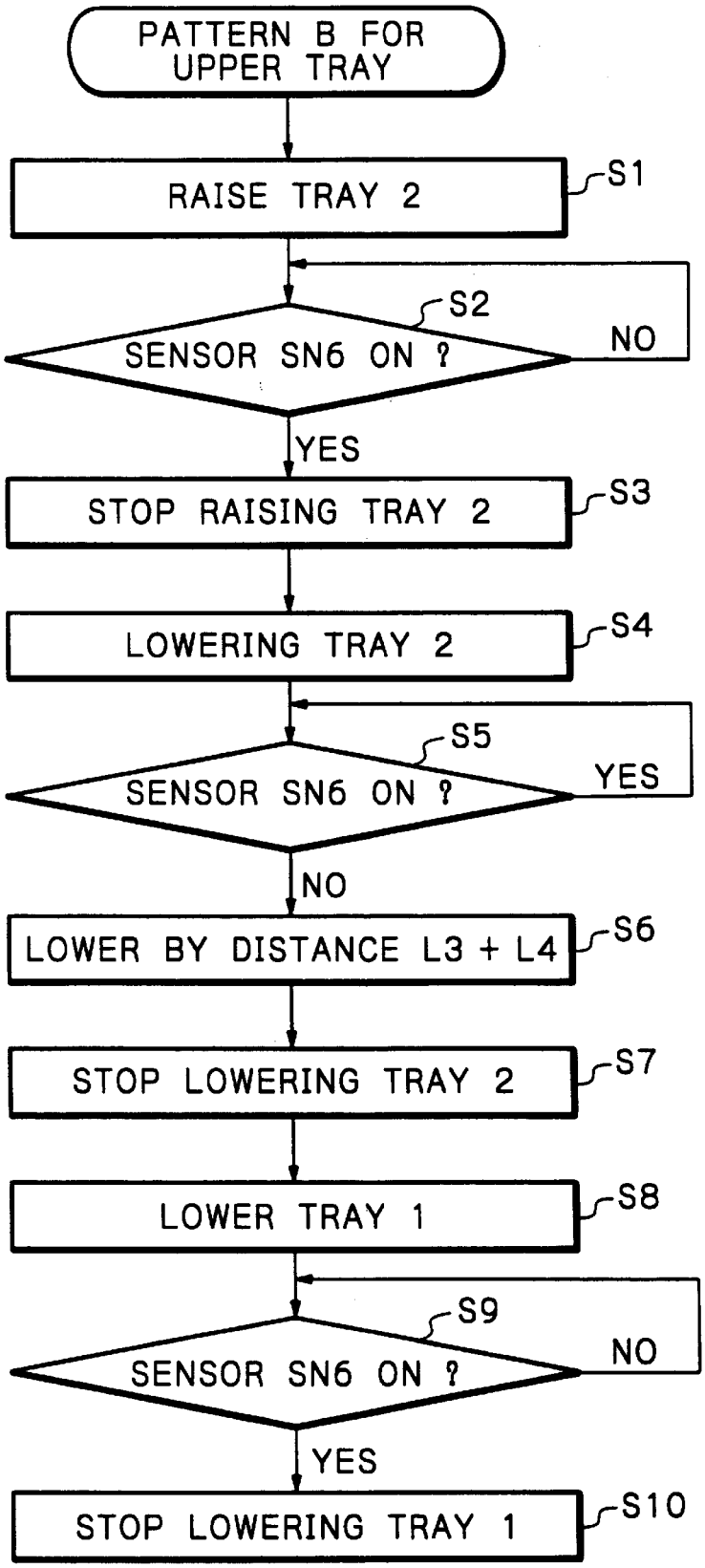
FIG. 34 is a flowchart showing another specific control procedure that the fourth embodiment executes when the upper tray is selected.

As shown in FIG. 34, as for the pattern B, the controller 100 once raises the tray 2 (S1) and determines whether or not the sensor SN6 is in an ON state (step S2). If the answer of the step S2 is YES, the controller 100 stops the movement of the tray 2 (step S3). Subsequently, the controller 100 lowers the tray 2 (step S4) and determines whether or not the sensor SN6 is in an ON state (step S5). If the answer of the step S5 is NO, the controller 100 lowers the tray 2 by the distance (L3+L4) (step S6) and then stops it (step S7). Thereafter, the controller 100 lowers the tray 1 (step S8) and determines whether or not the sensor SN6 has sensed the upper end of the end fence 1*a* (step S9). If the answer of the step S9 is YES, the controller 100 stops the movement of the tray 1.

As for the pattern C, the controller 100 does not execute any tray control and allows a job to be executed immediately, As for the pattern D, the controller 100 determines that the position of the tray 1 is unusual, executes initialization, and then sets up the pattern B.

When the operator selects the tray 2 an the operation panel of the copier G or the computer connected thereto, the controller 100 also determines the statuses of the sensors SN5 and SN6 first in order to see the positions of the trays 1 and 2.

Figure 35:
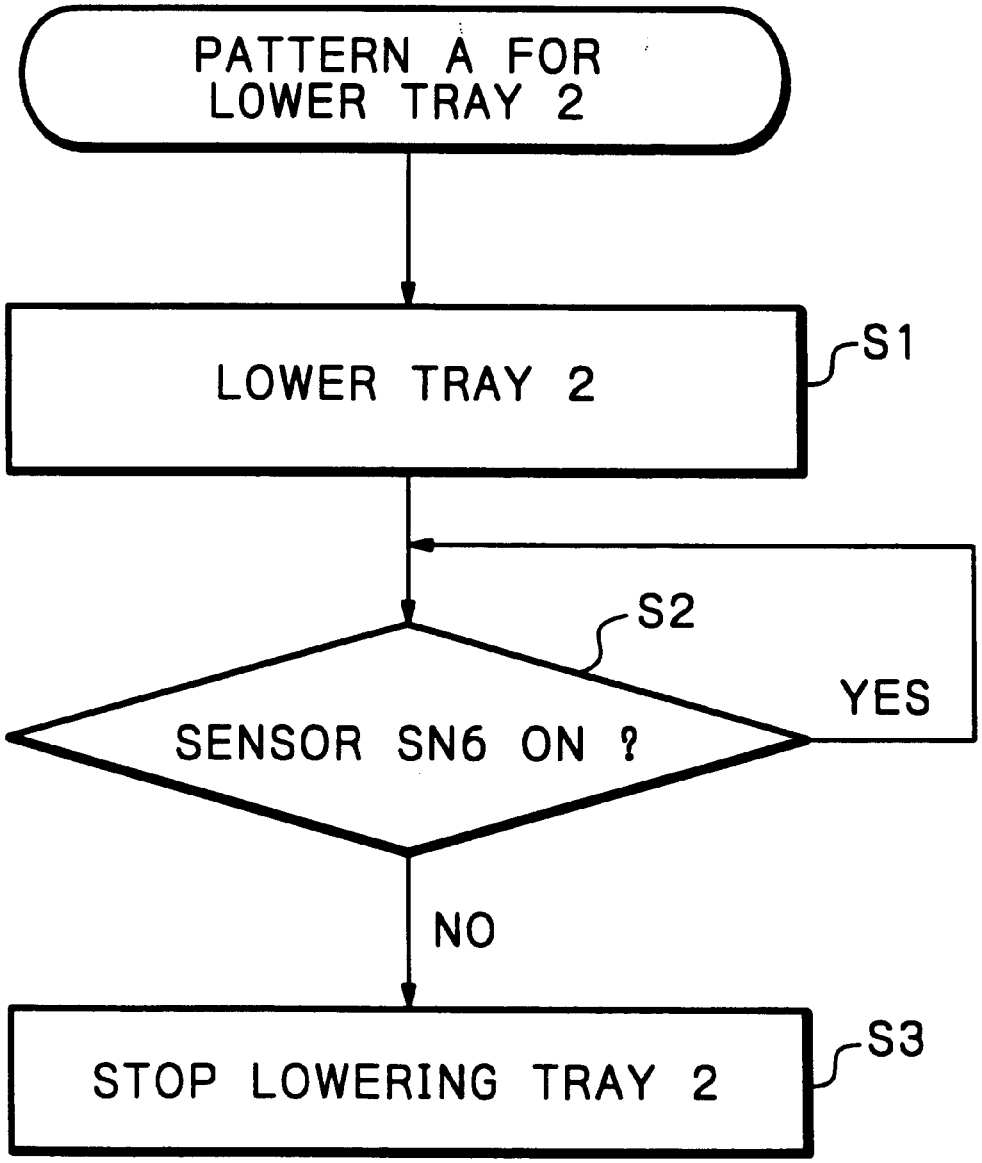
FIG. 35 is a flowchart showing another specific control procedure that the fourth embodiment executes when the lower tray is executed.

Specifically, as shown in FIG. 35, as for the pattern A, the controller 100 first lowers the tray 2 (step S1) and determines whether or not the sensor SN6 is in an ON state (step S2). When the sensor SN6 stops sensing the tray 2 (NO step S2), the controller 100 stops the movement of the tray 2 (step S3).

Figure 36:
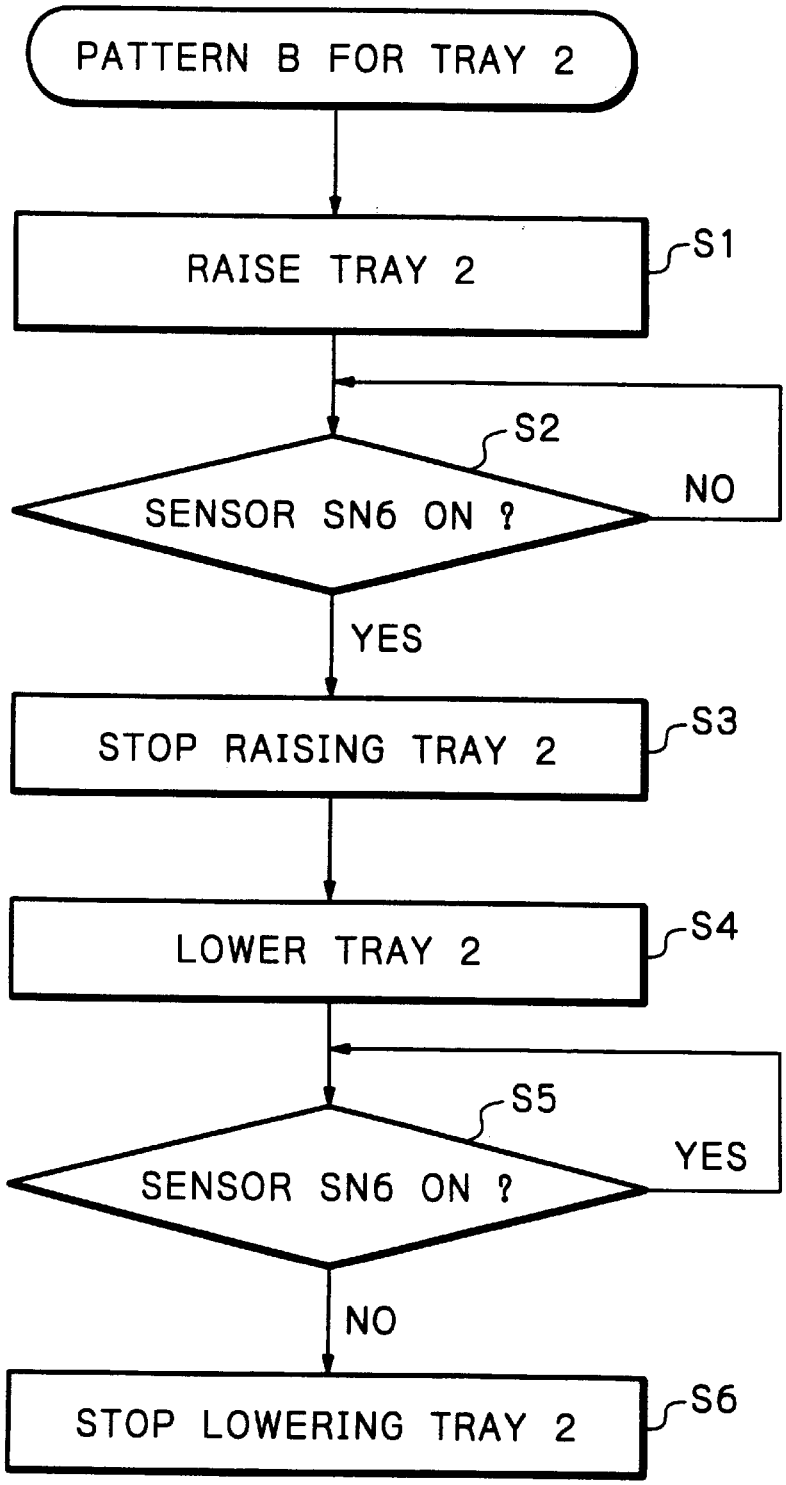
FIG. 36 is a flowchart showing another specific control procedure that the fourth embodiment executes when the lower tray is selected.

As shown in FIG. 36, as for the pattern B, the controller 100 once raises the tray 2 (step S1) and determines whether or not the sensor SN6 is in an ON state (step S2). As soon as the sensor SN6 senses the tray 2 (YES, step S2), the controller 100 stops the movement of the tray 2 (step S3). Subsequently, the controller 100 lowers the tray 2 (step S4) and then stops it (step S6) as soon as the sensor SN6 stops sensing it (NO, step S5).

Figure 37:
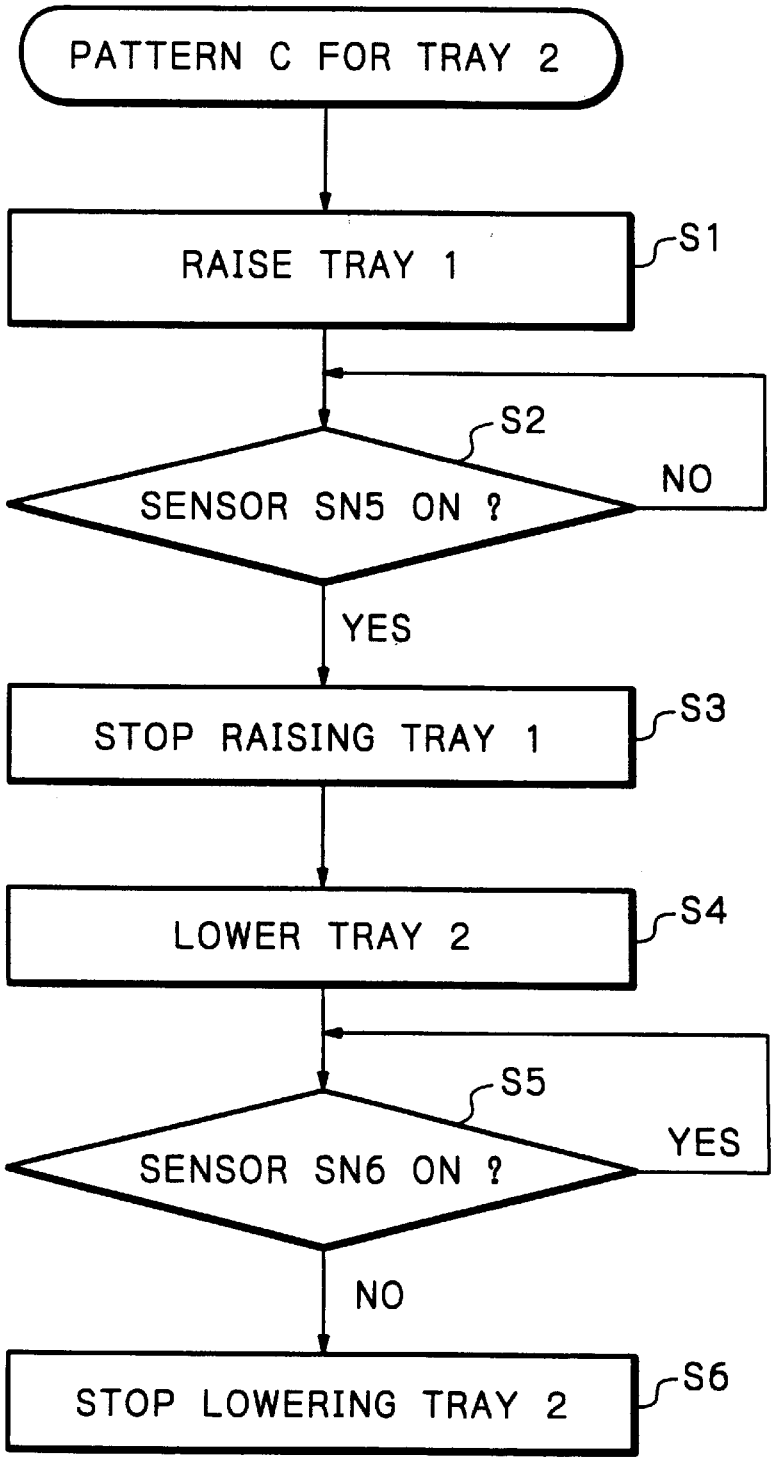
FIG. 37 is a flowchart showing another specific control procedure that the fourth embodiment executes when the lower tray is selected.

As shown in FIG. 37, as for the pattern C, the controller 100 first raises the tray 1 (step S1) and determines whether or not the sensor SN5 is in an ON state (step S2). If the answer of the step S2 is YES, the controller 100 stops the movement of the tray 1. Subsequently, the controller 100 lowers the tray 2 (step S4) and then stops the tray 2 (step S6) as soon as the sensor SN6 stops sensing it (NO, step S5).

Figure 38:
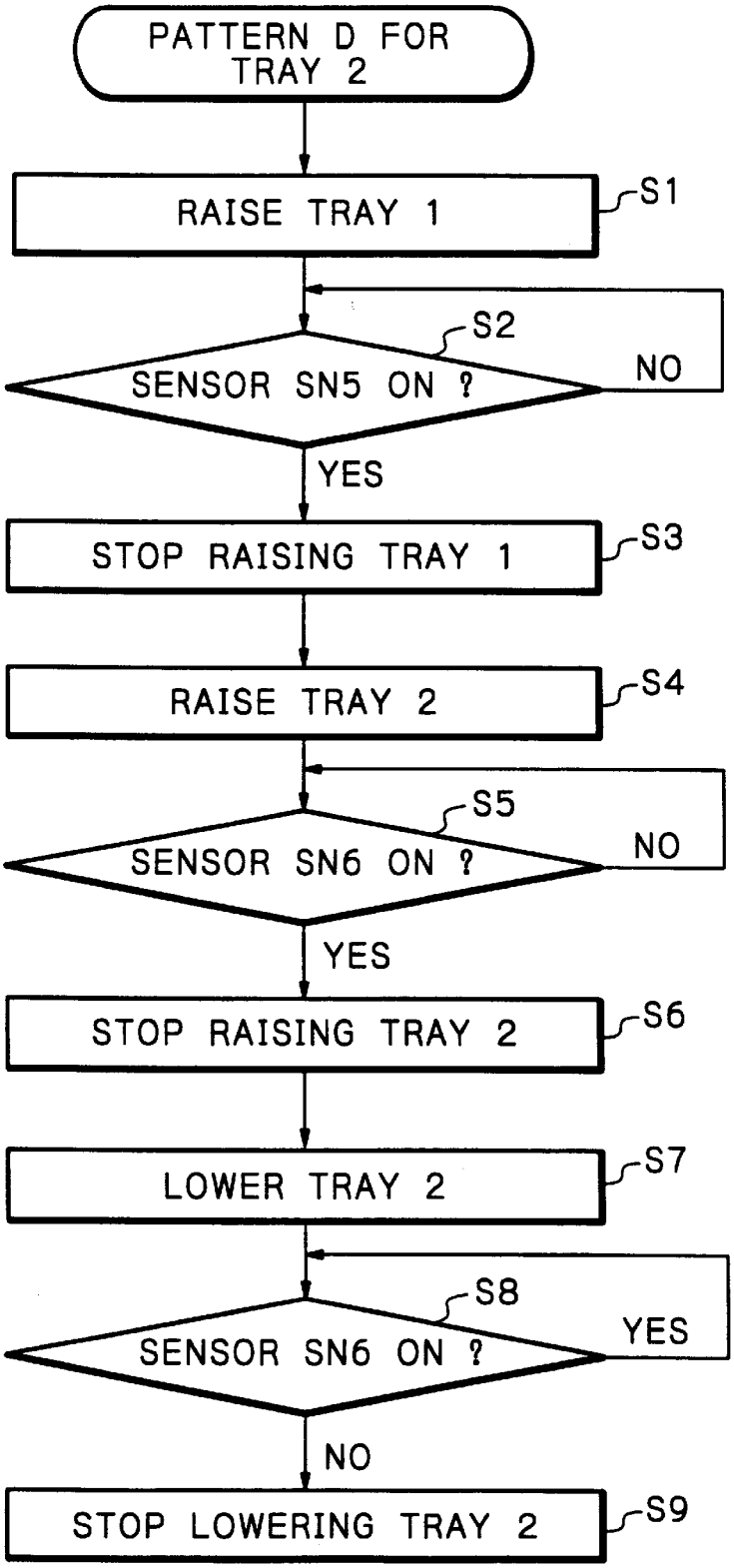
FIG. 38 is a flowchart showing another specific control procedure that the fourth embodiment executes when the lower tray is selected.

As shown in FIG. 38, as for the pattern D, the controller 100 first raises the tray 1 (step S1) and determines whether or not the sensor SN5 is in an ON state (step S2). If the answer of the step S2 is YES, the controller 100 stops the movement of the tray 1 (step S3). Subsequently, the controller 100 raises the tray 2 (step S4) and determines whether or not the sensor SN6 is in an ON state (step S5). If the answer of the step S5 is YES, the controller 100 stops the movement of the tray 2 (step S6). Thereafter, the controller 100 lowers the tray 2 and then stops the tray 2 (step S9) as soon as the sensor SN6 stops sensing it (NO, step S8).

Figure 39:
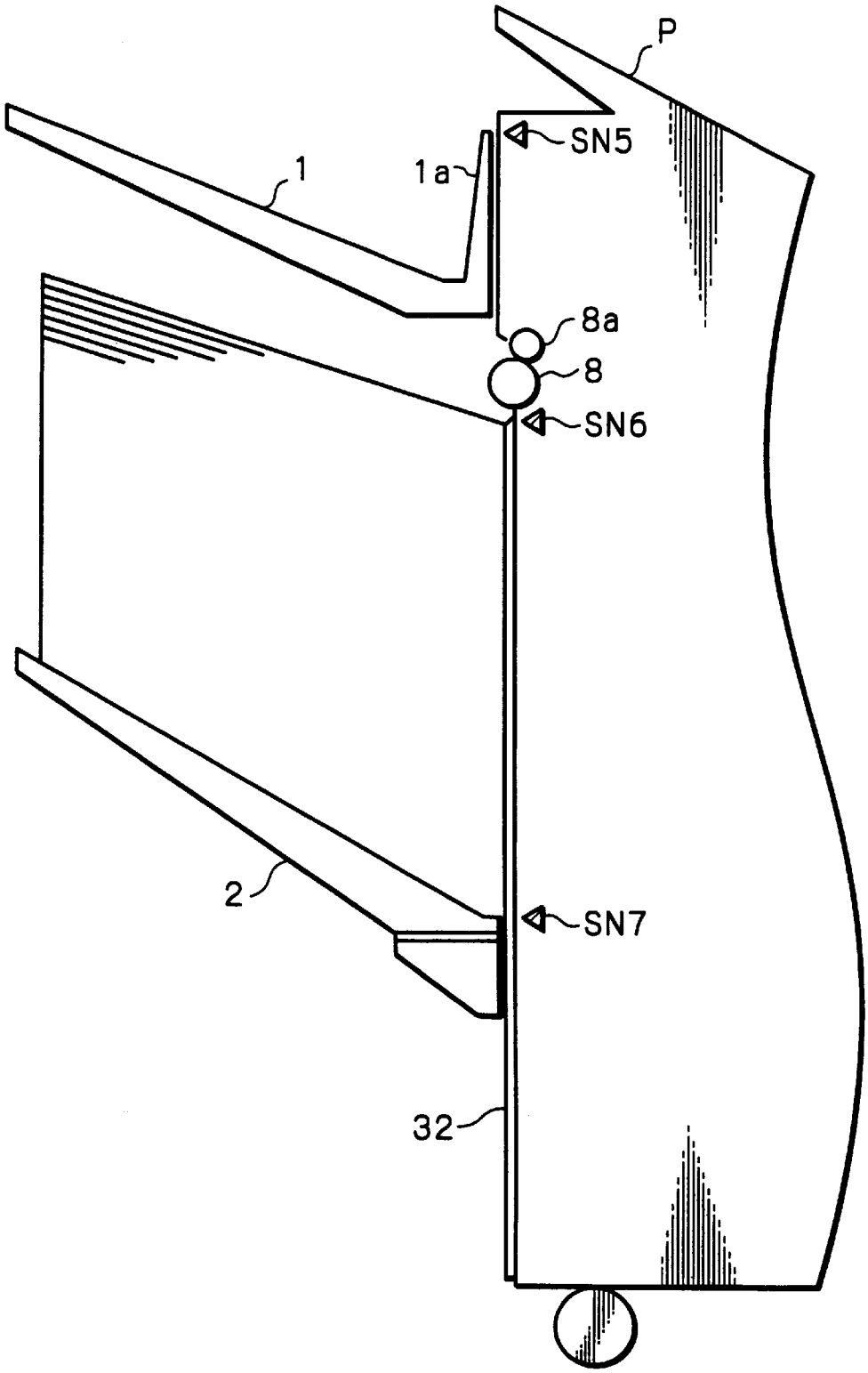
FIG. 39 is a side elevation showing a specific condition wherein the lower tray has reaches its full state.

As shown in FIG. 39, the sensor SN7 is positioned such that the tray 2 having been sensed by the sensor SN7 can further move downward by a preselected distance. Stated another way, a preselected distance is available between the bottom of the finisher and the sensor SN7 responsive to the lower limit position. FIG. 39 shows the tray 2 in its full state. Specifically, as a great number of papers are stacked on the tray 2, the tray 2 is sequentially lowered. When the sensors SN7 and SN6 sense the tray 2 and the top of the paper stack on the tray 2, respectively, the controller 100 determines that the tray 2 is full.

Figure 40:
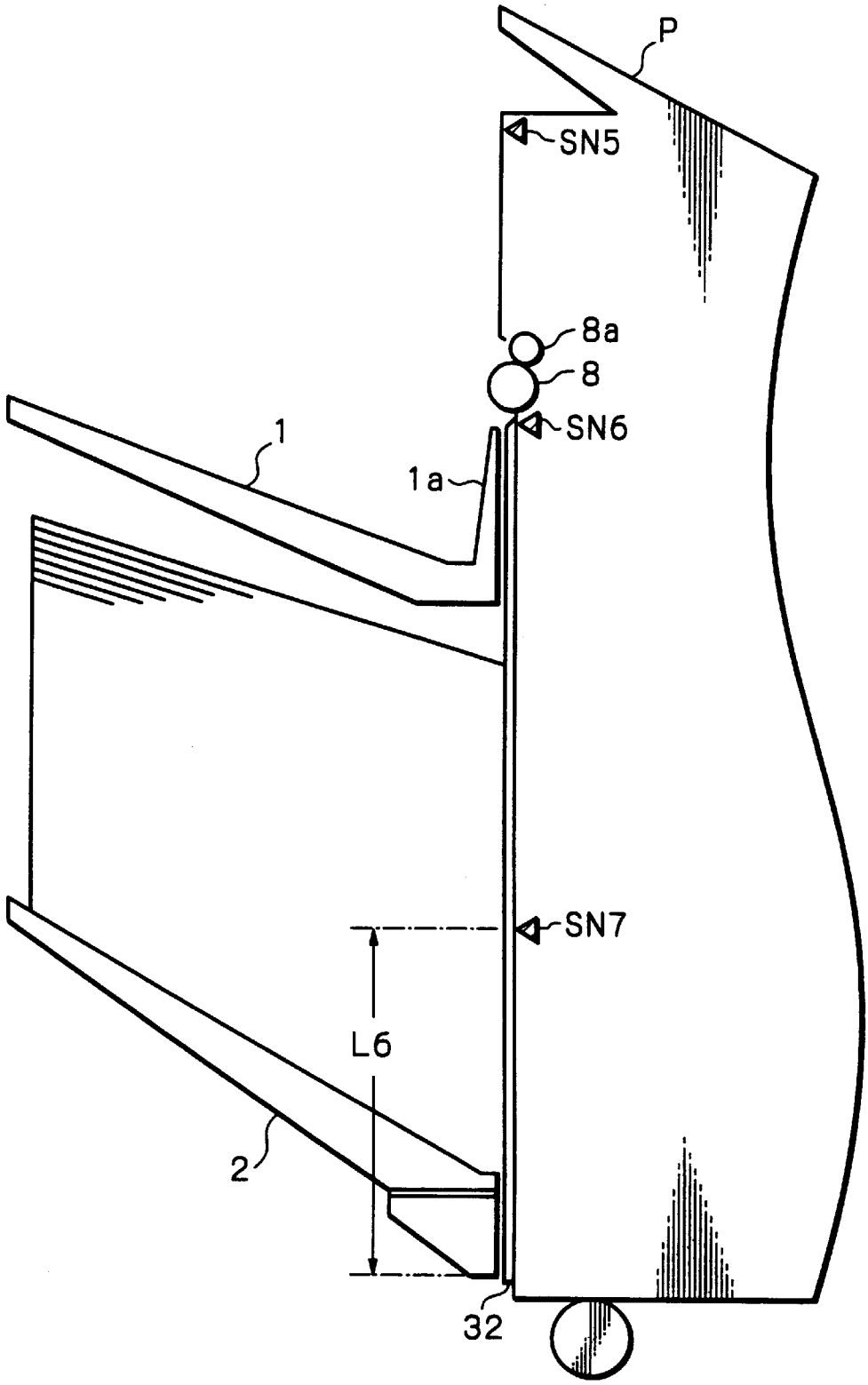
FIG. 40 is a side elevation showing another specific condition wherein the full lower tray is further lowered while the upper tray is located at the paper outlet.

When the tray 2 is full, the controller 100 lowers it to a position below the lower limit position by a preselected distance L6 (see FIG. 40). The distance L6 is selected to be greater than the distance (L3+L4), FIG. 33. Therefore, even when the tray 2 is left in its full state, the tray 1 can be located at the paper discharge position. The distance L6, like the distance (L3+L4), is determined in terms of the number of pulses for driving the motor 51.

As stated above, the above embodiment achieves the following advantages.

(1) The end fence of the tray movable via the outlet is capable of preventing papers stacked on the tray from returning to the outlet without complicating the configuration of the outlet. The papers do not contact the structural elements of the outlet and are therefore free from disturbance and contamination.

(2) The upper tray is movable outward in the paper discharge direction via the outlet. This allows the papers to be neatly positioned without complicating the configuration of the outlet.

(3) The retracted position of the lower tray can be determined without resorting to extra sensing means which would increase the cost of the finisher. Because the retracted position is located above the lower limit position and because the lower tray can be moved from the retracted position, a period of time necessary for the lower tray to move to the paper discharge position is reduced when the lower tray is selected.

(4) The preselected distance is such that the upper tray can move to the paper discharge position and a paper stack can be picked up from the lower tray. This not only guarantees easy removal of a paper stack, but also reduces the tray switching time (moving time).

(5) Even when the lower tray is full, it can be lowered to allow extra papers to be stacked.

(6) Even when the lower tray is held in its full state, the upper tray can be lowered to the paper discharge position. This promotes the effective use of a paper discharge space available at the side of the finisher.

Fifth Embodiment

This embodiment is directed mainly toward the fifth object stated earlier. This embodiment also differs from the previous embodiments in that the sensor SN9 responsive to the retracted position or home position of the tray 2 to absent and in that the controller 100 controls the trays 1 and 2 in a unique way. The fourth embodiment will be described with reference to FIGS. 41–50 in addition to FIGS. 1–8.

In the illustrative embodiment, the home position of the tray 1 is a position which the upper end of the end fence 1*a* reaches when raised by a preselected distance (amount) after being sensed by the sensor SN6. The home position of the tray 2 is a position where the tray 2 is sensed by the sensor SN7.

On the power-up of the copier G, the controller 100 determines whether or not the sensor SN7 responsive to the lower limit position is in an ON state. If the sensor SN7 is in an OFF state, the controller 100 lowers the tray 2 via the motor 51, determining that the tray 2 is positioned above the sensor SN7. As soon as the sensor SN7 senses the tray 2, the controller 100 stops lowering the tray 2. Subsequently, the controller 100 determines whether or not the sensor SN5 is in an ON state. If the sensor SN5 is in an OFF state, the controller 100 once raises the tray 1 via the motor 50 and then lowers the tray 1 as soon as the sensor SN5 senses it. When the sensor SN6 senses the upper and of the end fence 1*a,* the controller 100 raises the tray 1 by a preselected distance and then stops it. Further, if the sensor SN5 is in an ON state, the controller 100 lowers the tray 1, then raises it by the preselected distance when the sensor SN6 senses the tray 1, and then stops the tray 1.

Figure 41:
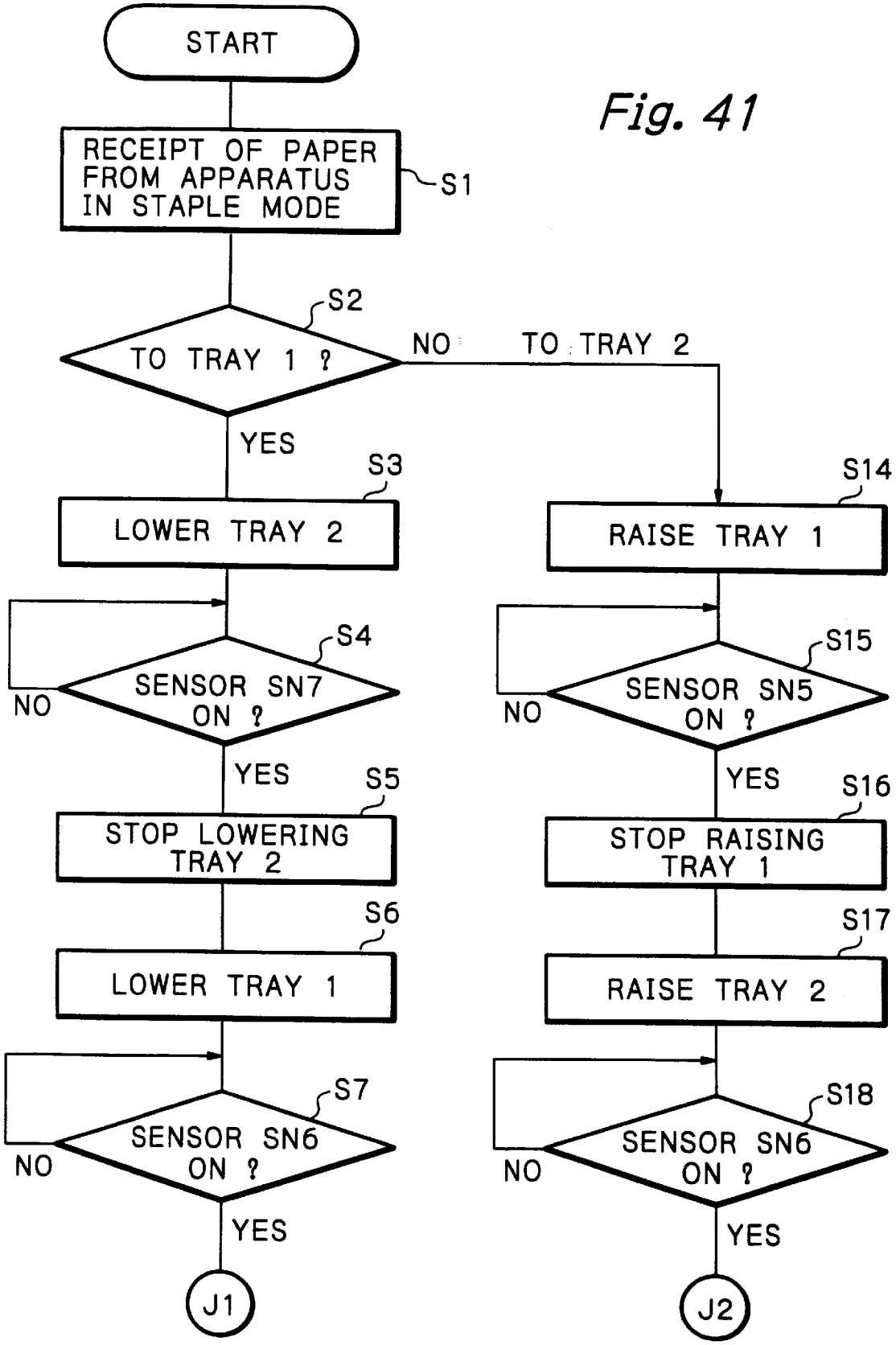
FIGS. 41 and 42 are flowcharts showing a specific procedure which a fifth embodiment of the present invention executes for moving the trays during finish processing.
Figure 42:
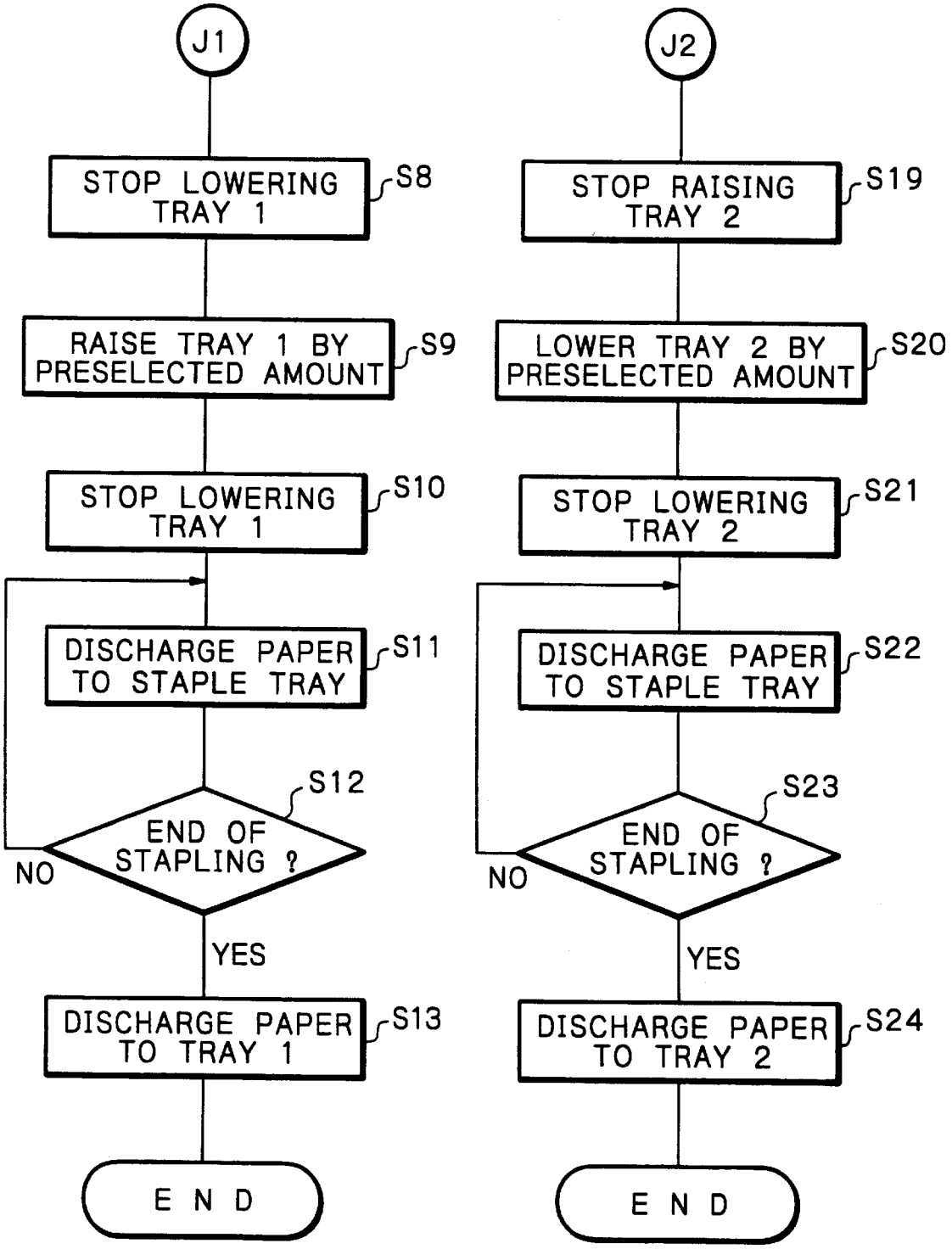

A first tray control procedure available with the illustrative embodiment will be described with reference to FIGS. 41 and 42. As shown, the discharge of papers from the copier a begins in the staple mode input on the copier G or the computer connected thereto (step S1), the controller 100 determines whether or not the tray 1 is selected by the operator (step S2). At the same time, the controller 100 determines whether or not the sensor SN7 is in an ON state. If the sensor SN7 is in an OFF state, the controller 100 lowers the tray 2 (step S3), determining that the tray 2 is positioned above the sensor SN7. The controller 100 again determines whether or not the sensor SN7 is in an ON state (step S4) and then stops the movement of the tray 2 (step S5). Thereafter, the controller 100 lowers the tray 1 (step S6) and determines whether or not the sensor SN6 is in an ON state (step S7). If the answer of the step S7 is YES, the controller 100 stops the movement of the tray 1 (step S8). Then, the controller 100 raises the tray 1 by a preselected distance (amount) (step S9) and then stops it (step S10). As a result, the tray 1 is located at the paper discharge position.

When a paper is discharged to the staple tray of the finisher, the controller 100 determines whether or not stapling has ended (step S12). If the answer of the step S12 is YES, the controller 100 causes a stapled paper stack to be driven out to the tray 1 (step S13).

Assume that the tray 2 is selected via the copier G or the computer connected thereto. Then, the controller 100 first determines whether or not the sensor SN5 responsive to the retracted position is in an ON state. If the sensor SN5 is in an OFF state, the controller 100 raises the tray 1 (step S14) and again checks the sensor SR5 (step S15). When the sensor SN5 turns on (YES, step S15), the control for 100 stops the movement of the tray 1 (step S16), then raises the tray 2 (step S17), and then determines whether or not the sensor SN6 is in an ON state (step S18). If the answer of the step S18 is YES, the controlled 100 once stops the movement of the tray 2 then lowers the tray 2 by a preselected distance (amount) (step S20), and then stops it (step S21). As a result, the tray 2 is located at the paper discharge position.

When a paper is discharged to the staple tray of the finisher (S22), the controller 100 determines whether or not stapling has ended (step S23). If the answer of the step S23 is YES, the controller 100 causes a stapled paper stack to be driven out to the tray 2 (step S24).

The tray 1 or 2 is located at the outlet E2 beforehand in response to information received from the copier G or the computer connected thereto. This successfully reduces a period of time relating to the movement of the tray 1 or 2. Stated another way, the trays 1 and 2 are not moved relative to the outlet E2 independently of each other, but are moved in parallel by staple processing within a necessary period of time. The finisher can therefore complete its operation in a shorter period of time than the conventional finishers.

After the tray 1 or 2 has been located at the outlet E2, papers are sequentially stacked on the tray 1 or 2. When the sensor SN6 senses the top of a paper stack on the tray 1 or 2 held at the outlet E2, the tray 1 or 2 is lowered by a preselected distance. Such a procedure is repeated to allow a great number of papers to be stacked on the tray 1 or 2. This is also true with the other embodiments to be described later.

In the non-staple mode, the operator is allowed to select desired one of the proof tray P, upper tray 1 end lower tray 2; the trays 1 and 2 each are capable of accommodating a great number of papers. The proof tray P, upper tray 1 and lower tray 2 may be respectively assigned to a facsimile apparatus, a copier or a printer, and a printer or a copier, as desired. The finisher is therefore adaptive to a multifunction image forming apparatus.

A second tray control procedure available with the illustrative embodiment will be described with reference to FIGS. 43–46. The procedure to be described prevents the trays 1 and 2 from interfering with each other when moved independently of each other.

Figure 43:
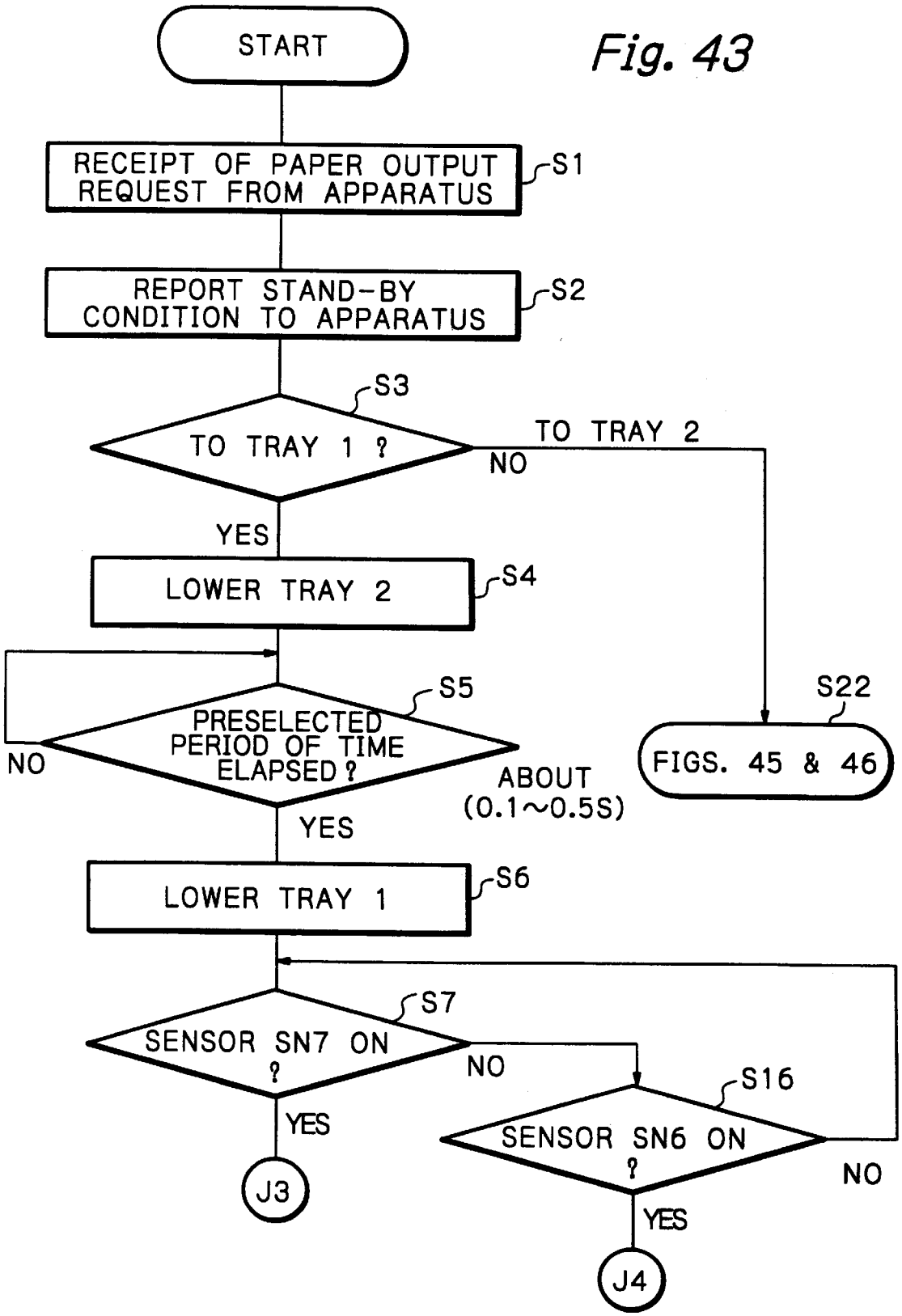
FIGS. 43 and 44 are flowcharts showing another specific procedure which the fifth embodiment executes for moving each of the trays at a particular timing.
Figure 44:
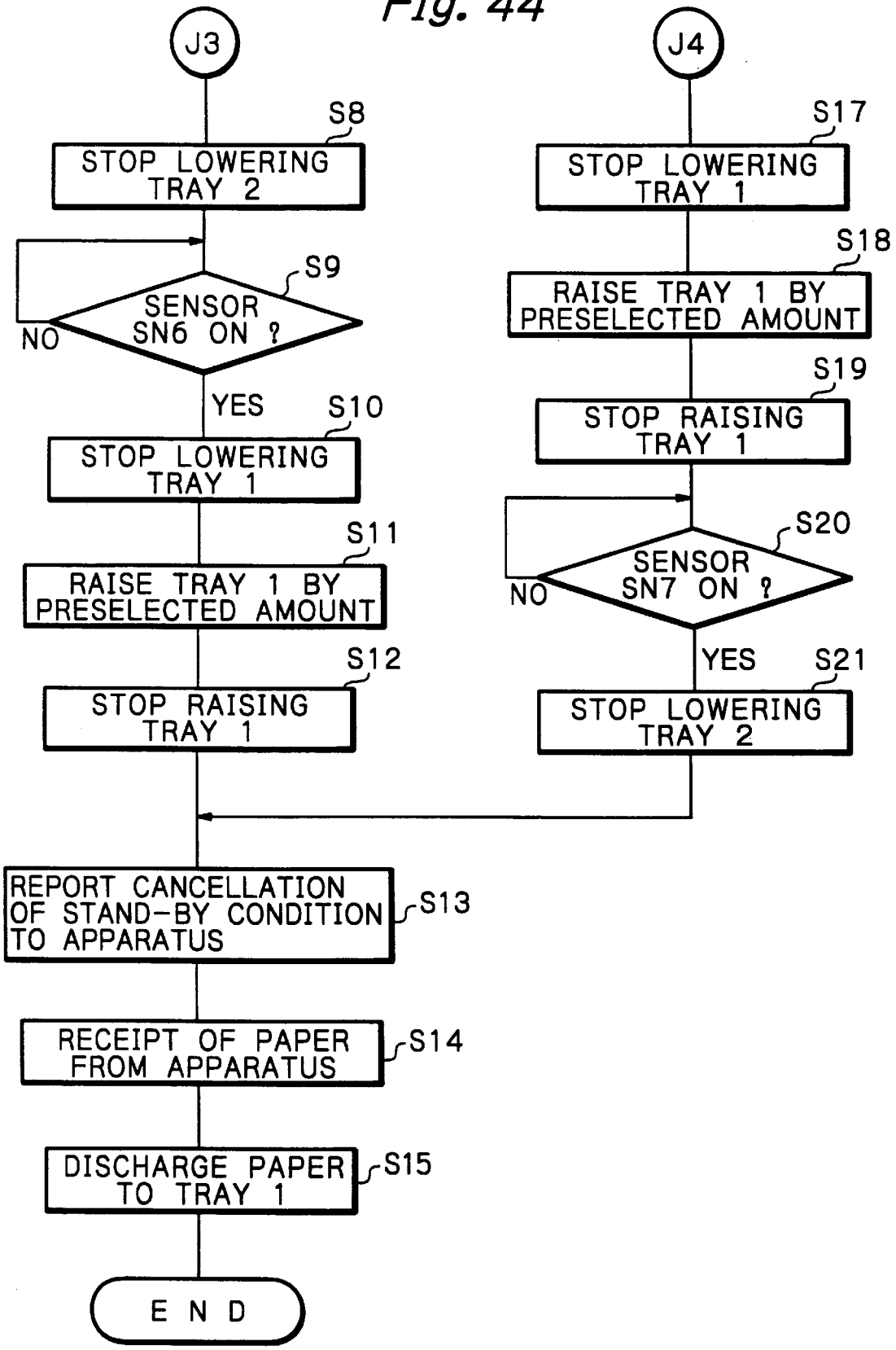

As shown in FIGS. 43 and 44, when the controller 100 receives a paper output request from the copier G or the computer connected thereto (step S1), it sends an answer representative of a stand-by state to the copier G or the computer (step S2). The controller 100 determines whether or not the tray 1 is selected (step S3) and determines whether or not the sensor SN7 is in an ON state. If the sensor SW7 is in an OFF state, the controller 100 determines that the tray 2 is positioned above the sensor SN7, and lowers the tray 2 which would obstruct the positioning of the tray 1 at the outlet E2 (step S4). Then, on the elapse of a preselected period of time (about 0.1 second to 0.5 second in the illustrative embodiment), the controller 100 lowers the tray 1 (step S6). As soon as the sensor SN7 turns on (YES, step S7), the controller 100 stops the movement of the tray 2.

Subsequently, the controller 100 determines whether or not the sensor SN6 is in an ON state (step S9). When the sensor SN6 turns on (YES, step S9), the controller 100 once stops the movement of the tray 1 (step S10), then raises the tray 1 by a preselected distance (amount) (step S11), and then stops it (step S12). The tray 1 is now ready to receive papers via the outlet E2. Thereafter, the controller 100 sends a signal representative of the cancellation of the stand-by state to the copier G or the computer (step S13). In response, a paper is transferred from the copier G to the finisher (step S14) and therefrom to the tray 1 (step S15).

If the answer of the step S7 is NO, meaning that the sensor SN7 is in an OFF state, the controller 100 determines whether or not the sensor SN6 is in an ON state (step S16). When the sensor SN6 turns on (YES, step S16), the controller once stops the movement of the tray 1 (step S17), then raises the tray 1 by a preselected distance (amount) (step S18), and then stops it (step S19). As a result, the tray 1 brought to the outlet E2. Further, the controller 100 determines whether or not the sensor SN7 is in an ON state (step S20). If the answer of the step S20 is YES, the controller stops the movement of the tray 2 (step S21). This is followed by the step S13.

Figure 45:
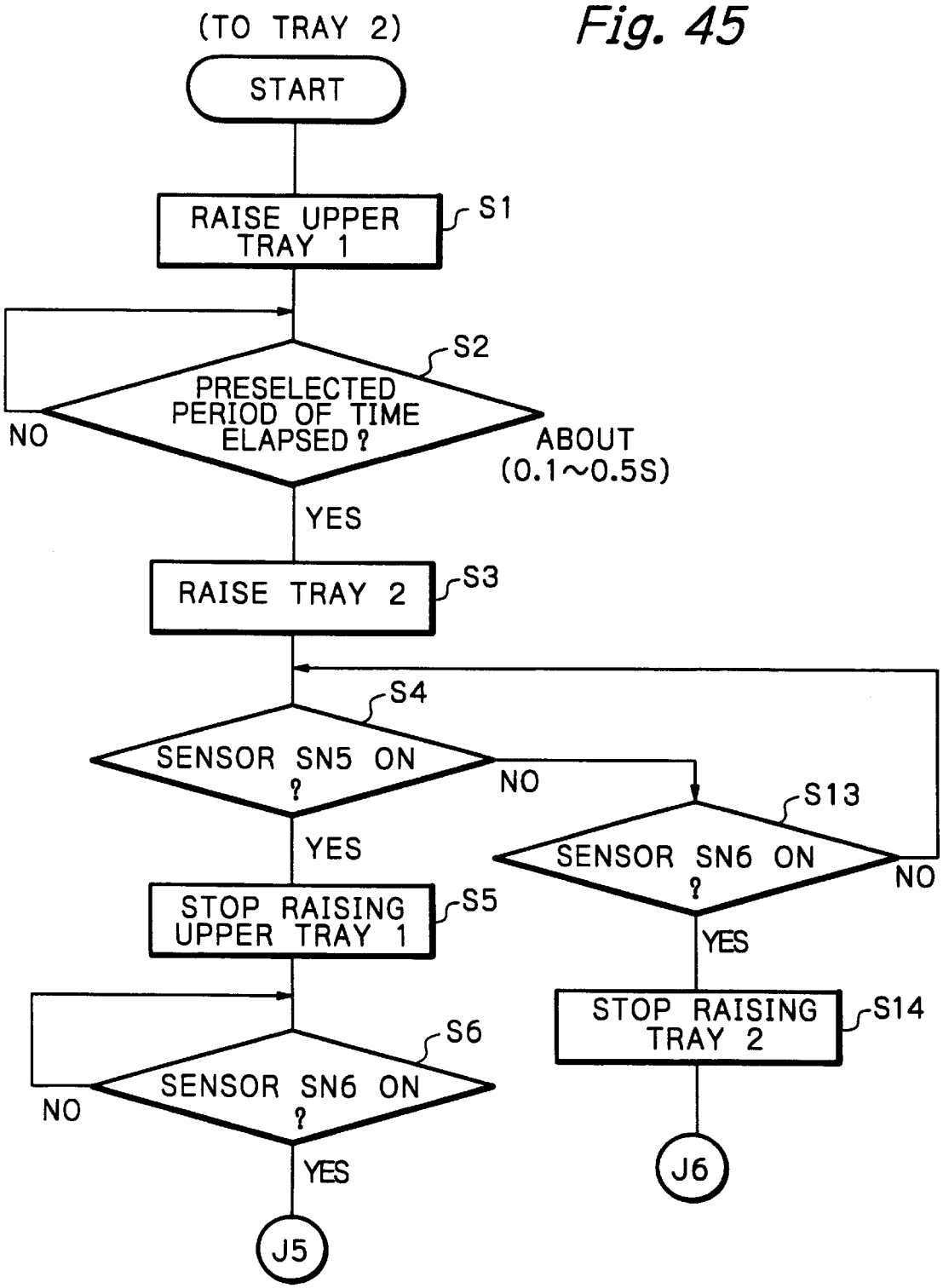
FIGS. 45 and 46 are flowcharts showing another specific procedure which the fifth embodiment executes for moving each of the trays at a particular timing.
Figure 46:
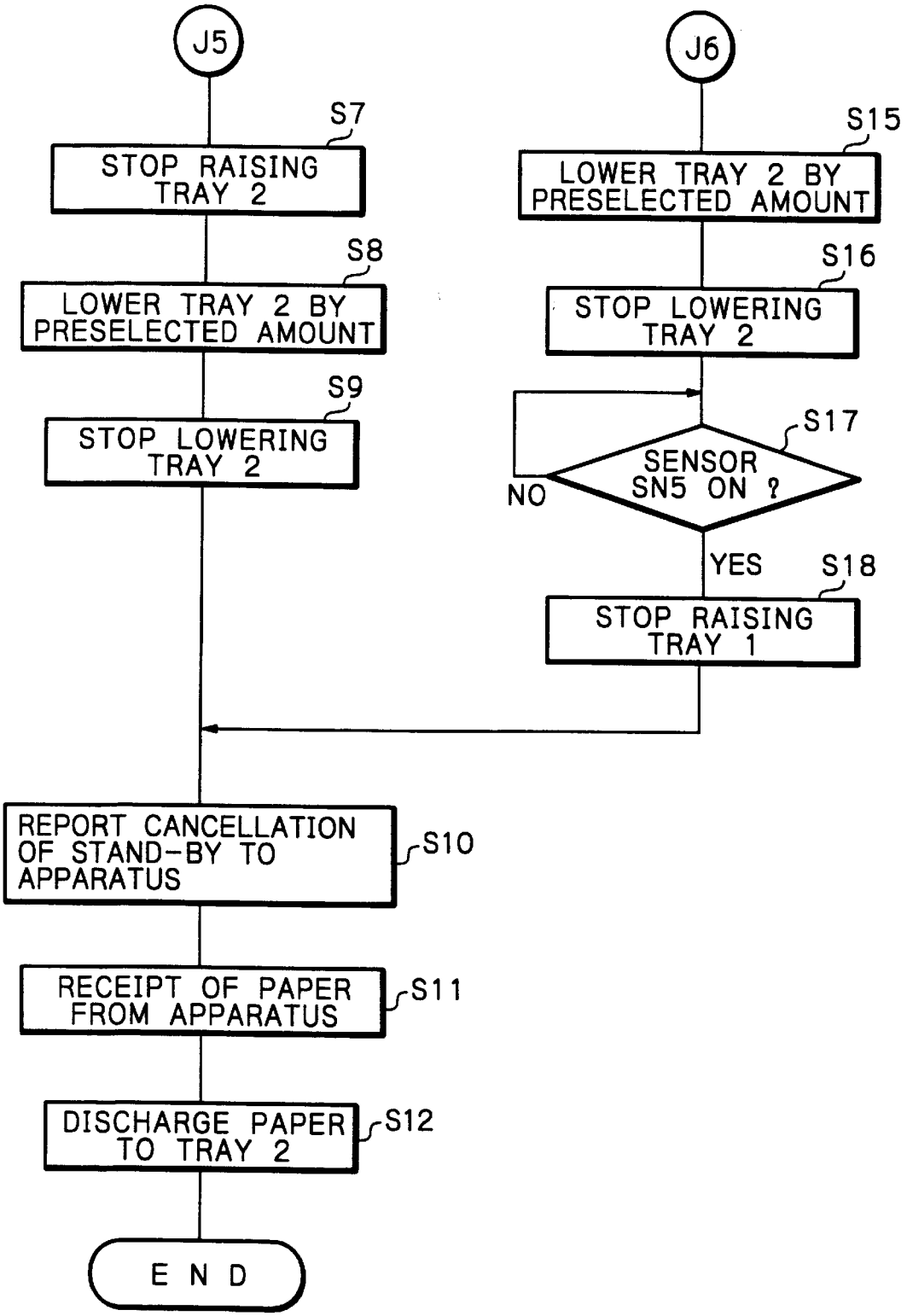

Assume that the tray 2 is selected. Then, as shown in FIGS. 45 and 46, the controller 100 determines whether or not the sensor SN5 is in an ON state. If the sensor SN5 is in an OFF state, the controller 100 raises the tray 1 which would obstruct the positioning of the tray 2 at the outlet E2 (step S1). Then, on the elapse of a preselected period of time (about 0.1 second to 0.5 second in the illustrative embodiment) (step S2), the controller 100 raises the tray 2 (step S3). As soon as the sensor S57 turns on (YES, step S4), the controller 100 stops the movement of the tray 1 (step S5).

Subsequently, the controller 100 determines whether or not the sensor SN6 is in an ON state (step S6). When the sensor SN6 turns on (YES, step S6), the controller 100 once stops the movement of the tray 2 (step S7), then lowers the tray 2 by a preselected distance (amount) (step S8), and then stops it (step S9). The tray 2 is now reedy to receive papers via the outlet E2. Thereafter, the controller 100 sends a signal representative of the cancellation of the stand-by state to the copier G or the computer (step S10). In response, a paper is transferred from the copier G to the finisher (step 11) and therefrom to the tray 2 (step 12).

If the answer of the step S4 is NO, meaning that the sensor SN5 is in an OFF state, the controller 100 determines whether or not the sensor SN6 is in an ON state (step S13). When the sensor SN6 turns on (YES, step S13), the controller once stops the movement of the tray 2 (step S14), then lowers the tray 2 by a preselected distance (amount) (step S15), and then stops it (step S16). Thereafter, the controller determined whether or not the sensor SN5 is in an ON state (step S17). If the answer of the step S17 is YES, the controller 100 stops the movement of the tray 1 (step S18). As a result, the tray 2 brought to the outlet E2. This is followed by the step S10.

A third tray control procedure available with the illustrative embodiment will be described with reference to FIGS, 47–50. Should the trays 1 and 2 each be moved at a particularly timing in order to avoid collision, the total period of time necessary for the movement of the trays 1 and 2 would be increased. This embodiment is capable of solving this problem.

Figures 47, 49, 50:
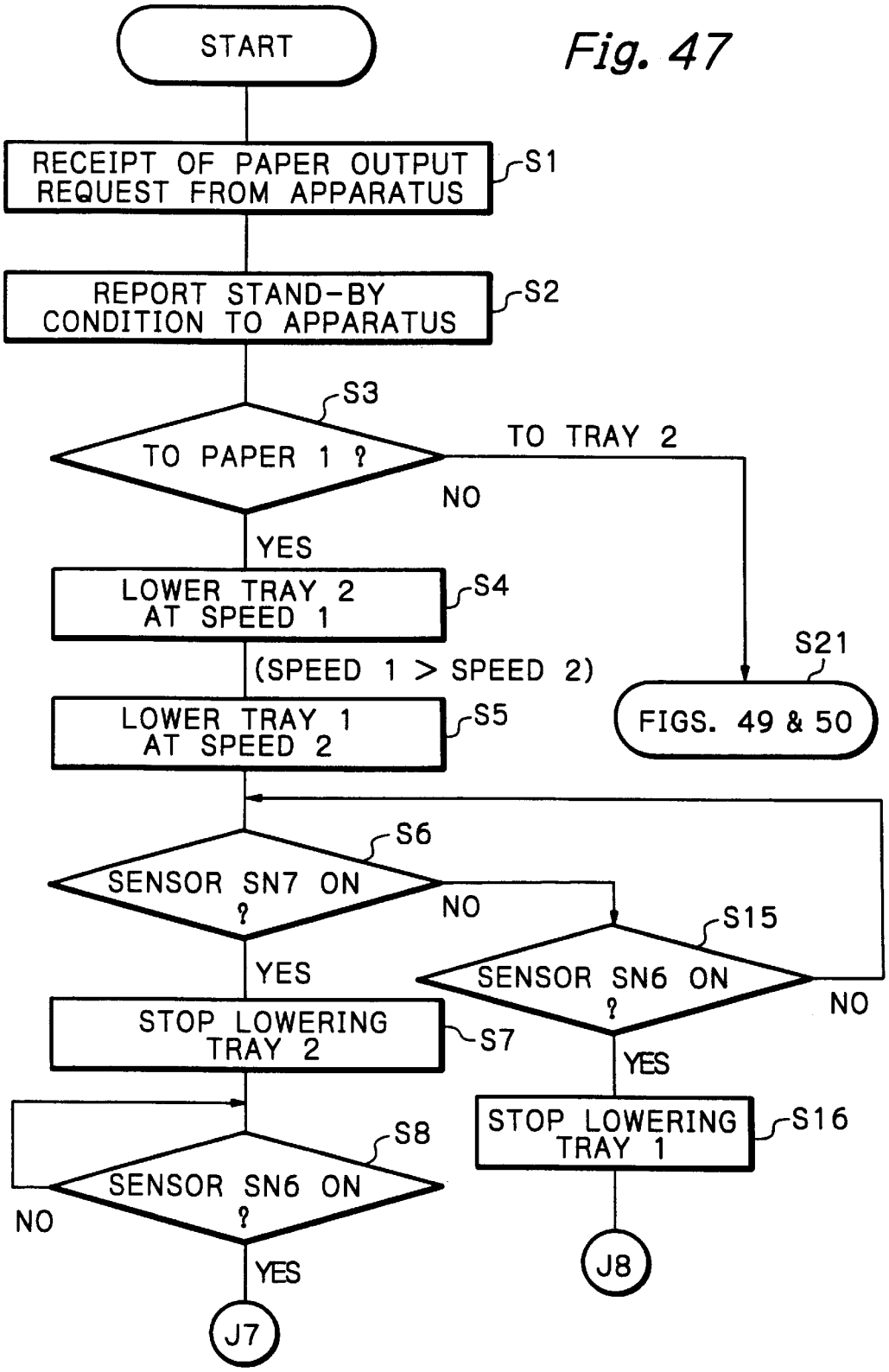
FIGS. 47 and 48 are flowcharts showing another specific procedure which the fifth embodiment executes for moving each of the trays at a particular timing.
FIGS. 49 and 50 are flowcharts showing another specific procedure which the fifth embodiment executes for moving each of the trays at a particular timing.
Figure 48:
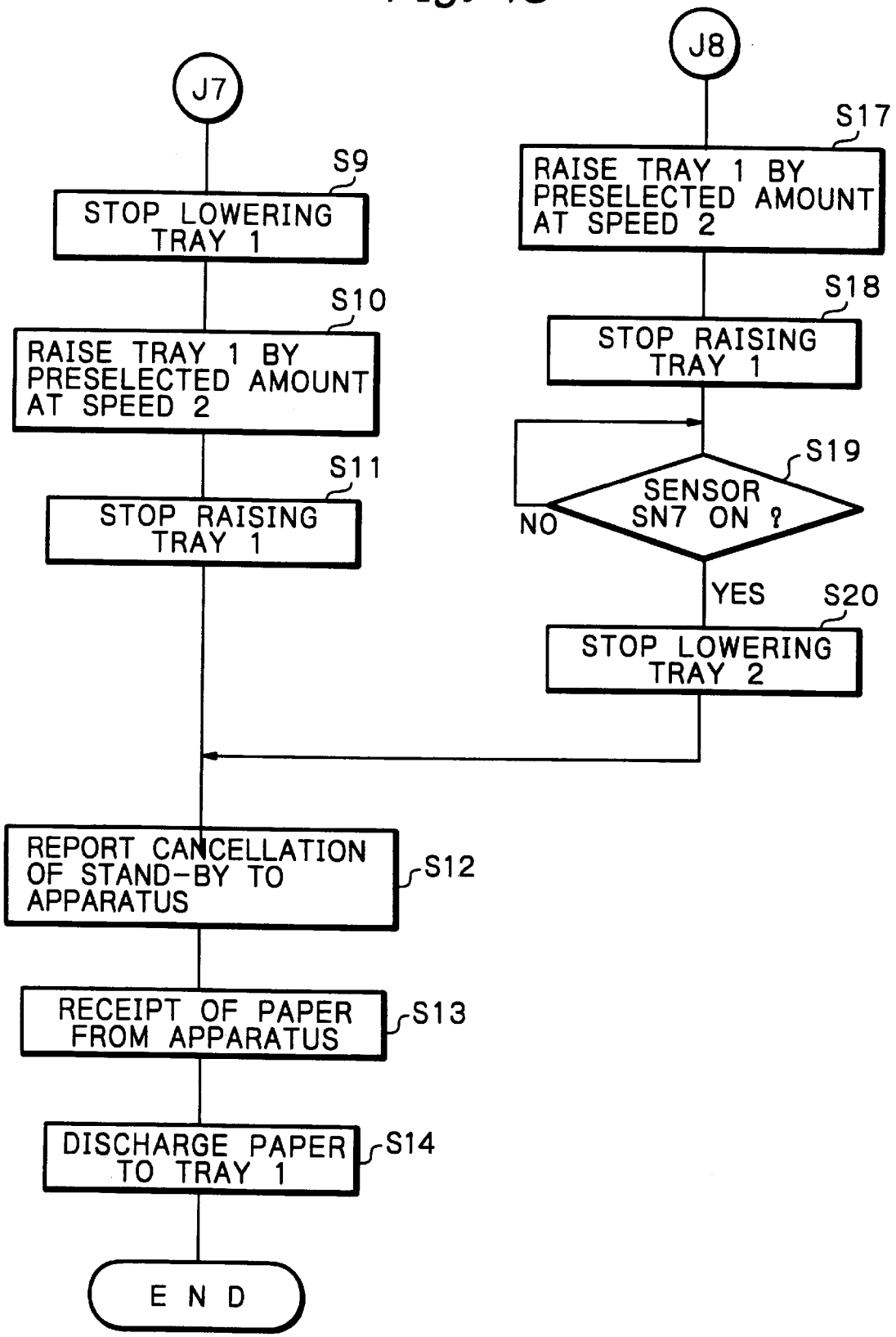
Figure 49:
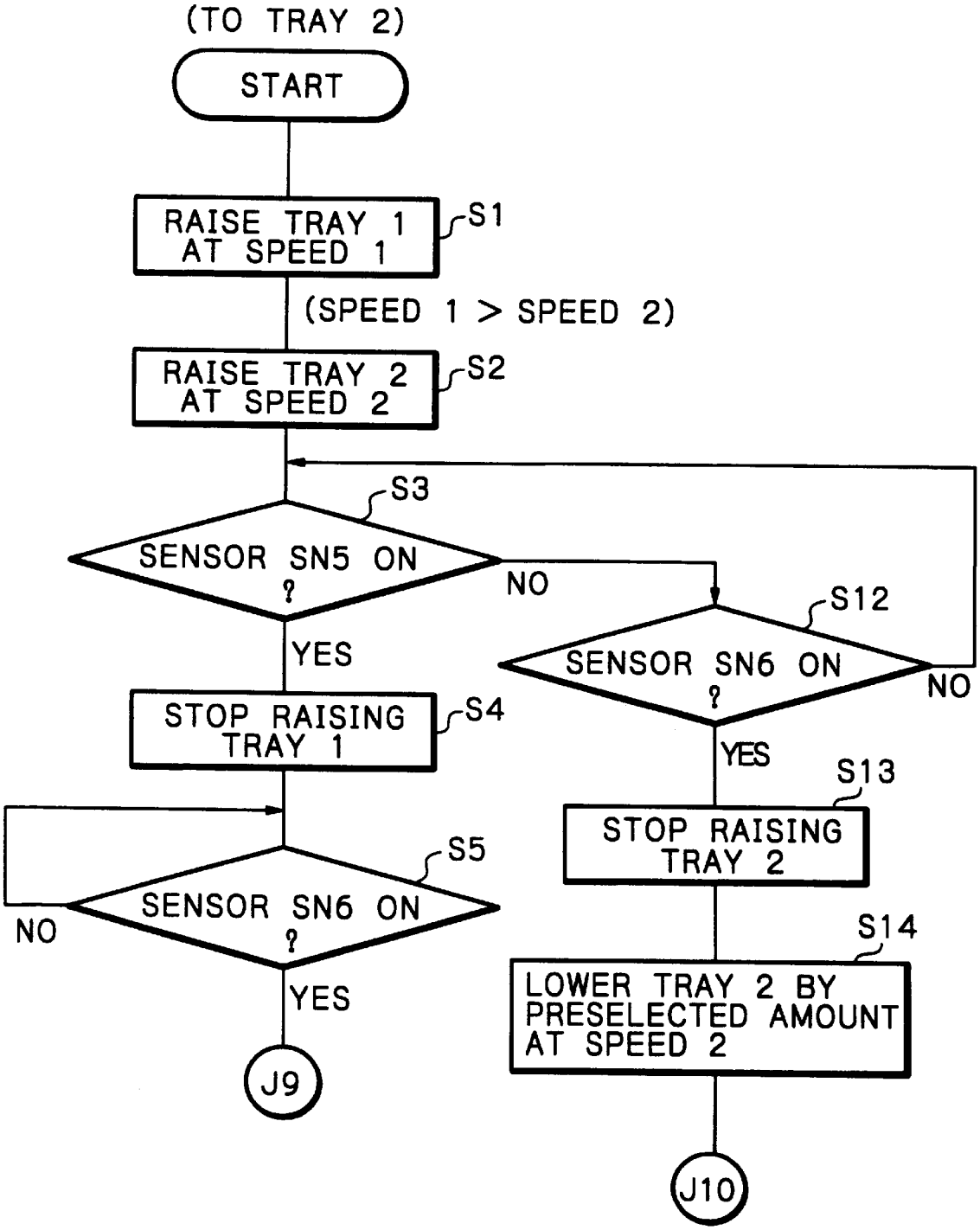
Figure 50:
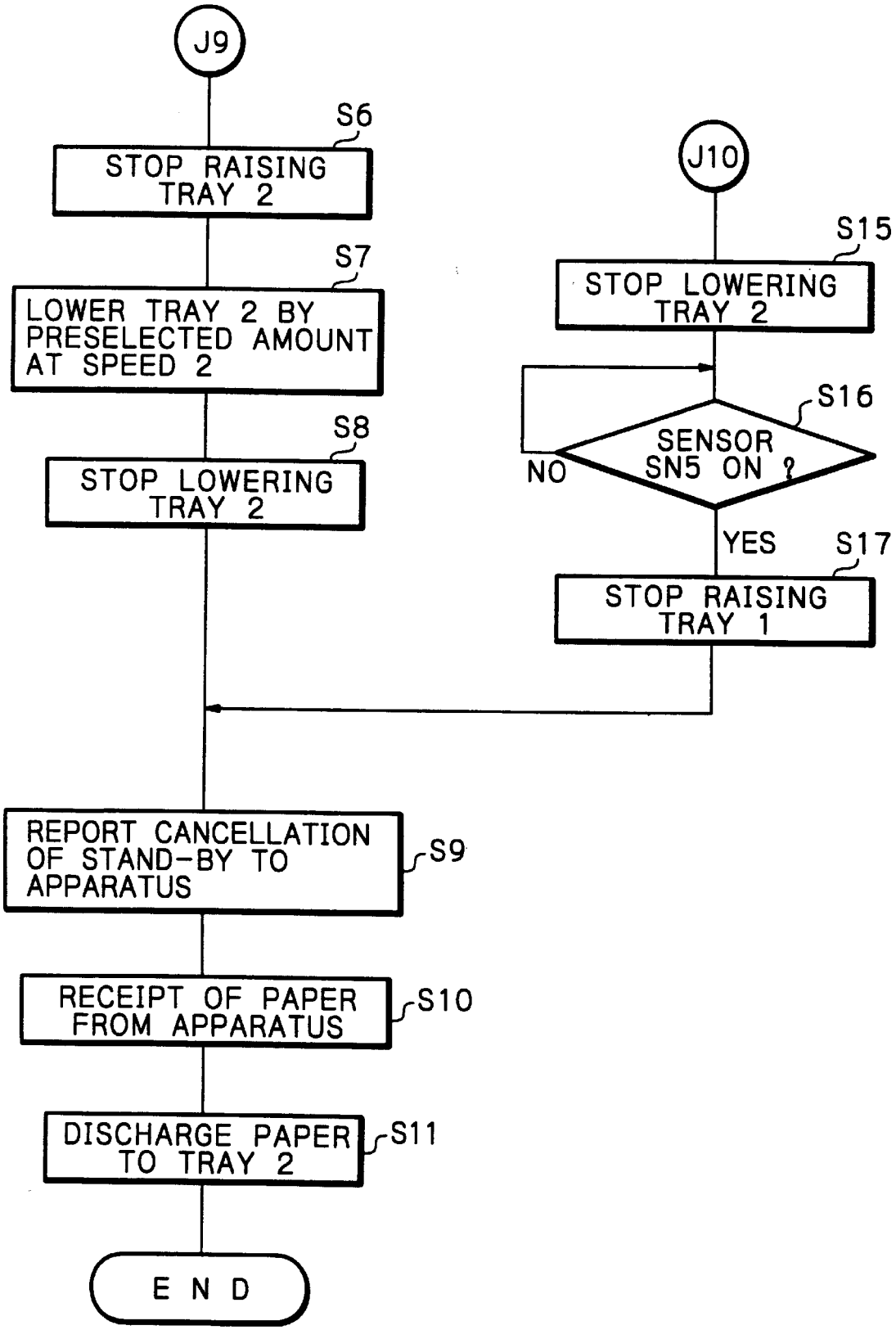

As shown in FIGS. 47 and 48, when the controller 100 receives a paper output request from the copier G or the computer connected thereto (step S1, it sends an answer representative of a stand-by state to the copier G or the computer (step S2). The controller 100 determines whether or not the tray 1 is selected (step S3) and determines whether or not the sensor SN7 is in an ON state. If the answer of the step S3 is YES and if the sensor SN7 is in an OFF state, the controller 100 determines that the tray 2 is positioned above the sensor SN7, and lowers the tray 2 at a first speed 1 (step S4). At the same time, the controller 100 lowers the tray 1 at a second speed 2 (step S5). The speed 1 is selected to be higher than the speed 2, i.e., the tray to be retracted is moved at a higher speed than the tray to be brought to the outlet E2. This is done by controlling the motors 50 and 51 that are implemented by stepping motors.

Subsequently, the controller determines whether or not the sensor SN7 is in an ON state (step S8), and stops the movement of the tray 2 as soon as the sensor SN7 turns an (step S7).

Subsequently, the controller 100 determines whether or not the sensor SN6 is in an ON state (step S8). When the sensor SN6 turns on (YES, step S6), the controller 100 once stops the movement of the tray 1 (step S9), then raises the tray 1 by a preselected distance (amount) at the speed 2 (step S10), and then stops it (step S11). The tray 1 is now ready to receive papers via the outlet E2. Thereafter, the controller 100 sends a signal representative of the cancellation of the stand-by state to the copier G or the computer (step S12). In response, a paper is transferred from the copier G to the finisher (step S13) and therefrom to the tray 1 (step S14)

If the answer of the step S6 is NO, meaning that the sensor SN7 is in an OFF state, the controller 100 determines whether or not the sensor SN6 is in an ON state (step S15). When the sensor SN6 turns on (YES, step S15), the controller once stops the movement of the tray 1 (step S16), then raises the tray 1 at the speed 2 by a preselected distance (amount) (step S17), and then stops it (step S18). Further, the controller 100 determines whether or not the sensor SN7 is in an ON state (step S19). If the answer of the step S19 is YES, the controller stops the movement of the tray 2 (step S20). This is followed by the step S12.

Assume that the tray 2 is selected. Then, as shown in FIGS. 49 and 50, the controller 100 determines whether or not the sensor SN5 is in an ON state. If the sensor SN5 is in an OFF state, the controller 100 raises the tray 1 at the speed 1 (step S1) while raising the tray 2 at the speed 2 (step S2). Then, the controller 100 determines whether or not the sensor SN5 is in an ON state (step S3), and stops the movement of the tray 1 when the sensor SN5 turns on (YES, step S5).

Subsequently, the controller 100 determines whether or not the sensor SN6 is in an ON state (step S5). When the sensor SN6 turns on (YES, step S6), the controller 100 once stops the movement of the tray 2 (step S6), then lowers the tray 2 at the speed 2 by a preselected distance (amount) (step S7), and then stops it (step S8). The tray 2 is now ready to receive papers via the outlet E2. Thereafter, the controller 100 sends a signal representative of the cancellation of the stand-by state to the copier G or the computer (step S9). In response, a paper is transferred from the copier G to the finisher (step 10) and therefrom to the tray 2 (step 11).

If the answer of the step S3 is NO, meaning that the sensor SN5 is in an OFF state, the controller 100 determines whether or not the sensor SN6 is in an ON state (step S12). When the sensor SN6 turns on (YES, step S12), the controller once stops the movement of the tray 2 (step S13), then lowers the tray 2 at the speed 2 by a preselected distance (amount) (step S14), and then stops it (step S15). Thereafter, the controller determined whether or not the sensor SN5 is in an ON state (step S16). If the answer of the step S16 is YES, the controller 100 stops the movement of the tray 1 (step S17). As a result, the tray 2 brought to the outlet E2. This is followed by the step S9.

As stated above, the fifth embodiment achieves the following advantages, (1) A tray selected is brought to the outlet during finish processing. This reduces a period of time relating to the movement of the trays and therefore the entire finishing time.

(2) A plurality of trays each are brought to the outlet independently of each other. This implements a mass paper discharge function with a single outlet.

(3) The tray that would obstruct the tray selected is retracted first. The trays are therefore prevented from colliding with each other.

(4) The tray to be retracted is moved at a higher speed than the tray to be located at the outlet. This, coupled with the fact that the two trays start moving at the same time, obviates a wasteful time otherwise required to prevent the trays from colliding with each other.

Sixth Embodiment

This embodiment is directed toward the sixth object stated earlier. The operation of the control means 100 unique to this embodiment will be described with reference to FIGS. 51–53 in addition to FIGS. 1–8.

Referring again to FIG. 1, the controller 100, i.e., CPU 102 of the illustrative embodiment sets up any one of the following four different paper conveyance modes:

(1) conveyance along a first route A1 (corresponding to the non-staple route B)

(2) conveyance along a second route A2 (corresponding to the staple route A)

(3) conveyance along a third route A3

(4) paper discharge to either one of first and second trays selected

In the conveyance mode (1), when the sensor S1 senses a paper, the path selectors 20 and 21 are switched to steer the paper to the outlet E2.

In the conveyance mode (2), when the sensor SN1 senses a paper, the path selector 21 is switched to steer the paper to the second route A2. The roller 6, brush roller 6*a* and tap roller 9 are caused to operate. As soon as the sensor SN3 senses a number of papers expected to be stapled together, the jogger fence 11 positions the edges of the papers, and then the stapler S staples the papers. Subsequently, the belt 10*a* with the catch 10 is driven to convey the stapled paper stack to the outlet E2.

In the conveyance mode (4), one of the first and second trays is selected on the basis of a command received from, e.g., the computer connected to the copier G. The tray selected is brought to the outlet E2. Specifically, in response to the above command, the CPU 102 determines the current positions of the trays 1 and 2, returns the trays 1 and 2 to their home positions, and then locates the tray selected at the outlet E2.

Figure 51:
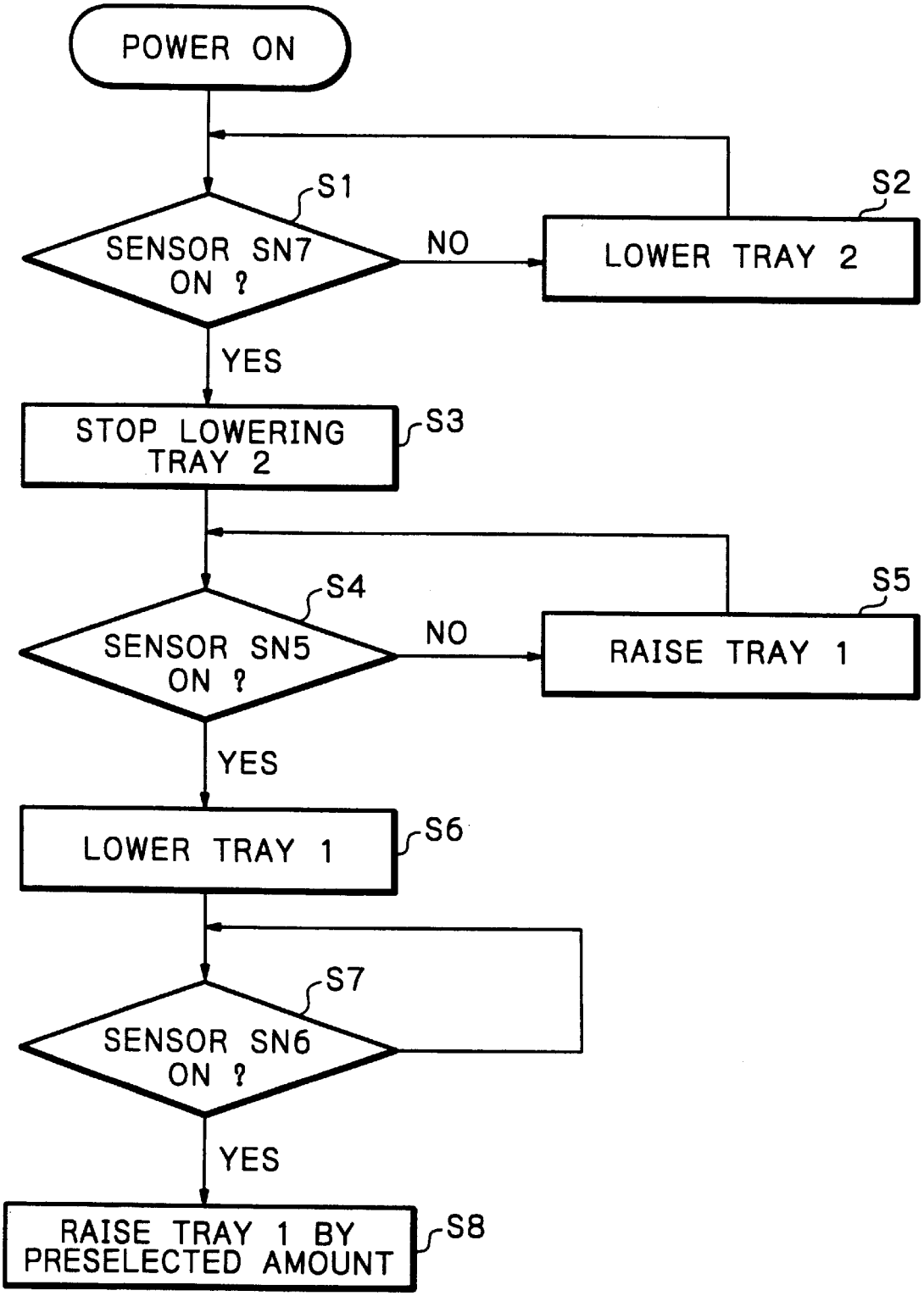
FIG. 51 is a flowchart showing initialization representative of a sixth embodiment of the present invention.

As shown in FIG. 51, on the power-up of the copier G, the controller 100 moves each of the trays 1 and 2 to the respective home position. The home position of the tray 1 is a position that the end fence 1*a* reaches when raised by a preselected distance after being sensed by the sensor SN5. The home position of the tray 2 is a position where the sensor SN7 senses the tray 2.

In FIG. 51, on the power-up of the copier G, the controller 100 determines whether or not the sensor SN7 is in an ON state, i.e., whether or not it has sensed the tray 2 (step S1). If the answer of the step S1 is NO, the controller 100 lowers the tray 2 via the motor 51 (step S2), determining that the tray 2 is located above the sensor SN7. The controller 100 turns off the motor 51 as soon as the sensor SN7 senses the tray 2, thereby stopping the movement of the tray 2 (step S3). As a result, the tray 2 is brought to its home position.

Subsequently, the controller 100 determines whether or not the sensor SN5 responsive to the tray 1 is in an ON state (step S4). If the answer of the step S4 is NO, the controller 100 raises the tray 1 via the motor 50 (step S5). As soon as the sensor SN5 senses the tray 1 (YES, step S4), the controller 100 stops the movement of the tray 1 and then lowers it (step S6). When the sensor SN6 senses the tray 1 being lowered (YES, step S7), the controller 100 stops the movement of the tray 1, then raises the tray 1 by a preselected distance, and then stops it (step S8). As a result, the tray 1 is located at its home position and ready to stack papers thereon. In this manner, in the conveyance modes (1) and (2), the tray 1 serves as a main tray for stacking papers sequentially driven out of the copier G.

Figure 52:
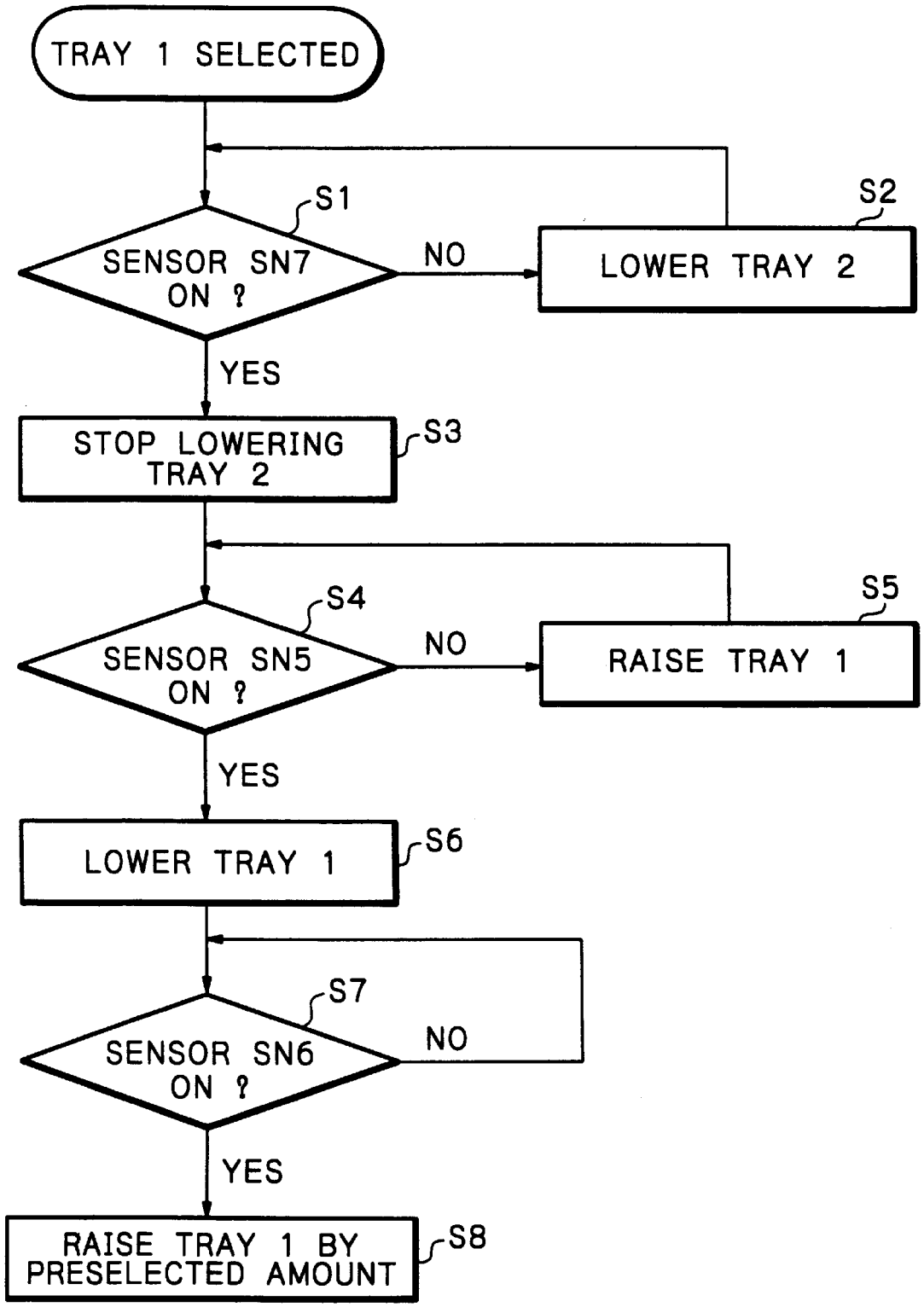
FIG. 52 is a flowchart showing a specific procedure that the sixth embodiment executes when one of the trays is selected.

When the tray 1 is selected via, e.g., the computer, the controller 100 executes a sequence of steps shown in FIG. 52. As shown, the tray 1 is brought to the outlet E2 by a procedure similar to the procedure described with reference to FIG. 51.

Figure 53:
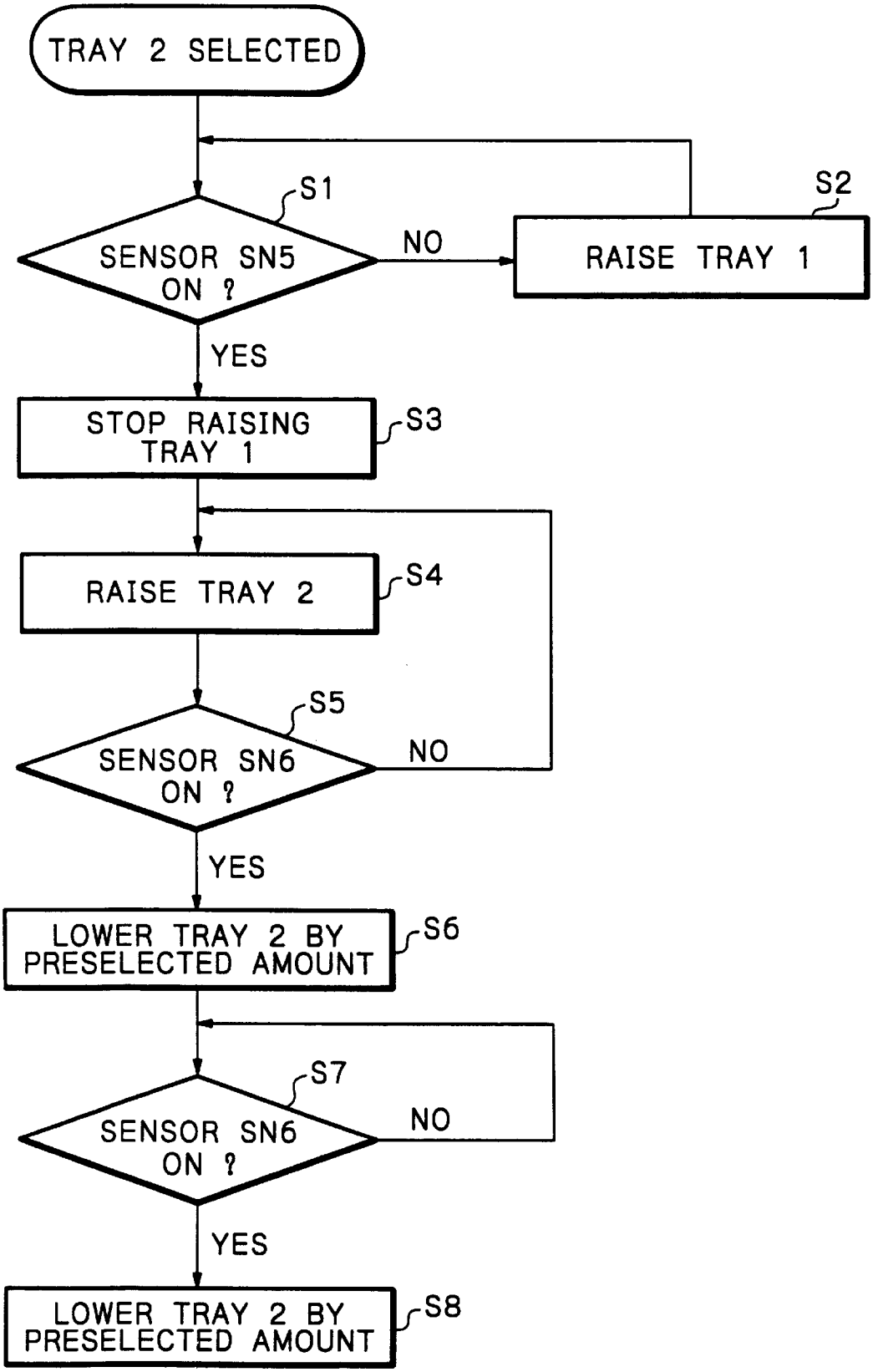
FIG. 53 is a flowchart showing another specific procedure that the sixth embodiment executes when the other tray is selected.

On the other hand, when the tray 2 is selected, the controller 100 executes a sequence of steps shown in FIG. 53. As shown, the controller 100 determines, whether or not the sensor SN5 is in an ON state, i.e., whether or not it has sensed the tray 1 (step S1). If the answer of the step S1 is NO, the controller 100 raises the tray 1 via the motor 50 (step S2). As soon as the sensor SN5 senses the tray 1, the controller 100 turns off the motor 50 and thereby stops the movement of the tray 1 (step S3).

Subsequently, the controller 100 raises the tray 2 via the motor 51 (step S51). When the sensor SN6 senses the tray 2 (YES, step S5), the controller 100 turns off the motor 51, then lowers the tray 2 by a preselected distance (step S6), and then causes papers to be stacked on the tray 2. Every time the sensor SN6 senses a paper (step S7), the controller 100 repeatedly lowers the tray 2 by a preselected amount (step S8). In this manner, the top of a paper stack on the tray 2 is constantly held at a height where other papers sequentially coming out via the outlet E2 can be stacked on the tray 2.

As stated above, when either one of the two trays 1 and 2 is selected, papers can be sequentially stacked on the tray selected. Moreover, because the tray 2 has its end fence implemented the wall of the finisher, it allows the trailing edges of papers to be positioned over a broader range than the tray 1 and can therefore accommodate a great number of papers. The procedure shown in FIG. 52 or 53 is continuously executed until the number of papers indicated by, e.g., the computer have been stacked, although not shown specifically, In the above embodiment, the tray 1 or 2 is selected in accordance with a commend received from, e.g., a computer. Alternatively, an arrangement may be made such that when an interrupt mode, for example, is selected in a copy mode, the controller 100 selects a tray other than one being used and causes papers output in the interrupt mode to be stacked; the tray may even by the proof tray, As stated above, the sixth embodiment achieves the following advantages.

(1) At least one of a plurality of trays has an end fence and a stacking surface movable up and down in synchronism with each other. In addition, one tray has an end fence implemented by the wall of the finisher body. The trays can therefore be selectively located at the paper discharge position. The tray whose end fence is implemented by the side wall of the finisher is capable of accommodating a great number of papers with a simple configuration.

(2) The trays each are driven by a respective drive source and can therefore be freely arranged. This successfully prevents the finisher from increasing in size.

(3) The trays share common guide rails. This reduces the cost and size of the finisher while simplifying the construction of the finisher.

(4) The tray having the end fence and stacking surface movable up and down in synchronism has its capacity determined by the end fence. Such trays can be arranged at a constant pitch. Therefore, by driving a plurality of trays with exclusive drive sources, it is possible to divide the trays into a group that can be arranged at the above constant pitch and the other group. This obviates an increase in cost ascribable to an increase in the number of drive sources.

(5) The guide rails each include a bent portion for preventing the end fence of the tray from interfering with the paper discharging means. This allows the paper discharging means to overlap the wall of the finisher and therefore to prevent the trailing edges of papers from returning to between the discharging means end the wall of the finisher.

(6) The bent portion of each guide rail has a length smaller than the pitch of guide means arranged on the tray. This reduces the tilting angle of the tray moving along the guide portion and thereby prevents a paper stack from dropping from the tray.

(7) Because the drive means for up-down movement are so located as not to interfere with each other, the belts forming part of the drive means can be arranged in parallel to each other. It follows that the finisher body can be reduced in size in the direction perpendicular to the parallel belts.

(8) The tray whose end fence is implemented by the wall of the finisher is located below the other trays. Therefore, a space below the lowermost tray can be used with priority, go that a great number of papers can be stacked on the lowermost stray.

(9) Because the tray selected is brought to the paper discharge position independently of the other trays, it allows papers to be stacked thereon without effecting the other trays.

Seventh Embodiment

This embodiment is directed mainly toward the seventh object stated earlier. This embodiment also differs from the previous embodiments in that the sensor SN9 responsive to the stand-by position of the tray 2 is absent.

Figure 54:
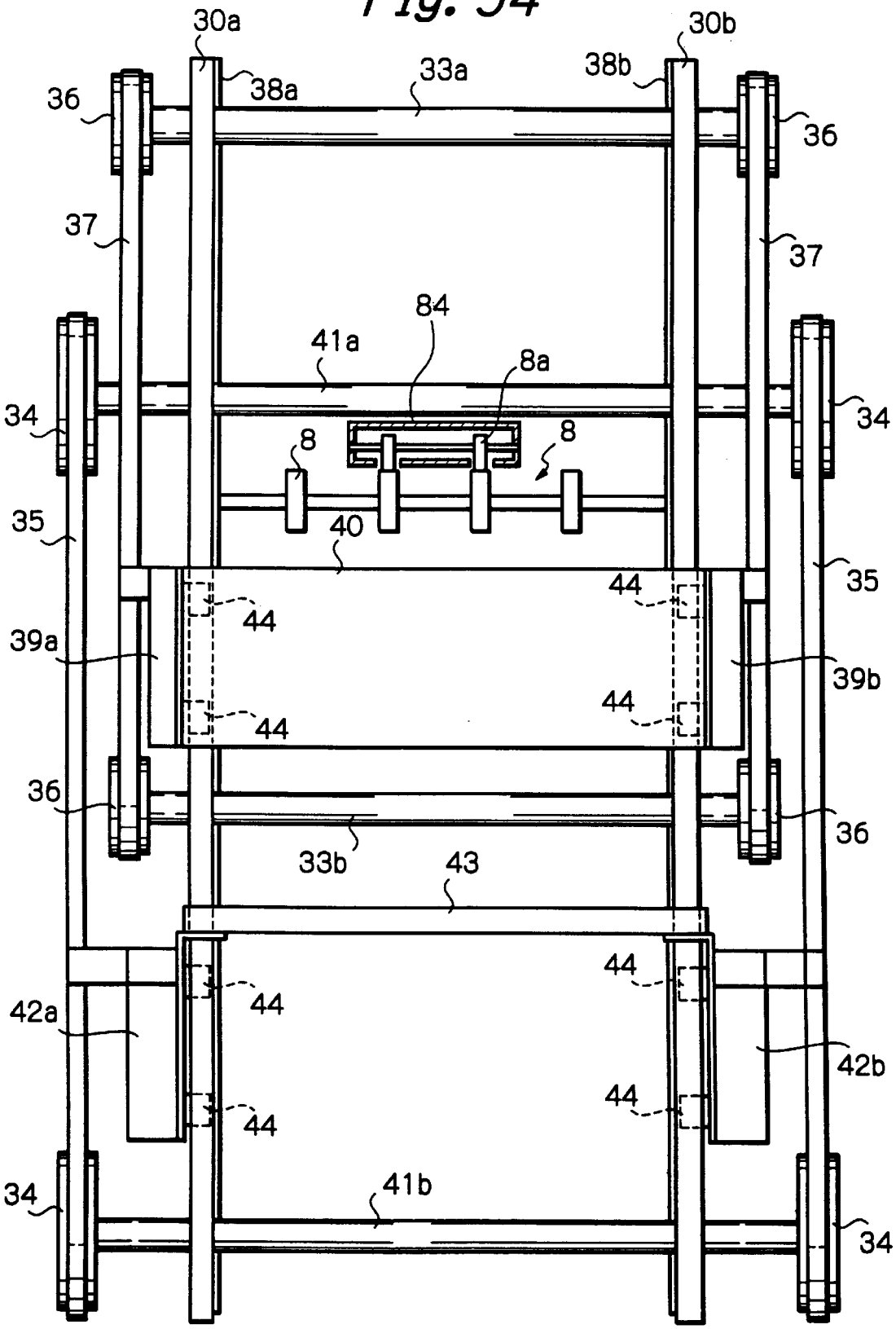
FIG. 54 is a side elevation showing a mechanism included in a seventh embodiment of the present invention for driving the lower tray up and down.

As shown in FIG. 54, a roller support member 84 is supported at its rear end in the paper discharge direction and angularly movable up and down. The driven roller 8*a* cooperative with the drive roller 8 is rotatably supported by the other or free end of the roller support member 84. A microswitch or limit switch 86 (see FIGS. 56–60) is mounted on a bracket, not shown, above the roller support member 84 and turned on or turned off by the displacement of the roller support member 84. Such an arrangement will be described more specifically later.

A shift mode is available with the illustrative embodiment. In the shift mode, papers are directly discharged to the tray 1 or 2 by way of the non-staple route B, FIG. 1. A shift signal is generated between consecutive jobs, i.e., between the last paper of a stack and the first paper of the next stack. In response, a shift motor 88 (see FIG. 2) is energized to shift the tray 1 or 2 in the direction of thrust, i.e., the direction perpendicular to the direction of paper discharge in a horizontal plane, preparing the tray for the next stack of papers. Consequently, consecutive paper stacks are offset from each other oar the tray 1 or 2.

Figure 55:
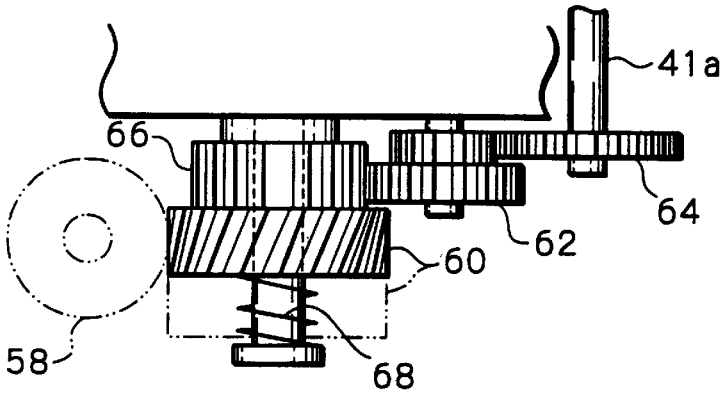
FIG. 55 is a plan view showing the mechanism of FIG. 54.

The essential part of the mechanism for moving the tray 2 up and down in the illustrative embodiment will be described with reference to FIGS. 4 and 5. As shown in FIG. 4, the output power of the motor 51 is transferred to a gear 64 mounted on the drive shaft 41*a* via a worm wheel 60 and an intermediate gear 62. The mechanism includes a safety measure for coping with the unusual downward movement of the tray 2, as follows. As shown in FIG. 55, a gear 60 coaxial with the worm wheel 60 is positioned at the rear of the worm wheel 60. The worm wheel 60 is held in mesh with the worm gear 58 by a spring 68. One of the worn wheel 60 and gear 66 is formed with a recess while the other of them is formed with a lug. The recess and lug are capable of meshing with each other in the direction of rotation, but capable of separating from each other in the axial direction. The recess and lug allow the worm wheel 60 and gear 66 to mesh with each other and rotate in synchronism so long as the torque remains in a preselected range.

When the tray 2 moves downward in an unusual manner or loaded with an excessive number of papers, the above recess and lug move away from each other with the result that the worm wheel 60 moves to a position indicated by a dash-and-dots line in FIG. 55 against the action of the spring 68. Consequently, the worm gear 58 and worm wheel 60 are released from each other, causing the tray 2 to stop moving. Such a mechanism is also applied to the other tray 1.

A tray control procedure particular to this embodiment will be described hereinafter. In the illustrative embodiment, the home position of the tray 1 is a position that the upper end of the end fence 1*a* reaches when raised by a preselected distance after being sensed by the sensor SN6. The home position of the tray 2 is a position where the sensor SN7 senses the tray 2. On the power-up of the copier G, the controller 100 determines whether or not the sensor SN7 is in an ON state. If the sensor SN7 is in an OFF state, meaning that it has not sensed the tray 2, the controller 100 lowers the tray 2 via the motor 51, determining that the tray 2 is positioned above the lower limit position. The controller 100 stops lowering the tray 2 when the sensor SN7 senses the tray 2.

Subsequently, the controller 100 determines whether or not the sensor SN5 responsive to the retracted position is in an ON state. If the sensor SN5 is in an OFF state, the controller 100 once raises the tray 1 via the motor 50 and then stops the tray 1 as soon as the sensor SN5 senses it. The controller 100 again lowers the tray 1 until the sensor SN6 senses the upper end of the and fence 1*a*, then raises the tray 1 by a preselected distance, and then stops it.

Assume that the operator selects the tray 1 on the copier G or the computer connected thereto. Then, the controller 100 first determines whether or not the sensor SN7 is in an ON state. If the sensor SN7 is in an OFF state, the controller 100 lowers the tray 2 via the motor 51, determining that the tray 2 is positioned above the lower limit position. The control far 100 stops the movement of the tray 2 when the sensor SN7 senses the tray 2. Subsequently, the controller 100 determines whether or not the sensor SN5 is in an ON state. If the sensor SN5 is in an OFF state, the controller 100 once raises the tray 1 via the motor 60 and then stops the tray 1 when the sensor SN5 senses it. The controller again lowers the tray 1 until the sensor SN6 senses the upper end of the end fence 1*a*. Thereafter, the controller 100 raises the tray 1 by a preselected amount.

When the sensor SN5 is in an ON state, the controller 100 lowers the tray 1 until the sensor SN6 senses the upper end of the end fence 1*a*. Subsequently, the controller 100 raises the tray 1 by a preselected distance and then stops it. In this condition, papers are sequentially stacked on the tray 1.

When the tray 2 is selected on the copier G or the computer connected thereto, the controller 100 first determines whether or not the sensor SN5 is in an ON state. If the sensor SN5 is in an OFF state, the controller 100 raises the tray 1 until the sensor SN5 senses it. Subsequently, the controller 100 raises the tray 2 until the sensor SN6 senses it, and then lowers the tray 2 by a preselected distance. In this condition, papers are sequentially stacked on the tray 2. Every time the top of the stack on the tray 2 is sensed by the sensor SN6, the controller 100 lowers the tray 2 by a preselected distance in order to stack a great number of papers on the tray 2. The controller 100 determines that the tray 2 is full when the sensor SN7 senses the tray 2 and when the sensor SN6 senses the top of the stack.

Figure 56:
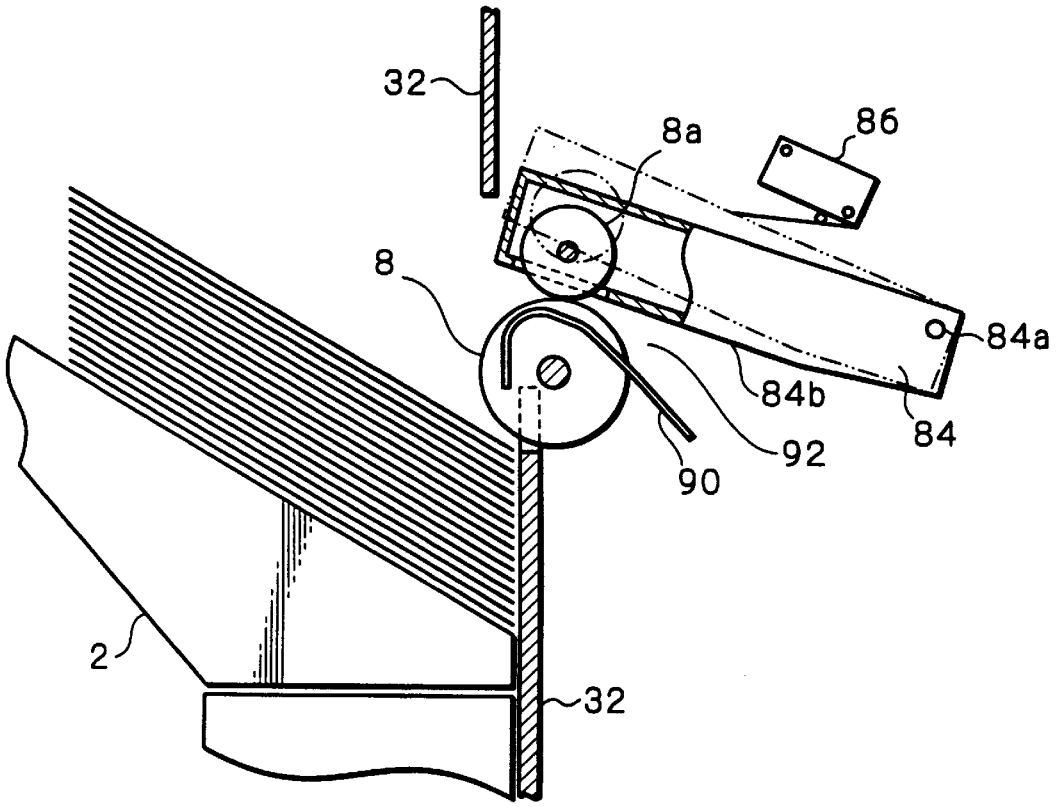
FIG. 56 is an enlarged front view of an arrangement around a paper outlet included in the seventh embodiment.

The arrangement including the roller support member 84, FIG. 54, and the safety measure unique to the illustrative embodiment will be described more specifically. As shown in FIG. 56, the roller support member 84 is rotatable up and down about a fulcrum 84*a*. The driven roller 8*a* is pressed against the drive roller or outlet roller 8 due to its own weight and the weight of the roller support member 84. The underside 84 of the roller support member 84 serves as a paper guide and forms an outlet path 92 in cooperation with a guide 90 associated with the drive roller 8.

Figure 57:
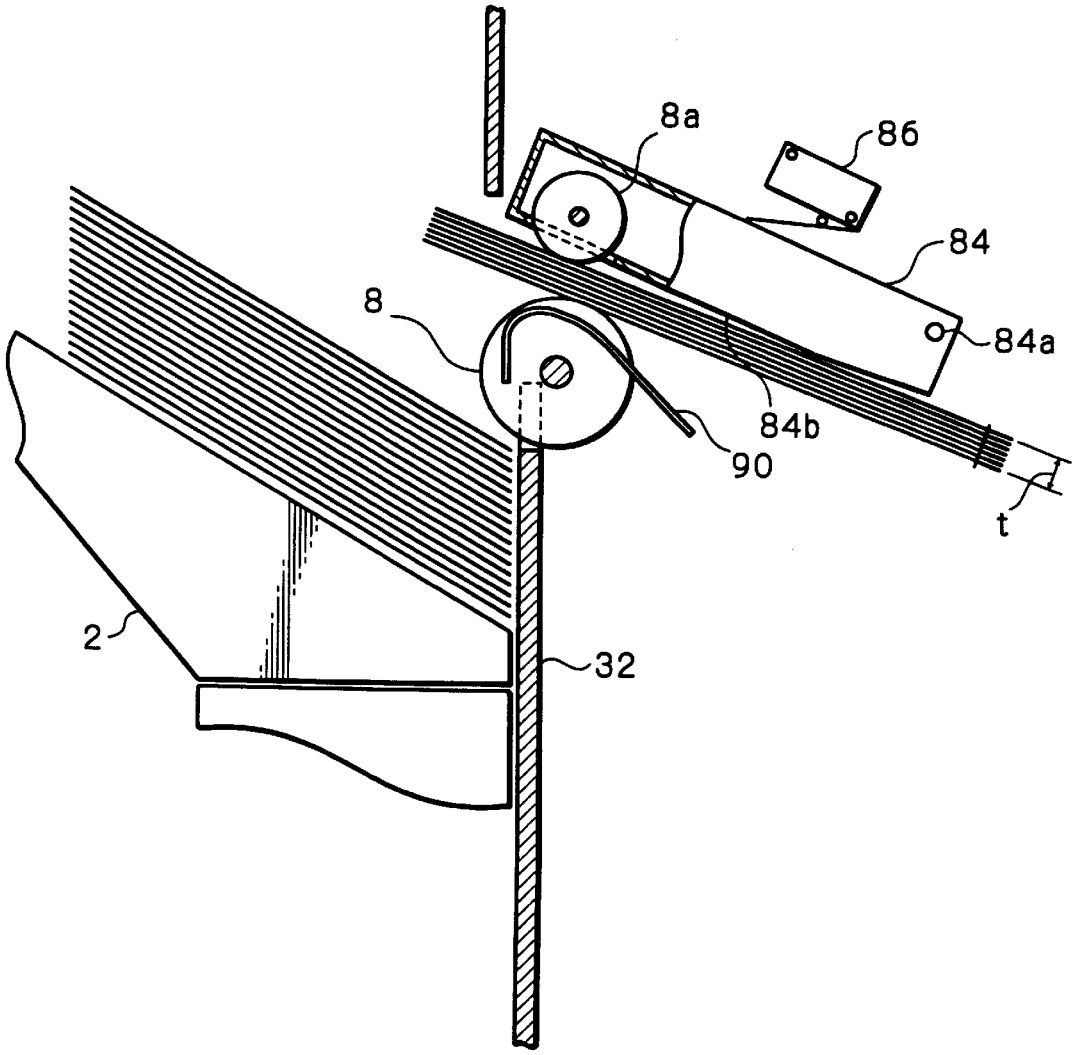
FIG. 57 is an enlarged front view showing the arrangement of FIG. 56 in a condition wherein a stack of papers is discharged via the outlet.

As shown in FIG. 57, when papers are discharged in the form of a stack, the roller support member 84 is angularly moved in accordance with the thickness t of the stack. As a result, the driven roller 8*a* is moved away from the drive roller 8.

When, the roller support member 84 moves upward over an angle slightly greater than one corresponding to the maximum thickness t of papers or paper stack, the roller support member 84 contacts the microswitch 86 and turns it off. In the illustrative embodiment, the maximum thickness t is assumed to be the thickness of a stapled stack of fifty papers. It follows that when the operator's hand or a similar object whose thickness is greater than the thickness t is a put between the roller 8 and 8*a,* the microswitch 86 turns off.

Figure 58:
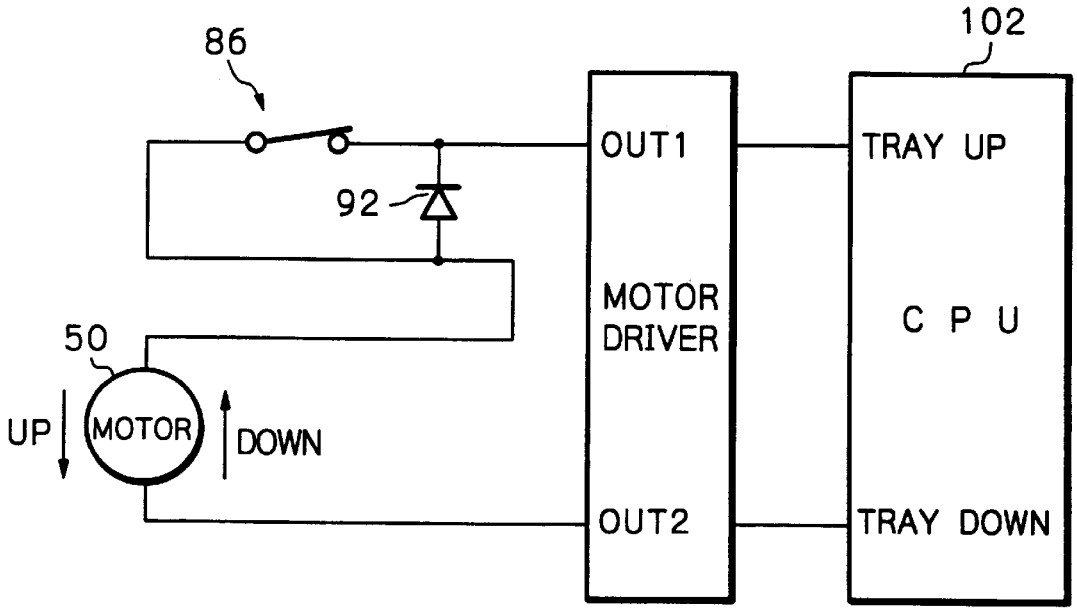
FIGS. 58 and 59 are schematic block diagrams each showing a particular condition of switching means included in the seventh embodiment.

Specifically, as shown in FIG. 58, a diode 92 is connected in parallel between the motor 50 assigned to the tray 1 and the microswitch 86. When the thickness of the papers or paper stack discharged is less than t, the microswitch 86 remains in its ON state. In this condition, the tray 1 is movable up and down, as needed.

Figure 59:
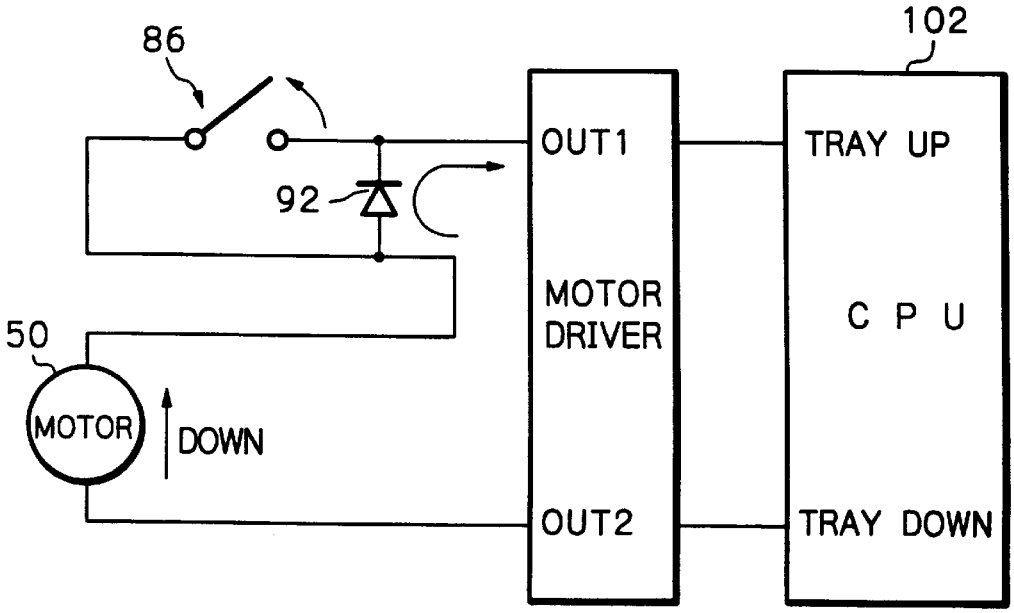

Assume that an object having a thickness greater than the thickness t is put between the roller 8 and 8*a,* moving the roller support member 84 by more than the preselected angle corresponding to the thickness t. Then, as shown in FIG 59, the upper surface of the roller support member 84 presses the contact of the microswitch 86 and thereby turns off the microswitch 86. As a result, a current stops flowing through the elevation side of a motor driver, causing the tray 1 to stop rising.

Figure 60:
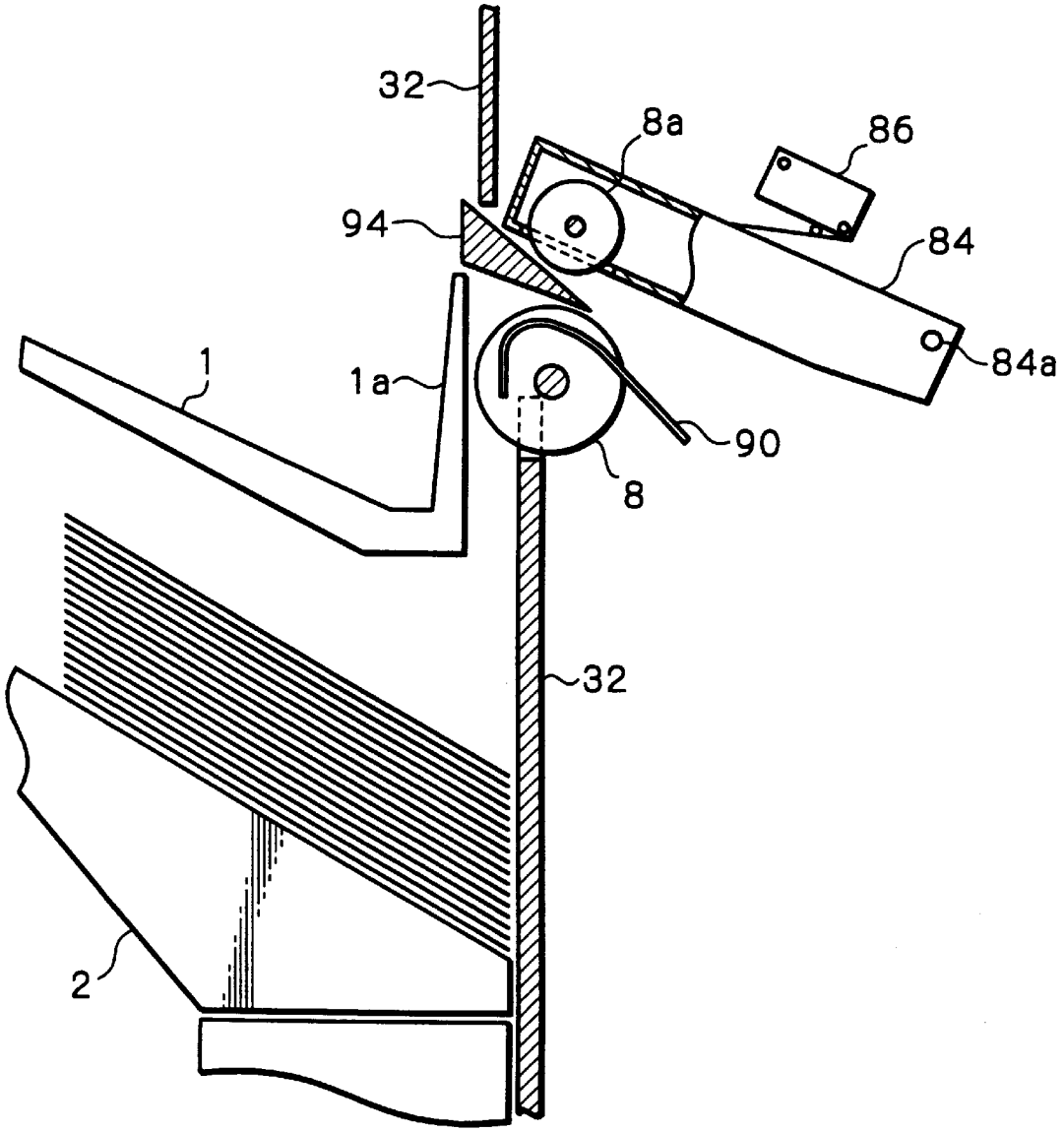
FIG. 60 is an enlarged front view of the arrangement around the paper outlet in which a pair of outlet rollers are moved away from each other by an unexpected object.

More specifically, as shown in FIG. 60, when the operator's hand or similar object 94 is put between the rollers 8 and 8*a* while the tray 1 is retracting upward from the paper discharge position, the tray 1 stops rising. This protects the operator from injury and protects the finisher from damage ascribable to the object and tray 1 otherwise hitting against each other.

As stated above, the illustrative embodiment achieves the following unprecedented advantages.

(1) When the thickness of papers or paper stack discharged by the outlet roller pair is greater than the preselected thickness, the tray is inhibited from moving, e.g., upward. This protects the operator from injury and protects the finisher from damage.

(2) Because the roller support member has a paper guide surface, an extra paper guide is not necessary.

(3) The switch means is actuated at a position exceeding the thickness that the finisher itself can discharge. It follows that optimal safety matching with the finisher is achievable.

Eighth Embodiment

Figure 61:
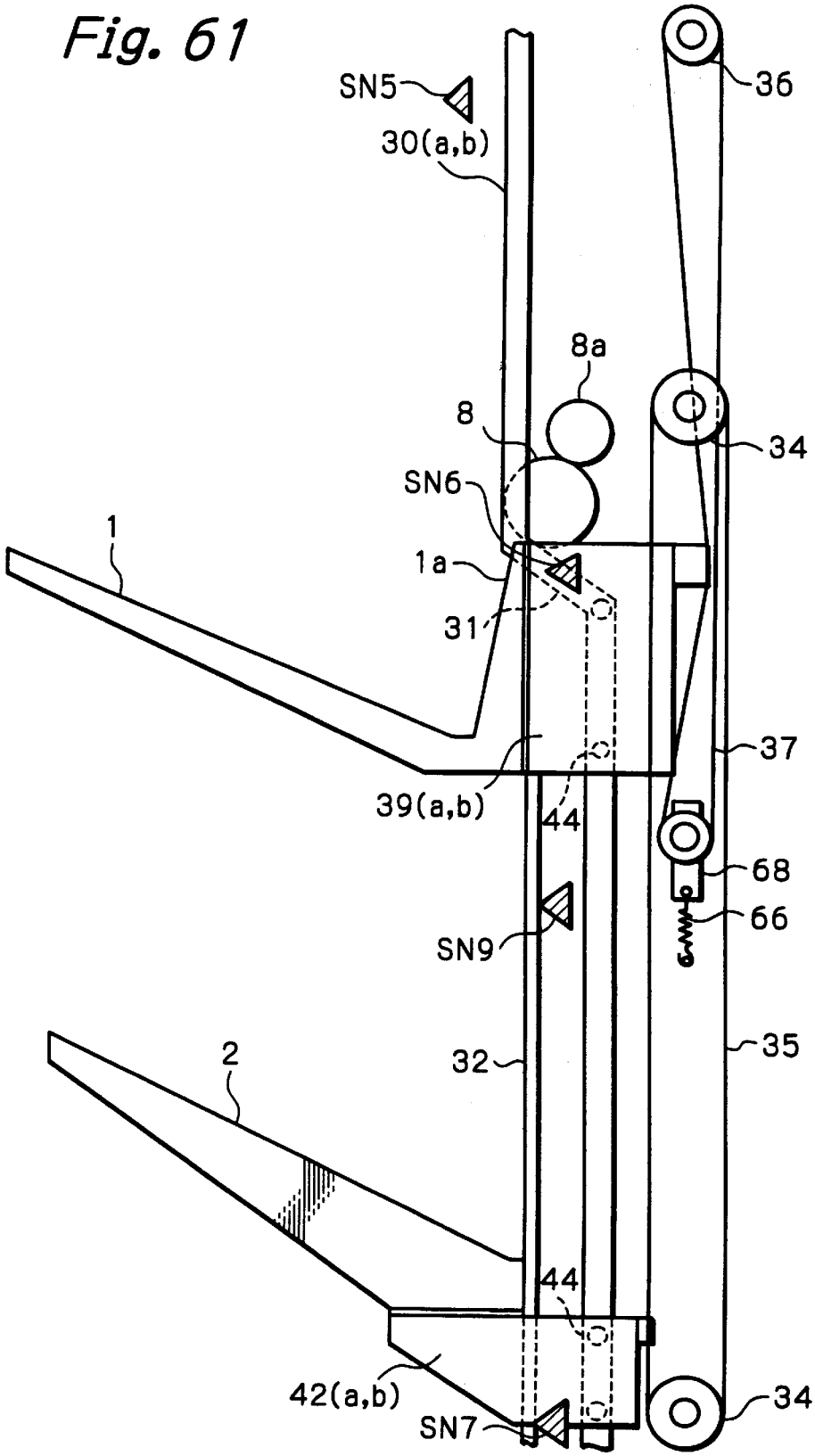
FIG. 61 is a front view showing a mechanism included in an eighth embodiment of the present invention for moving the trays up and down in a particular condition.
Figure 62:
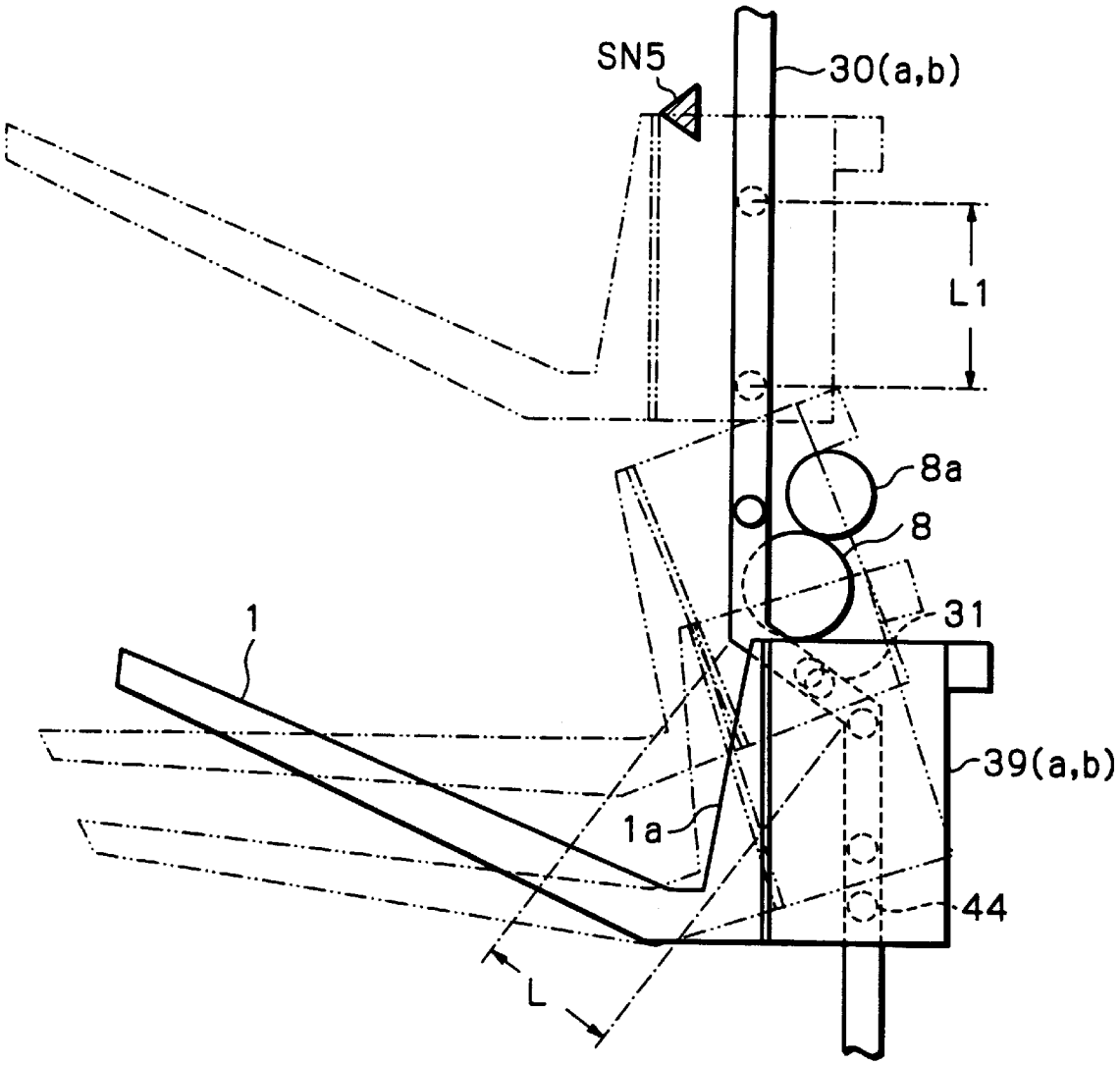
FIGS. 62 and 63 are front views each showing the mechanism of FIG. 61 in another particular condition.
Figure 63:
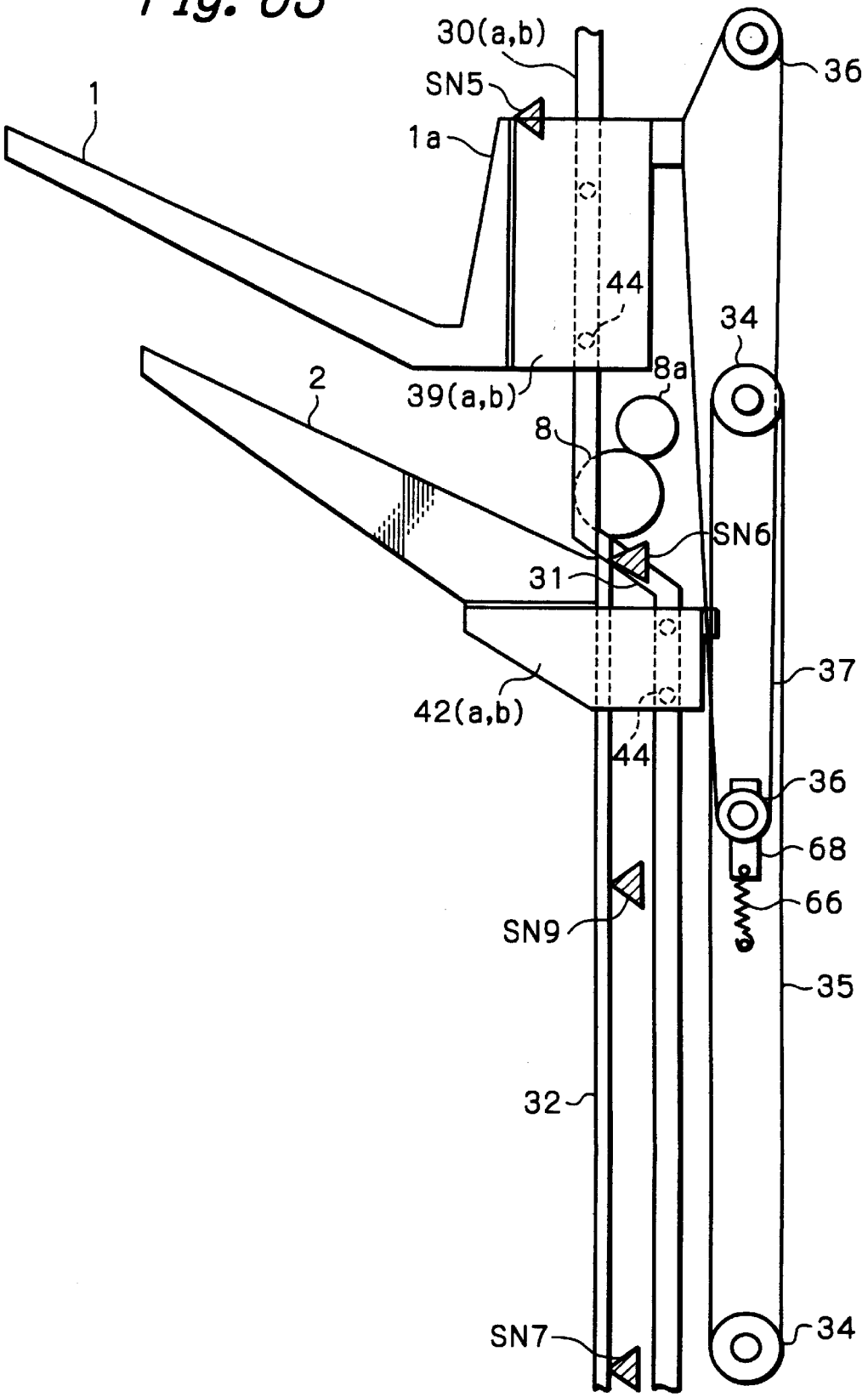

This embodiment is directed mainly toward the eighth object stated earlier. This embodiment is identical with the seventh embodiment as to the shift mode operation and the construction and movement of the tray 2. As shown in FIGS. 61–63, this embodiment differs from the previous embodiments as to the positions of the sensors SN5 and SN7. Again, the tray 1 expected to retract upward away from the outlet 2 includes the end fence 1*a* in order to obviate the need for a sophisticated shutter mechanism otherwise arranged in the outlet E2.

A tray control procedure unique to the eighth embodiment will be described hereinafter. As shown in FIG. 9, the hone position of the tray 1 is a position where the sensor SN5 responsive to the retracted position senses the upper end of the and fence 1*a*. The home position of the tray 2 is a position where the sensor SN9 responsive to the retracted position senses the lower rear end (lower end hereinafter) of the tray 2 in the direction of paper discharge.

Figure 64:
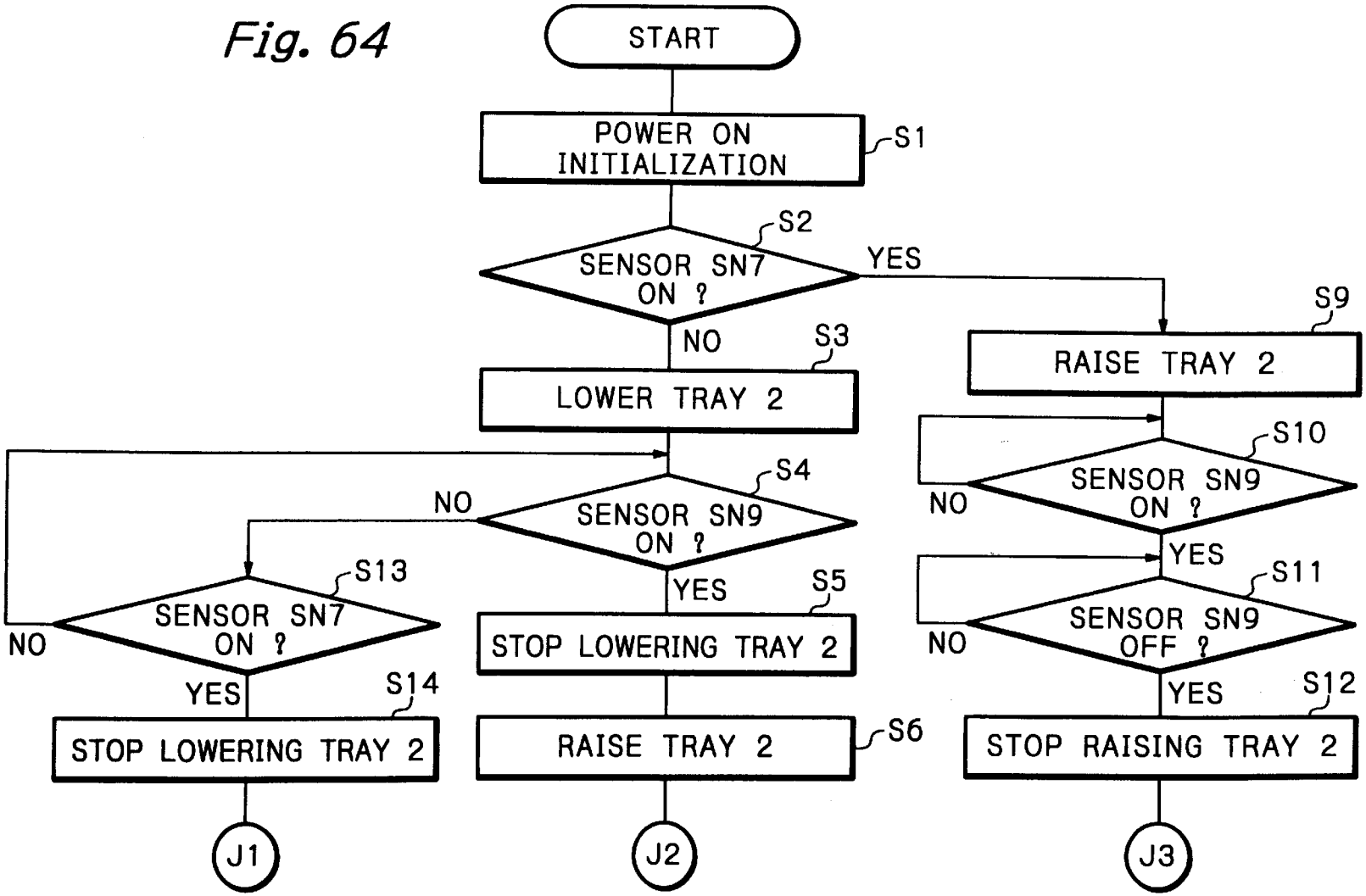
FIGS. 64 and 65 are flowcharts showing a specific procedure which the eighth embodiment executes for locating the upper tray and lower tray at their home positions.
Figure 65:
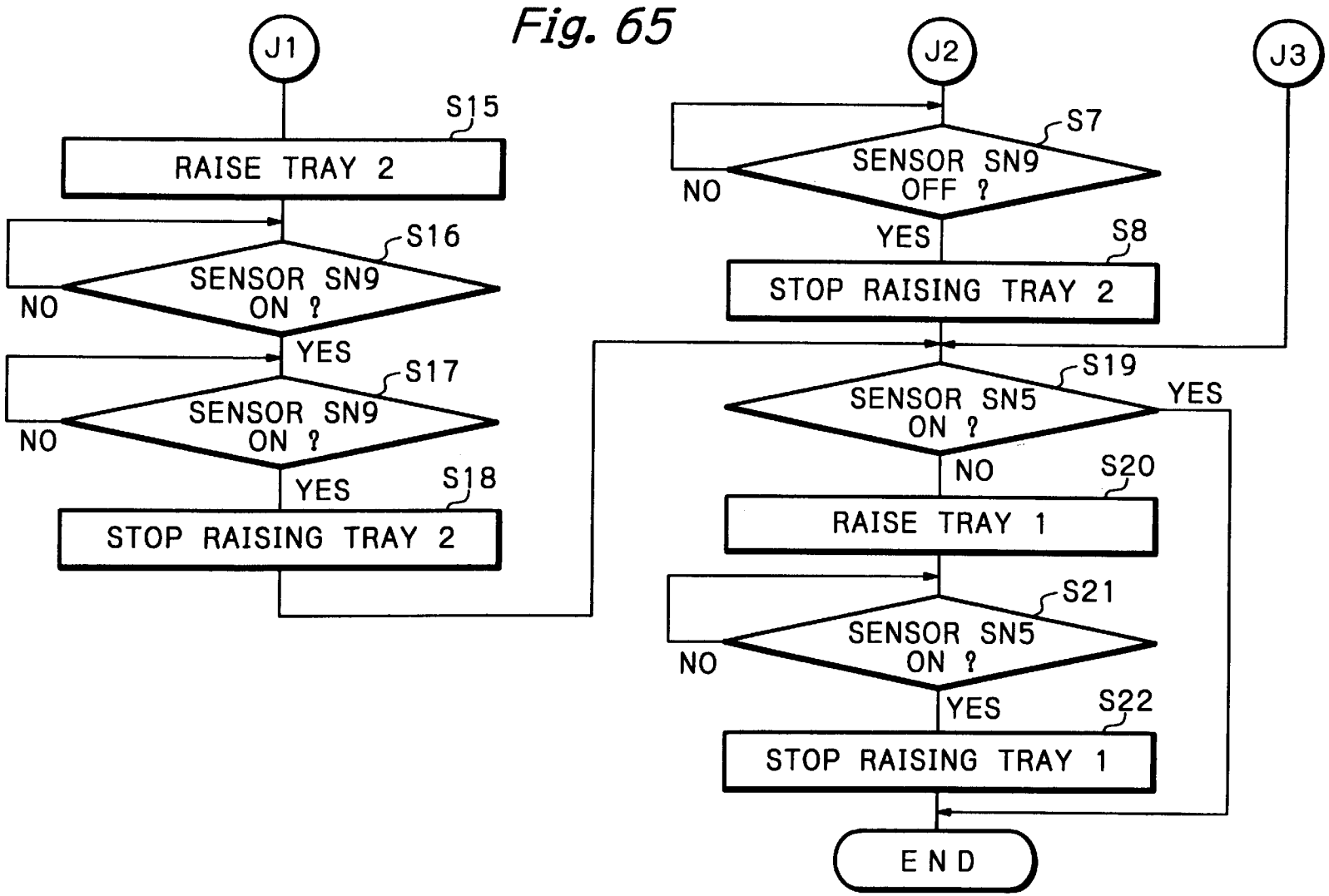

FIGS. 64 and 65 demonstrate how the controller 100 locates the trays 1 and 2 at their home positions. The controller 100 may cause the trays 1 and 2 to start moving at the same time, if desired. As shown, on the power-up of the copier G, initialization begins (step S1). The controller 100 determines whether or not the sensor SN7 is in an ON state (step S2). If the sensor SN7 is in an OFF state (NO, step S2), the controller 100 lowers the tray 2 via the motor 51 (step 53), determining that the tray 2 is positioned above the lower limit position. Then, the controller 100 determines whether or not the sensor SN9 is in an ON state (step S4). If the answer of the step S4 is YES, the controller 100 stops moving the tray 2 (step S5) and again raises it (step S6). Subsequently, the controller 100 determines whether or not the sensor SN9 is in an OFF state (step S7), and stops the tray 2 (step S8) when the sensor SN9 turns off (YES, step S7). As a result, the lower end of the tray 2 is located at the stand-by position or home position to which the sensor SN9 is responsive.

If the answer of the step S2 is YES, meaning that the tray 2 is located at the lower limit position, the controller 100 raises the tray 2 (step S9) and determines whether or not the sensor SN9 turns on (step S10). When the sensor SN9 turns on (YES, step S10), meaning that it senses the upper end of the tray 2), the controller 100 continuously determines the status of the sensor SN9 (step S11). As soon as the sensor SN9 turns off (YES, step S11), the controller 100 stops raising the tray 2. Consequently, the lower end of the tray 2 is located at the stand-by position.

When the tray 2 is located between the lower limit position and the stand-by position, i.e., if the sensor SN6 is in an OFF state in the step S4, the controller 100 determines whether or not the sensor SN7 is in an ON state (step S13). If the answer of the step S13 is YES, the controller stops the tray 2 (step S14) and then raises it (step S15). Subsequently, the controller 199 determines whether or not the sensor SN9 is in an ON state (step S16). If the answer of the step S16 is YES, meaning that the sensor S16 has sensed the upper end of the tray 2, the controller determines the status of the sensor SN9 (step S17). When the sensor SH9 turns off (YES, step S17), the controller 100 stops moving the tray 2 (step S18). Consequently, the lower end of the tray 2 is located at the stand-by position.

After the step S18, the controller 100 determines whether or not the sensor SN5 is in an ON state (step S19). If the answer of the step S19 is NO, the controller 100 raises the tray 1 via the motor 50 (step S20) and continuously determines the status of the sensor SN5 (step S21). When the sensor SN5 turns on (YES, step S21), the controller 100 stops moving the tray 1 (step S22).

Reference will again be made to FIG. 12 showing a specific condition wherein papers are sequentially stacked on the tray 2 while the tray 1 is held in its retracted position. The position of the tray 2 for receiving papers via the outlet E2 is coincident with the position where the sensor SN6 senses the upper end of the tray 2 or the top of papers stacked thereon. As shown in FIG. 13, when papers are sequentially stacked an the tray 1 while the tray 2 is held in its retracted position, the tray 2 is held in its lower limit position in order to prevent papers stacked thereon from contacting the tray 1.

In the condition shown in FIG. 12, when the sensor SN6 senses the top of sheets stacked on the tray 2, the controller 100 lowers the tray 2 by a preselected distance. The controller 100 repeats this operation when a great number of papers are stacked on the tray 2. The controller 100 determines that the tray 2 is full when the sensor SN9 senses the lower end of the tray 2 and when the sensor SN6 senses the top of papers stacked on the tray 2, as shown in FIG. 14.

The controller 100 detects the full state of the tray 2 when the tray 2 is positioned above the lower limit position, so that the tray can be switched from the tray 2 to the tray 1 without the papers being removed from the tray 2. In the illustrative embodiment, the sensor SN9 responsive to the stand-by position serves to sense the full state, of the tray 2 at the same time. FIG. 15 shows a specific condition wherein the full tray 2 is retracted to its lower limit position while the tray 1 is brought to the outlet E2.

The full tray 2 must be retracted by an amount great enough for the tray 1 to be located at the position for receiving papers from the outlet E2. Therefore, as shown in FIG. 14, the above amount is determined by the amount of papers that can be stacked on the tray 1, i.e., the height H1 of the end fence 1*a*. More specifically, if the sensor SN9 is positioned above the sensor SN7 by a distance H (between the stand-by position and the lower limit position) greater than the height H1, the sensor SN9 can play the role of a tray 2 full sensor (full sensing means) and a stand-by position sensor at the same time. However, the prerequisite is that the distance H1 between the sensors SN6 and SN9 (overall height of the full tray 2 including papers) be greater than or equal to the distance H.

Figure 66:
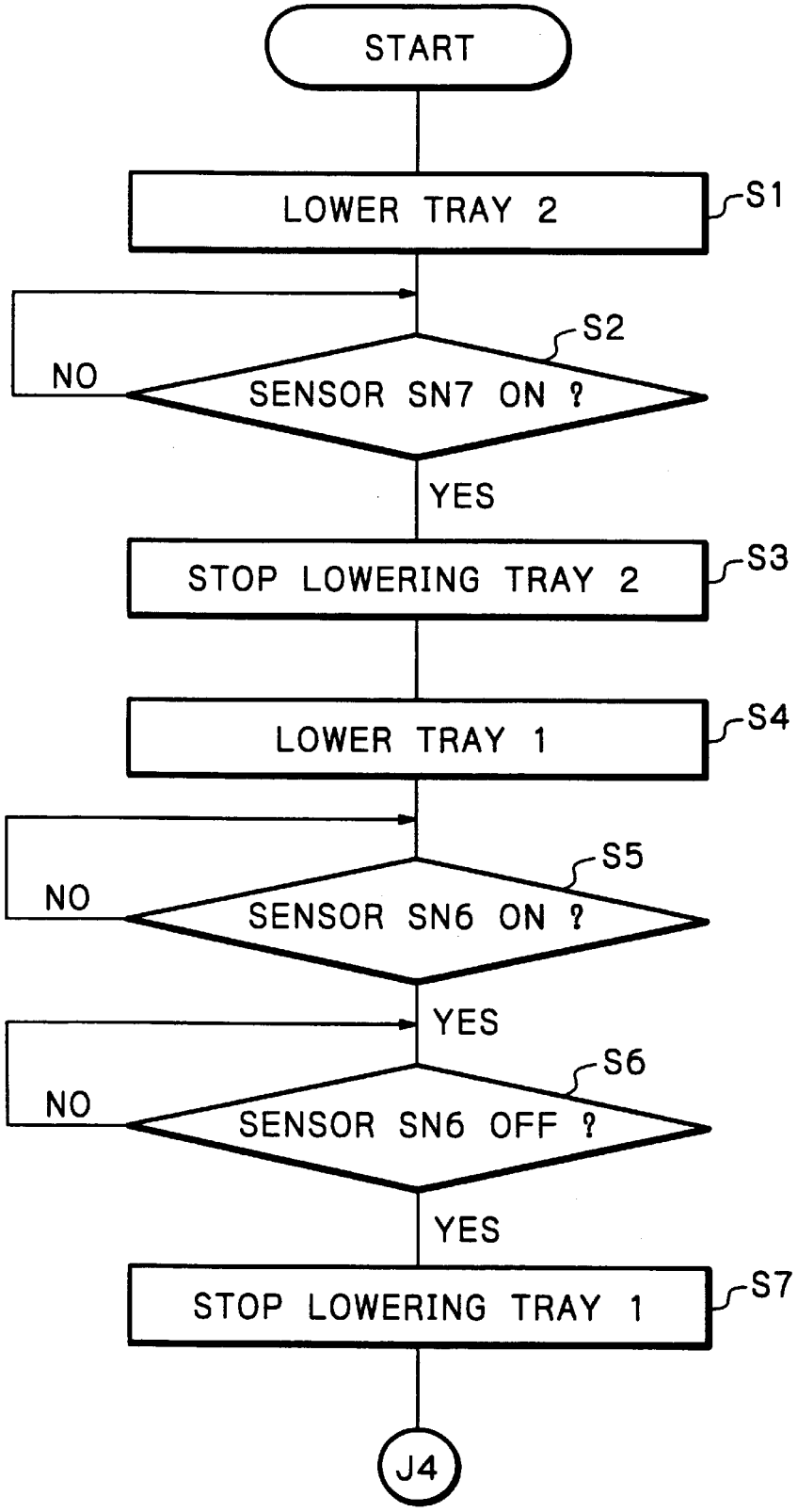
FIGS. 66 and 67 are flowcharts showing another specific procedure which the eighth embodiment executes for causing the lower tray to retract when the number of papers stacked thereon is small.
Figure 67:
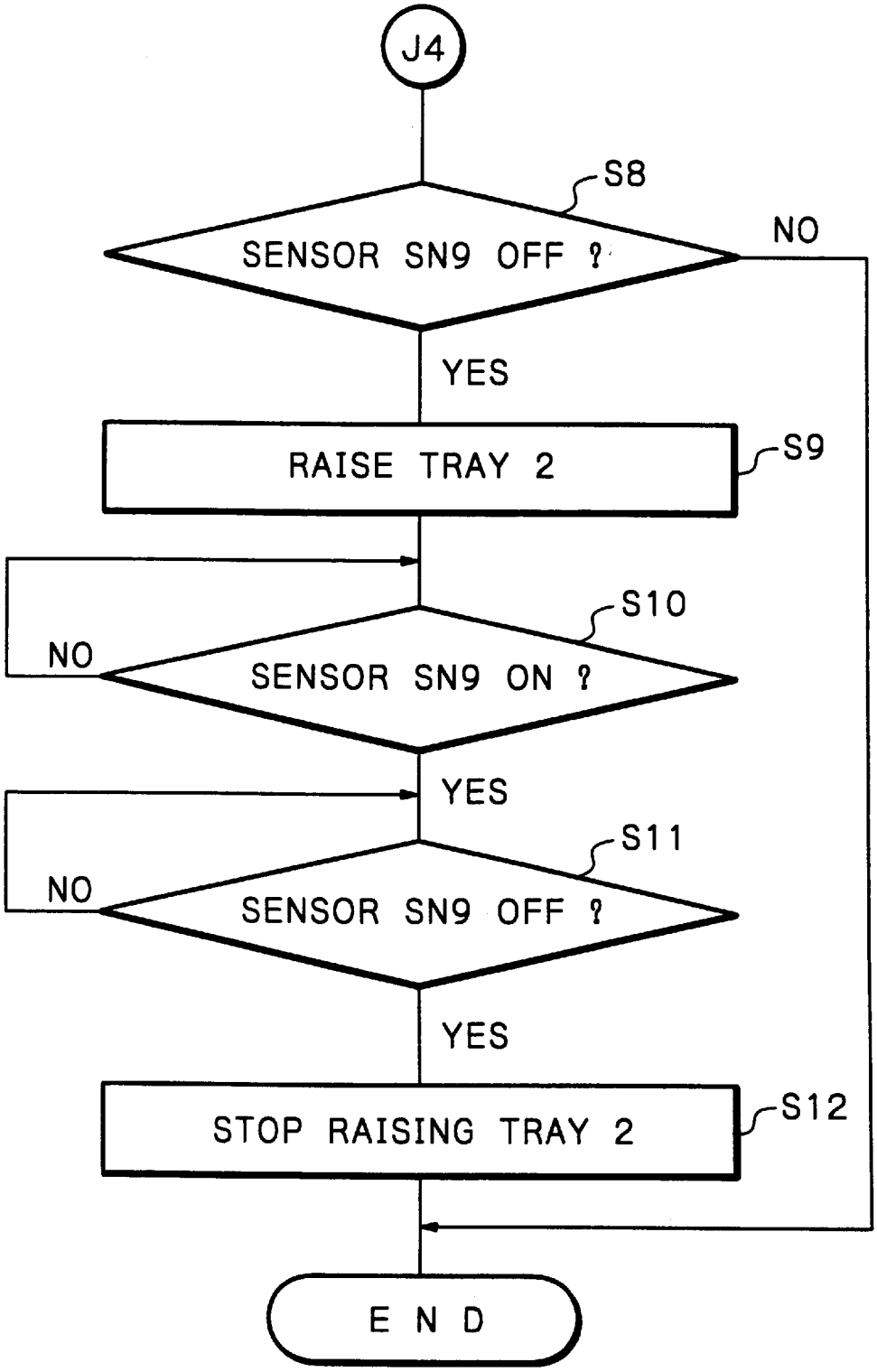

Assume that papers should be discharged to the tray 1 when the trays 1 and 2 each are held in the respective home position. Then, as shown in FIGS. 66 and 67, the controller 100 lowers or retracts the tray 2 (step S1). When the sensor SN7 responsive to the lower limit position turns on (YES, step S2), the controller 100 stops lowering the tray 2 (step S3) and lowers the tray 1 (step S4). Subsequently, when the sensor SN6 turns on (YES, stop 55), meaning that it has sensed the lower end of the tray 1, the controller 100 continuously determines the status of the sensor SN6. When the sensor SN6 turns off (YES, step S6), the controller 100 stops lowering the tray 1 (step S7), After the step S7, the controller 100 determines whether or not the sensor SN9 is in an OFF state (step S8). If the answer of the step S8 is YES, the controller 100 raises the tray 2 to the retracted position (step S9), determining that the number of papers on the tray 2 is small. As soon as the sensor SN9 turns on, i.e., senses the upper end of the tray 2 (YES, step S10), the controller 100 continuously determines the status of the sensor SN9 (step S11). When the sensor SN9 turns off (YES, step S11), the controller stops raising the tray 2 (step S12). As a result, the lower end of the tray 2 is located at the retracted position.

When the tray 2 is selected in place of the tray 1 later, the tray 2 moves from the above stand-by position closer to the outlet E2 than the lower limit position, or original retracted position, to the outlet E2. This reduces a period of time necessary for the tray 2 to reach the outlet E2.

Figure 68:
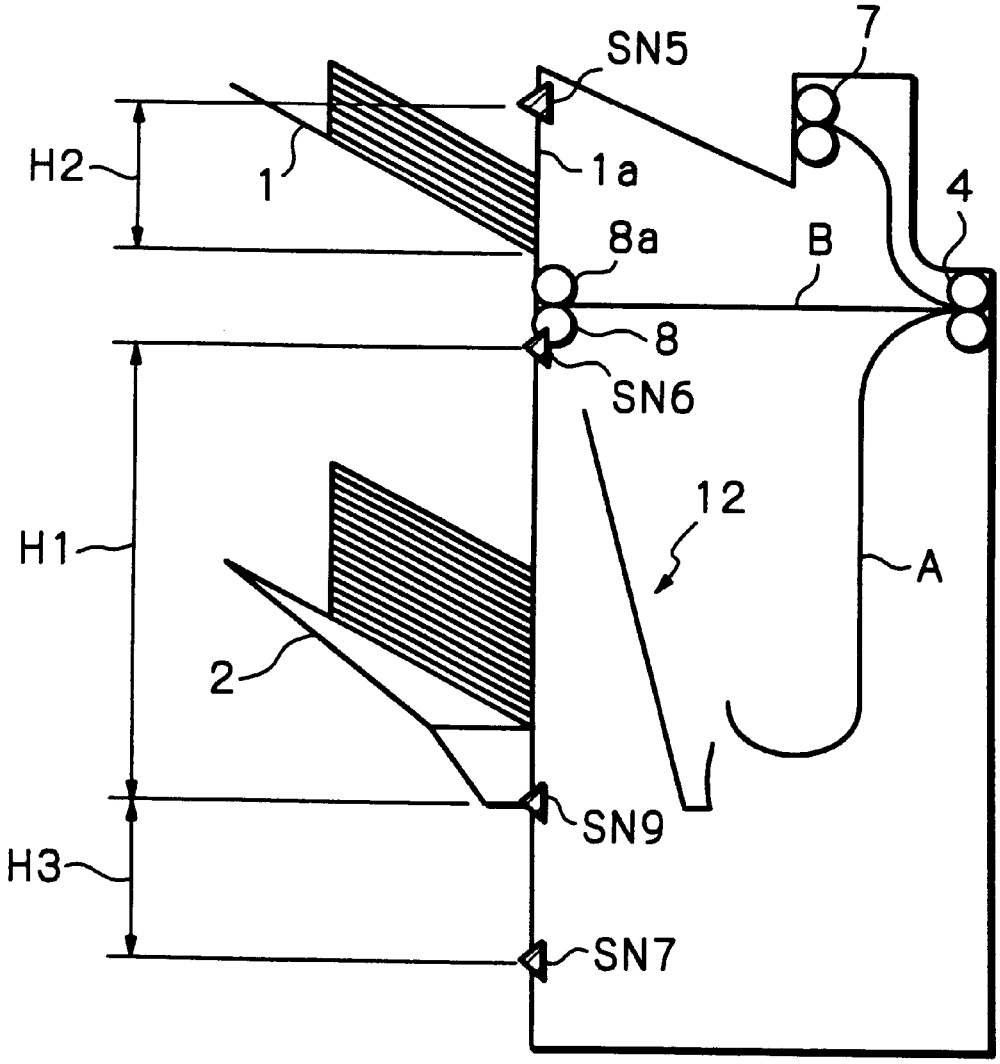
FIG. 68 is a front view showing the lower tray retracted to a stand-by position.

Assume that the number of papers stacked on the tray 2 is small when papers are being discharged to the tray 1. In this condition, the trays 1 and 2 must be prevented from colliding with each other even when the tray 2 is raised to the position where the sensor SN9 senses the lower end of the tray 2 (stand-by position). To meet this requirement, the illustrative embodiment is so configured as to satisfy relations of H3≧H1 and H1≧H2+H3, as shown in FIG. 68.

Figure 69:
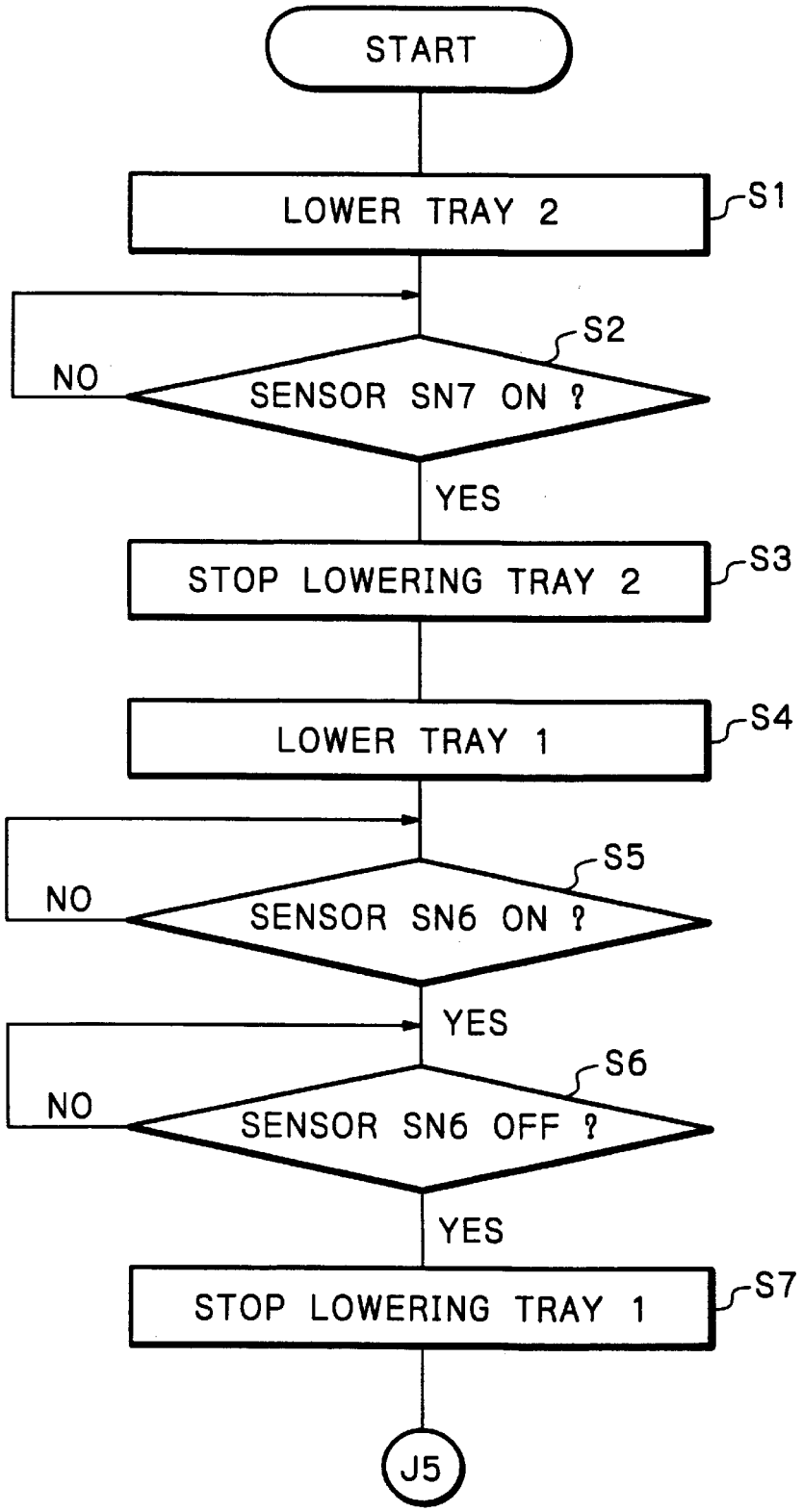
FIGS. 69 and 70 are flowcharts showing another specific procedure which the eighth embodiment executes for causing the lower tray to retract to the stand-by position when papers are removed therefrom.
Figure 70:
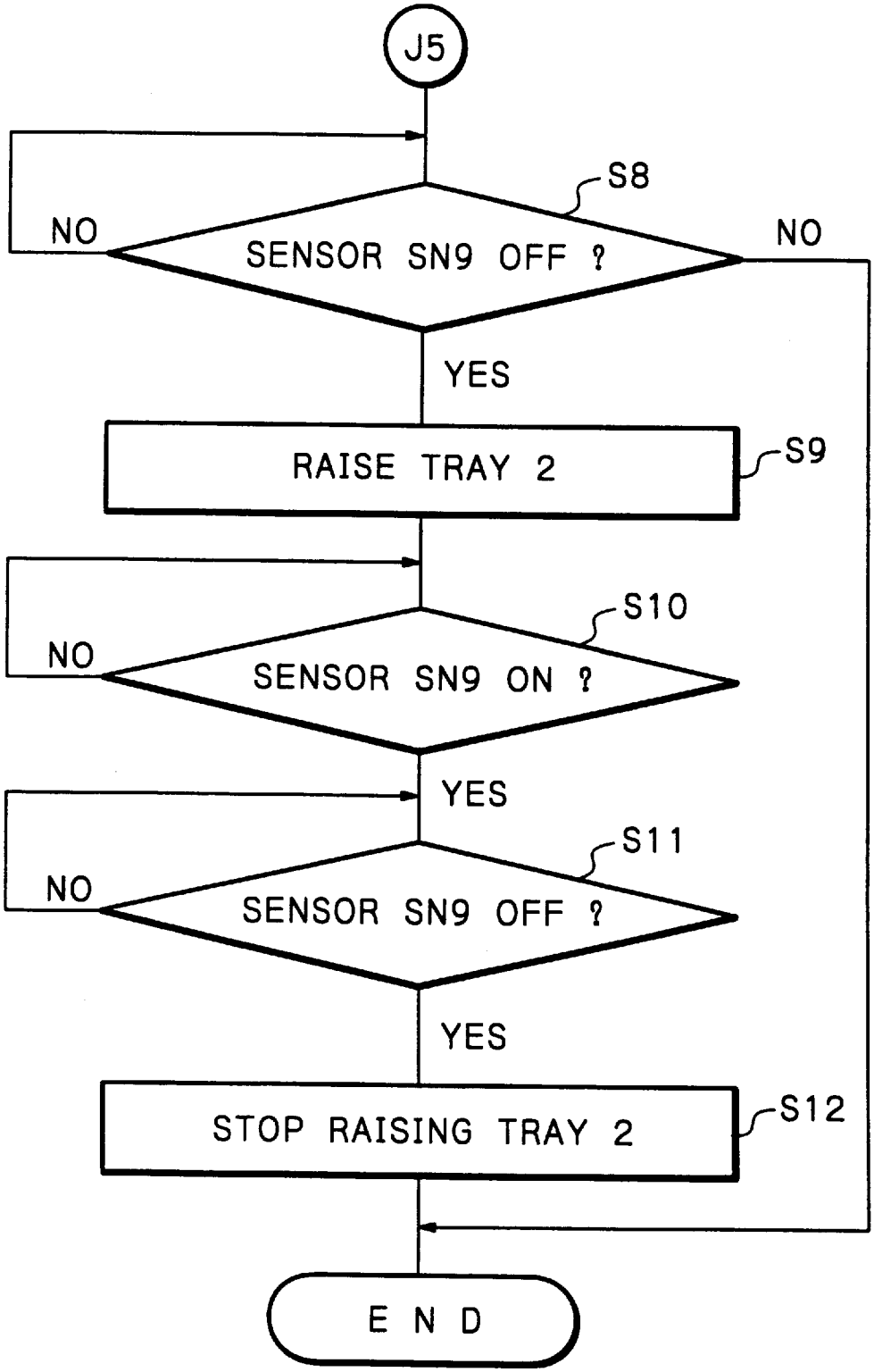

Reference will be made to FIGS. 69 and 70 for describing a tray control procedure to be executed when the trays 1 and 2 each are held at the respective home position, when papers should be discharged to the tray 1, and when papers are removed from the tray 2. As shown, the controller 100 lowers or retracts the tray 2 (step S1). As soon as the sensor SN7 senses the tray 2 and turns on (YES, step 32), the controller 100 stops lowering the tray 2 (step S3) and lowers the tray 1 (step S4). Subsequently, the controller 100 determines whether or not the sensor SN6 is in an ON state (step S8). If the answer of the step S5 is YES, the controller 100 continuously determines the status of the sensor SN6 (step S6). When the sensor SN6 turns off (YES, step S6), the controller 100 stops towering the tray 1 (step 37).

Figure 72:
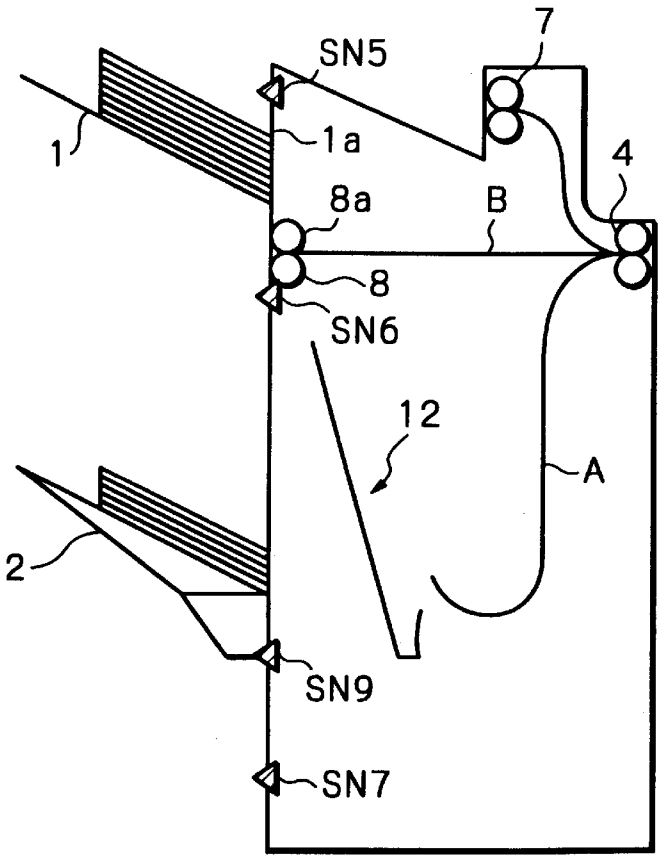
FIG. 72 is a front view showing the lower tray retracted to its stand-by position after the removal of papers.
Figure 71:
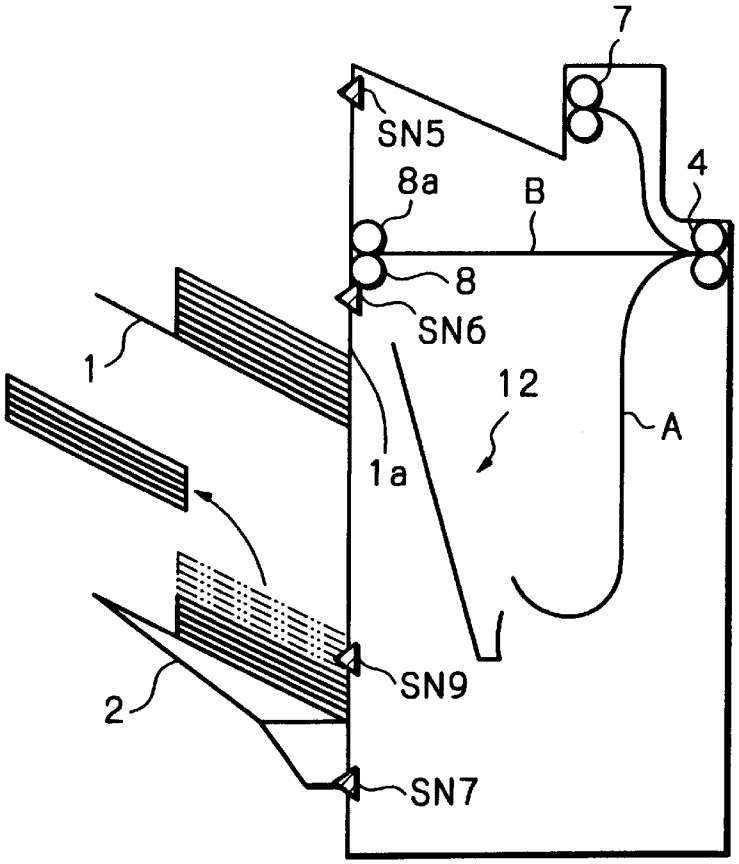
FIG. 71 is a front view showing the lower tray of the eighth embodiment from which papers have been removed.

Subsequently, the controller 100 determines whether or not the sensor SN9 is in an OFF state (step S8). As shown in FIG. 71, when the papers are removed from the tray 2 the sensor SN6 turns off. If the answer of the step S8 is YES, the controller 100 raises the tray 2 so as to use the stand-by position as the retracted position (step S9), determining that the number of papers on the sheet 2 is small. When the sensor SN9 turns on (YES, step S10), the controller continuously determines the status of the sensor SN9 (step S11). When the sensor SN9 turns off (YES, step S11), the controller 100 stops raising the tray 2 (step S12). Consequently, the lower end of the tray 2 is located at the stand-by position, as shown in FIG. 72.

When the tray 2 is selected in place of the tray 1 later, the tray 2 moves from the above stand-by position closer to the outlet E2 than the lower limit position, or original retracted position, to the outlet E2. This reduces a period of time necessary for the tray 2 to reach the outlet E2.

While the above embodiment includes a single tray 1, it is similarly practicable with a plurality of trays 1. The finisher may, of course, be constructed integrally with the copier G or similar image forming apparatus. If desired, the number of papers stacked on the tray 2 may be calculated by using the thickness of each paper and the number of papers.

As stated above, the illustrative embodiment achieves various advantages, as enumerated below.

(1) When the number of papers stacked on the lower tray is small, the stand-by position of the lower tray above the lower limit position is used as the retracted position. This reduces the period of time necessary for the lower tray to move to the outlet and thereby enhances rapid operation.

(2) The stand-by position sensing means determines the number of papers stacked an the lower tray. The decision is therefore easy and accurate.

(3) When the stand-by position sensing means assigned to the lower tray turns off due to the removal of papers from the lower tray, the stand-by position is used as the retracted position. This also reduces the period of time necessary for the lower tray to reach the outlet.

(4) When the retracted position of the lower tray is used as the stand-by position, the upper and lower trays are surely prevented from colliding with each other.

(5) the stand-by position sensing means plays the role of the full sensing means at the same time and therefore eliminates the need for extra full sensing means which would sophisticate the construction and increase the cost.

Various modifications will become possible for those skilled in the art after receiving the teachings of the present disclosure without departing from the scope thereof.

What is claimed is:

1. A finisher for an image forming apparatus, comprising: a paper outlet configured to discharge papers transferred from said image forming apparatus to said finisher:

a plurality of trays each capable of being selectively located at said paper outlet, including at least two trays moveable up and down independently of each other; and control means for locating a designated one of said at least two trays at said paper outlet.

2. A finisher as claimed in claim 1, wherein if the designated tray to be moved to said paper outlet would be obstructed by the other movable tray, said control means starts retracting said other movable tray and then starts moving said designated tray toward said paper outlet.

3. A finisher as claimed in claim 2, wherein said control means moves said other movable tray to move at a higher speed than said designated tray while starting moving said other movable tray and said designated tray at the same time.

4. The finisher of claim 1, wherein said control means locates said designated one of said at least two trays at said paper outlet during a finish processing of said papers before said papers are discharged from said paper outlet.

5. The finisher of claim 4, further comprising a stapling device, wherein said finish processing comprises stapling said papers.

6. The finisher of claim 1, further comprising a plurality of drive sources each corresponding to a respective one of said plurality of trays, wherein when any one of said plurality of trays is selected in accordance with a mode selected on said image forming apparatus, the tray selected is moved to said paper outlet by a respective drive means independently of others of said plurality of trays.

7. The finisher of claim 6, wherein when said selected one of said plurality of trays is obstructed from being moved to said paper outlet by another one of said plurality of trays, said other tray is moved out of obstruction before said selected tray is moved to said paper outlet.

8. The finisher of claim 6, wherein each of said drive means is positioned so as not to interfere with others of said drive means.

9. The finisher of claim 1, further comprising:

a first drive source configured to move a first of said at least two trays up and down; and a second drive source configured to move a second of said at least two trays up and down.

10. The finisher of claim 9, further comprising:

a vertical guide rail positioned adjacent to said paper outlet and configured to guide said first and second tray along said up and down movements, wherein said first tray is positioned above said second tray on said guide rail.

11. The finisher of claim 10, wherein when said first tray is selected in accordance with a mode selected on said image forming apparatus, said first and second tray are moved to positions on said guide rail below said paper outlet.

12. The finisher of claim 10, wherein when said second tray is selected in accordance with a mode selected on said image forming apparatus, said first tray is moved to a position on said guide rail above said paper outlet, and said second tray is moved to a position on said guide rail below said paper outlet.

* * * * *